US006810217B2

(12) United States Patent
Hiratsuka et al.

(10) Patent No.: US 6,810,217 B2
(45) Date of Patent: Oct. 26, 2004

(54) PROCESS CARTRIDGE

(75) Inventors: Kaori Hiratsuka, Shizuoka (JP); Hirohide Tanikawa, Shizuoka (JP); Tsutomu Onuma, Kanagawa (JP); Nobuyuki Okubo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/131,522

(22) Filed: Apr. 25, 2002

(65) Prior Publication Data

US 2003/0016955 A1 Jan. 23, 2003

(30) Foreign Application Priority Data

Apr. 26, 2001 (JP) ..... 2001-128782

(51) Int. Cl.[7] ..... G03G 15/08

(52) U.S. Cl. ..... 399/27; 399/30; 399/61; 399/63

(58) Field of Search ..... 399/27, 30, 61, 399/62, 111, 119, 120, 258, 262, 63

(56) References Cited

U.S. PATENT DOCUMENTS

| | | | | |
|---|---|---|---|---|
| 4,707,748 A | | 11/1987 | Ohtsuka et al. | 358/298 |
| 5,466,555 A | | 11/1995 | Taguchi et al. | 430/110 |
| 6,141,508 A | * | 10/2000 | Sasaki et al. | 399/27 |
| 6,208,816 B1 | | 3/2001 | Koizumi et al. | 399/27 |

FOREIGN PATENT DOCUMENTS

| | | |
|---|---|---|
| EP | 1 069 479 A1 * | 1/2001 |
| JP | 51-14278 | 2/1976 |
| JP | 59-21549 | 2/1984 |
| JP | 61-185761 | 8/1986 |
| JP | 62-62352 | 3/1987 |
| JP | 63-212956 | 9/1988 |
| JP | 5-100571 | 4/1993 |
| JP | 6-230604 | 8/1994 |
| JP | 7-160044 | 6/1995 |
| JP | 7-281478 | 10/1995 |
| JP | 2943035 | 6/1999 |
| JP | 2000-147891 | 5/2000 |
| JP | 2000-206774 | 7/2000 |
| JP | 2000-250380 | 9/2000 |
| JP | 2000-284522 | 10/2000 |
| JP | 2001-27841 | 1/2001 |
| JP | 2001-27842 | 1/2001 |

* cited by examiner

*Primary Examiner*—Hoang Ngo
(74) *Attorney, Agent, or Firm*—Fitzpatrick, Cella, Harper & Scinto

(57) ABSTRACT

A process cartridge which is detachably mountable to a main body of an image-forming apparatus has a photosensitive member, a magnetic toner-holding section provided with a magnetic toner-carrying member which transports the toner to a developing zone, and a residual magnetic toner detector capable of detecting residual toner by a change in electrostatic capacity which is caused between electrodes provided inside the magnetic toner-holding section. The magnetic toner contains at least a binder resin and a colorant, having a weight-average particle diameter of from 6.5 μm to 15.0 μm, and having a Carr's floodability index of more than 80.

6 Claims, 23 Drawing Sheets

PROCESS CARTRIDGE

BACKGROUND OF THE INVENTION

1. Field of the Invention

This invention relates to a toner and a process cartridge which are used in image-forming processes such as electrophotography, electrostatic printing and toner jet printing. More particularly, it relates to a toner for developing electrostatic latent images, and an image-forming method and a process cartridge which make use of the toner.

2. Related Background Art

In recent years, in electrophotographic image-forming apparatus, a process cartridge system has widely been employed in which an electrophotographic photosensitive member and other processing means to be set to act on the photosensitive member are integrally joined to set up a cartridge so as to be detachably mountable to the main body of an electrophotographic image-forming apparatus. In the electrophotographic image-forming apparatus of such a cartridge system, users themselves can replace the cartridge, and hence some apparatus are provided with a means for detecting the quantity of toner remaining in a developing unit and, when the toner is running short, indicating its quantity to warn and urge users to replace the cartridge before any lowering of image density occurs.

Various methods are proposed on such detection of cartridge's service life, and a method is proposed in which a non-volatile storage means such as EEPROM (electrically erasable programmable read-only memory) is utilized to integrate the usage (extent of use) of a cartridge and store it in memory. For example, Japanese Patent Application Laid-open No. 61-185761 discloses an electrophotographic image-forming apparatus having a means by which, where a photosensitive drum in a process cartridge is exposed to light of a laser or a light-emitting diode, the information of the exposure time is added and stored in memory so that the information corresponding to the residual (residual quantity) of toner is added and stored in memory.

On such a cartridge, since there are many opportunities for the cartridge to be detached from and mounted to the main body of the apparatus, it is also proposed to incorporate a storage means in the cartridge itself so that the accuracy of detection may be improved when a plurality of cartridges are used for one apparatus main body. For example, as disclosed in Japanese Patent Application Laid-open No. 63-212956, an electrophotographic image-forming apparatus is proposed in which a cartridge is provided therein with a memory and the apparatus main body is provided with a means for reading and writing stored information and a means for operating information relating to the cartridge's service life in accordance with what has been read from the memory and with electrophotographic action to write the information in the memory.

As another method of detecting the consumption of toner, a method is also proposed in which the residual of toner in a cartridge is directly detected. For example, Japanese Patent Application Laid-open No. 62-62352 discloses a method in which a detecting antenna is provided in the vicinity of a developing sleeve which is a toner-carrying member, and electric current induced in the antenna is measured when AC voltage is applied to the developing sleeve, where any change of the electric current in accordance with the quantity of toner present between the sleeve and the antenna is utilized to detect the residual of toner.

Japanese Patent Application Laid-open No. 5-100571 also discloses a toner detector having a toner-detecting electrode member in which, in place of two electrode rods, two parallel electrodes, disposed on the same plane in parallel keeping a stated distance between them, are combined in plurality in a hill-and-dale fashion; the toner-detecting electrode member being disposed at the bottom surface of a toner container. This detector detects any change in electrostatic capacity between the parallel electrodes provided in a planar state, to detect the residual of toner.

However, all the above toner detectors detect whether or not the toner remains in the toner container, i.e., they can only detect that the toner is running short immediately before the toner held in the toner container is used up, and can not detect how much the toner remains in the toner container.

On the other hand, where the quantity of toner in the toner container can be detected, it is possible for users themselves to know the condition of use of toner in the toner container. This is very convenient for users because a new process cartridge can be prepared for replacement at an appropriate time.

Such a successive residual detection system is disclosed in, e.g., Japanese Patent Applications Laid-open No. 2000-147891, No. 2000-206774, No. 2000-250380, No. 2001-27841 and No. 2001-27842, which, however, has room for studies on the detection of residual in high precision.

The residual detection systems having been discussed above also have a problem that the quantity of a toner filled into a cartridge is measured and hence the detection may greatly be influenced by power characteristics of the toner. Especially where the toner is filled into the cartridge in a large volume, or the cartridge has such a shape that it tends to be densely packed with the toner, the toner may have a poor fluidity depending on service environmental conditions of printers, so that the quantity of toner can not accurately be detected or the detection system can not operate in some cases.

Accordingly, where such a system is employed, it is preferable to learn the powder characteristics of toner by using a method of evaluating toner's fluidity as one of characteristics of powder. The fluidity of individual toners may be evaluated by any methods suited for the toners. It, however, is also true that there is a possibility of lacking in generality. Accordingly, the Carr's fluidity index and Carr's floodability index are available as indices by which the fluidity of powder can synthetically been evaluated by measuring some phenomena and characteristics relating to fluidity.

The fluidity index can literally be a standard for evaluating the difficulty of flow-out ascribable to the force for gravity on powder, and the floodability index is a standard for determining how the phenomenon of flushing tends to occur. Flushing is a phenomenon in which the powder having been kept stationary to have a low fluidity comes into a fluidized state like a liquid when vibrated to begin being fluidized.

It means that, the higher the value of this floodability index is, the higher fluidity and floodability the toner has as a powder.

As patents in which these values are specified, Japanese Patent Publication No. 59-21549 discloses a toner characterized by having a Carr's fluidity index of 30 or more. The higher the fluidity index is, the more lightly fluid the toner can be. As a toner, however, if the toner has only a fluidity index of 30 or more, the toner may be agitated with difficulty, and also may be fed to the developing sleeve with difficulty. Hence, it is difficult to detect any accurate powder quantity of the toner. Also, some toners may come loose with difficulty when packed even in the case of toners having a high fluidity. Namely, when the toner is filled, the toner having been pressed and compacted at the bottom of a cartridge by the toner's own weight, the toner may be agitated by means of an agitation member with difficulty and may be fed to the developing member with difficulty. Hence, the quantity of usable toner may lower for its filling fraction (or packing fraction), thus it is difficult to detect the quantity of toner actually used. Japanese Patent No. 2943035 also discloses a toner specified to have a floodability index of from 50 to 80. However, in this case, too, this value is low for the use of the residual detection system. Even if the toner within this range is used in the cartridge, the toner may be agitated with difficulty as stated above and also may be fed to the developing sleeve with difficulty. Thus, it is difficult to learn the quantity of toner accurately.

In order to change this fluidity of toner, it is attempted to change the physical properties of a resin as disclosed in Japanese Patent Application Laid-open No. 07-281478, to change fluidity using a wax as disclosed in Japanese Patent Application Laid-open No. 2000-284522, and to change the fluidity of toner by changing the fluidity index of a magnetic material as disclosed in Japanese Patent Application Laid-open No. 06-230604. However, where the physical properties of various materials for toners are changed in order to attain the intended fluidity indices of the toners as in these cases, the toners may conversely have characteristics unsuitable for the developing processes in the main body, so that any good developing performance can not be achieved in some cases.

Japanese Patent Application Laid-open No. 07-160044 also discloses a method in which a toner has a fluidity index of 40 or more and the fluidity index is changed by selecting the type of an external additive and the conditions for its external addition. However, those which are chiefly disclosed therein are the amount of the external additive and the time for treatment by external addition, and the toner, though having a high fluidity, does not have any sufficient floodability. Hence, it does not have any sufficient powder characteristics for its incorporation in the residual detection system.

SUMMARY OF THE INVENTION

An object of the present invention is to provide a toner and a process cartridge which make it possible to detect the quantity of toner remaining in a toner-holding section, in any environment and at any filling fraction in the process cartridge to inform users of the residual of toner and the number of printable sheets, and to afford superior developing performance.

Stated specifically, the present invention provides a process cartridge used in an image-forming apparatus which forms an image on a recording medium, wherein;

the process cartridge is detachably mountable to the main body of the image-forming apparatus;

the process cartridge has a photosensitive member, a toner-holding section which holds therein a toner for developing electrostatic latent images formed on the photosensitive member and is provided with a toner-carrying member which transports the toner to a developing zone, and a toner-residual detection means capable of detecting residual toner by a change in electrostatic capacity which is caused between electrodes provided inside the toner-holding section; and the toner contains at least a binder resin and a colorant, has a weight-average particle diameter of from 6.5 $\mu$m to 15.0 $\mu$m, and has a Carr's floodability index of more than 80.

DETAILED DESCRIPTION OF THE PREFERRED EMBODIMENTS

Figure 1:
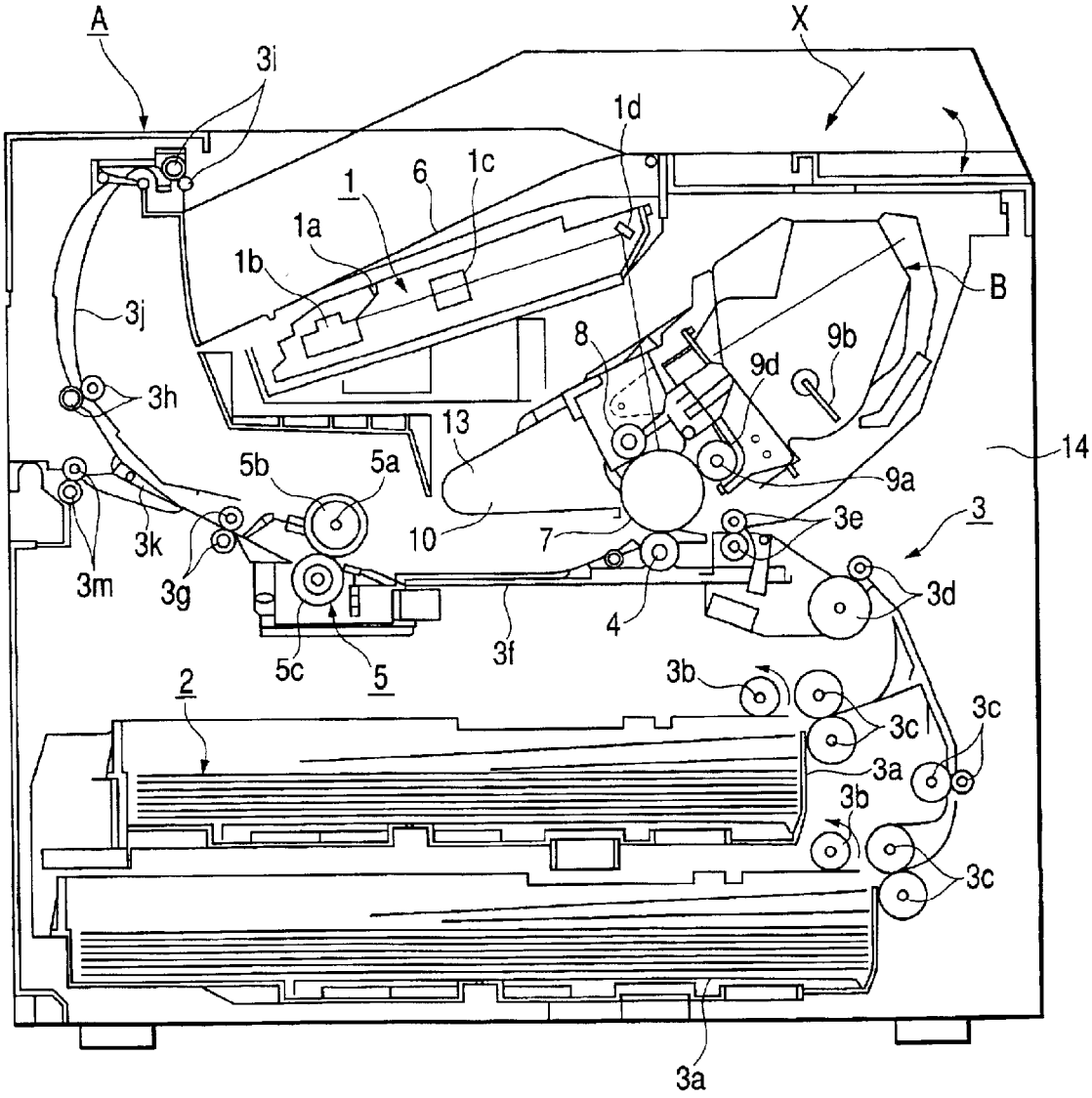
FIG. 1 is a schematic view showing the construction of an embodiment of an electrophotographic image-forming apparatus according to the present invention.

As a result of extensive studies made in order to solve the problems involved in the prior art, the present inventors have discovered that, in an image-forming method making use of a process cartridge having a toner-residual detection means, the precision of toner-residual detection can be improved and the residual toner can be detected with like precision in any environment and in any toner fill amount, by improving the toner-residual detection means and also controlling the floodability index of toner to a value of more than 80.

The toner filled into the process cartridge of the present invention has at least a binder resin and a colorant, and has a Carr's floodability index of more than 80. The toner may preferably have a Carr's fluidity index of more than 60.

The fluidity index and the floodability index termed in the present specification are measured in the following way (for details, see Japanese Patent Publication No. 51-14278).

Using Powder Tester P-100 (Hosokawa Micron Corporation), parameters of the angle of repose, the angle of rupture, the difference angle, the degree of compression (compressibility), the degree of agglomeration, the spatula angle and dispersibility are measured. The values obtained on these are fitted to the Carr's fluidity index table (Table 5) and Carr's floodability index table (Table 6) (see Chemical Engineering, Jan. 18, 1965, pp.166–167), and are converted into the corresponding indices of 25 or less each. The total of indices determined from the respective parameters are calculated as the fluidity index and floodability index. Measuring methods for the respective parameters are shown below.

(1) Angle of Repose:

150 g of the toner is accumulated on a round table of 8 cm in diameter through a screen with a mesh of 710 $\mu$m. Here, the toner is accumulated to such an extent that it overflows from the edge of the table. The angle formed between the ridge of the toner thus accumulated on the table and the plane of the round table is measured by the aid of laser light to find the angle of repose.

(2) Degree of Compression:

The degree of compression can be determined from loose-packing bulk density (loose apparent specific gravity A) and tapping bulk density (hard apparent specific gravity B).

$$\text{Degree of compression } (\%)=100\ (P-A)/P$$

Measurement of Loose Apparent Specific Gravity:

150 g of the toner is gently flowed into a cup of 5 cm in diameter, 5.2 cm in height and 100 cc in volume. After the the toner has been heaped up in the cup for measurement, the toner surface is leveled at the cup edge. Then the loose apparent specific gravity is calculated from the quantity of the toner with which the cup is filled.

Measurement of Hard Apparent Specific Gravity:

To the measuring cup used to measure the loose apparent specific gravity, an accessory cap is additionally fitted. The cup is filled with the toner, and this cup is tapped 180 times. At the time the tapping has been completed, the cap is removed, and the excess toner standing heaped up in the cap is leveled at the cup edge. Then the hard apparent specific gravity is calculated from the quantity of the toner with which the cup is filled.

Both apparent specific gravity values are inserted into the expression of degree of compression to determine the degree of compression.

(3) Spatula Angle:

A spatula of 3 cm×8 cm (to be fixed horizontally) is placed in a tray of 10 cm×15 cm in such a way that the former is in contact with the latter's bottom. The toner is accumulated on the spatula. Here, the toner is so accumulated as to heap on the spatula. Thereafter, only the tray is gently descended, and the angle of inclination of the side face of the toner having remained on the spatula is measured by the aid of laser light.

Thereafter, a shock is once applied to the spatula with a shocker attached thereto, and then the spatula angle is again measured. The average of this measured value and the measured value before application of the shock is calculated as the spatula angle.

(4) Degree of Agglomeration:

On a vibrating stand, sieves are set in the order of 250 $\mu$m, 150 $\mu$m and 75 $\mu$m meshes from the top. Setting the vibration width at 1 mm and the vibration time at 20 seconds, 5 g of the toner is gently put on the stand, which is then vibrated. After the vibration is stopped, the weight of the toner remaining on each sieve is measured.

$$(\text{Weight of toner remaining on the upper stage})/5\ (\text{g})\times 100 \quad a$$

$$(\text{Weight of toner remaining on the middle stage})/5\ (\text{g})\times 100\times 0.6 \quad b$$

$$(\text{Weight of toner remaining on the lower stage})/5\ (\text{g})\times 100\times 0.2 \quad c$$

The value of a+b+c is calculated as the degree of agglomeration (%).

The values obtained from these parameters are converted into an index of 25 or less according to the tables of Carr's fluidity index and floodability index. The total of these values, (1)+(2)+(3)+(4), is the Carr's fluidity index.

(5) Angle of Rupture:

After the angle of repose has been measured, a shock is applied three times to a tray on which the measuring round table is kept placed. Thereafter, the angle of the toner ruptured and remaining on the table is measured by the aid of laser light, and the angle measured is regarded as the angle of rupture.

(6) Difference Angle:

The difference between the angle of repose and the angle of rupture gives the difference angle.

(7) Dispersibility:

10 g of the toner is dropped in a mass on a watch glass of 10 cm in diameter, at a height of about 60 cm. Then, the toner remaining on the watch glass is weighed, and the dispersibility is determined from the following expression.

$$\text{Dispersibility } (\%)=(10-(\text{quantity of toner remaining on tray}))\times 10$$

The total of the indices which can be converted from the values of (5), (6) and (7) and the indices to which the value of fluidity index having been determined in the above corresponds can be determined as the floodability index according to the Carr's tables.

As long as the toner is one having high floodability and fluidity, like the one having a floodability index of more than 80, as a result of the above measurement, a high fluidity is regained at the time of agitation with an agitation member. Hence, the toner can readily constantly be transported from the toner-holding section to the developing zone, and, in the course the toner-carrying member is rotated, as shown in FIGS. 4A to 4D or FIGS. 13A to 13D the toner uniformly decreases because of its transport force, toward the toner-carrying member as viewed from the side section. In usual cases, electrodes are present in the vicinity of the toner-carrying member, and hence the toner may inevitably be detected as long as it is present between the electrodes, even when the toner is actually little present in the cartridge. As the result, this may cause a problem that any accurate residual of the toner can not be detected. However, in the case when the toner having a floodability index of more than 80 is used, the toner can have a powder surface which is horizontal to the direction of the force of gravity on the cartridge. Namely, the powder surface of the toner, which may decrease while gathering on one side in the usual cases, behaves like a liquid because of a high floodability of the toner. Hence, the toner surface may less incline and tends to shift horizontally in the gravity direction as viewed from the side section of the cartridge. As the result, the powder surface of the toner always shifts uniformly. This enables accurate detection of the residual toner whatever shape and filling fraction the cartridge has. Also, because of the toner's high floodability and fluidity, such a uniform shift of the powder surface can be maintained even in an environment of high temperature and high humidity, promising a small range of environment-dependent error in the toner-residual detection.

Here, where the toner has also a fluidity index of more than 60, the toner can be fed at a constant rate until the toner has run short in the cartridge, even respect to machines in which the toner is fed to the developing sleeve in a short time and in a large quantity in high-speed printable machines. Hence, the residual of toner can successively accurately be detected.

If the toner has a floodability index of 80 or less, a high fluidity can be achieved but, once the toner has been caught, it does not easily become fluid even if a force is applied. Hence, the toner can not easily be transported even in an attempt to transport the toner by means of an agitation member. As a result, the toner may be transported to the developing sleeve with difficulty, and may be charged in the state the toner is non-uniformly laid on the sleeve. Hence, the toner may also non-uniformly be charged to cause uneven images, and, since the powder surface is always unstable, it is difficult to detect the quantity of toner accurately.

If, on the other hand, the toner has a floodability index of 80 or less and also the toner has a fluidity index of 60 or less, the toner itself tends to agglomerate and also can be fluid with difficulty. Hence, the toner tends to melt-adhere to the part against which it rubs when it moves inside the cartridge. As the result, the toner may adhere to agitation blades and detector members when transported, resulting in a great error in the detection of residual toner. Also, in an environment of high temperature and high humidity, the toner may have especially poor fluidity, and hence the toner around the detector may stick, resulting in a great error in the detection of residual toner in this case, too.

The residual toner successive detector is also located at the part always coming into contact with the toner, taking account of its function. As a result, the toner-holding section may undergo a high load upon its contact with the toner-residual successive detector. Especially where a toner having a floodability index of 80 or less is used in such construction, any external additive present on the surfaces of toner particles tends to become buried to cause, e.g., a great background fog or a positive ghost, so that the toner may possibly have a poor developing performance. Also, if the toner has a low floodability, it may have a high powder pressure against the toner-carrying member to tend to cause its melt-adhesion to the toner-carrying member when the in-machine temperature becomes high, so that image defects in white lines may occur in the direction of paper feed.

The toner according to the present invention, however, has high floodability, and hence, even when it comes into contact with the residual-toner successive detector, any high load may directly be applied to the toner with difficulty, and the deterioration of toner as stated previously may hardly occur. This can bring about good developing performance without dependence on the environment over a long period of time until the toner runs short in the cartridge. Also, in the residual-toner detection system, the fluidity of toner may change depending on the environment. Accordingly, the system has been improved in precision by, e.g., improving toner transport systems and detection systems. However, as long as the toner used is a toner having high floodability, it is unnecessary to change the transport force attributable to agitation and the setting of the detection system, without regard to the quantity of the toner filled into the cartridge and the shape of the cartridge. Accordingly, the cartridge can be designed with a high degree of freedom and the residual toner can accurately be known.

In order to achieve the floodability index and fluidity index of the toner according to the present invention, it is a basis for its achievement to set to a certain or higher value the ratio of the specific surface area between the toner before external addition and the toner after external addition by not only changing the particle diameter of the toner or the quantity of the external additive, but also changing the state of agitation by changing the shape of an agitation blade used at the time of external addition, changing the toner filling fraction in a mixer or changing the mode of agitation. Here, the ratio of (BET specific surface area of toner after external addition)/(BET specific surface area of toner before external addition) may preferably be approximately from 1.6 to 2.4. As long as the ratio of (BET specific surface area of toner after external addition)/(BET specific surface area of toner before external addition) is within this range, the external additive having been added can stand uniformly loose on the surfaces of toner particles without agglomerating thereon. In such a case, some particles of the external additive are present with a weak adhesive force, some particles of the external additive are present that stand liberated, some particles of the external additive are kept to stick to the surfaces of toner particles at an appropriate adhesive force, and some particles of the external additive stand buried in toner particles by a strong impact force. The presence of the external additive in such variously mixed states enables achievement of the intended floodability of the toner. Here, various conditions for the treatment of toner by external addition may be changed. Thus, the proportion of the states of presence of this external additive changes to make the toner have different powder characteristics and have different floodability indices.

Here, the ratio of (BET specific surface area of toner after external addition)/(BET specific surface area of toner before external addition) may more preferably be approximately from 1.7 to 2.3, and still more preferably from 1.8 to 2.2, within the range of which the external additive can be present on the surfaces of toner particles in a proper condition, and the toner can have a floodability index of more than 80.

The BET specific surface area is measured by the BET method. More specifically, the specific surface area is calculated using the BET multi-point method, and using a specific surface area measuring device GEMINI2375 (manufactured by Shimadzu Corporation), adsorbing nitrogen gas on the sample surface.

As an apparatus for the treatment by external addition, it may include, e.g., Henschel Mixer (manufactured by Mitsui & Smelting Co., Ltd.), Super Mixer (manufactured by Kawata K.K.), Ribocone (manufactured by Ohkawara Seisakusho K.K.), Nauta Mixer, Turbulizer, Cyclomix (manufactured by Hosokawa Micron Corporation), Spiral Pin Mixer (manufactured by Taiheiyo Kiko K.K.) and Rhedige Mixer (manufactured by Matsubo K.K.). To achieve the above state of external addition by using any of these apparatus, describing the case of the Henschel Mixer, the toner material powder may be filled into an agitating container at an apparent volume filling fraction of from 8 to 30%, and preferably from 10 to 25%, and, as construction of agitating blades at the time of treatment, a blade shape which can cause the powder accumulated at the bottom of the container to convect throughout the interior of the container and a blade shape which can apply the appropriate shear force to the powder and make mechanical treatment while forcing back to the lower part of the container the powder having flown up may preferably be used in combination. Under the above conditions, the powder in the container can be in not a too high concentration, and hence the space necessary for the external addition treatment can be ensured. Thus, the agitating blades can impart high impact and agitation force to the toner particles, and hence the external additive can be present on toner particle surfaces in the various states and the toner having the intended high floodability can be obtained. As an agitation mode used here, it is preferable to change the number of revolutions of the agitating blades by some stages during treatment so that the state of the external additive adhering to toner particles can be intermingled in variety. It is also preferable to repeat treatment several times after the treatment has been made once, to select the form of agitation in which the force can be applied acceleratedly.

The toner used in the present invention may preferably have a weight-average particle diameter of from 6.5 $\mu$m to 15 $\mu$m, more preferably from 6.5 $\mu$m to 10 $\mu$m, and still more preferably from 6.5 $\mu$m to 8.0 $\mu$m.

In the present invention, if the toner has a weight-average particle diameter smaller than 6.5 $\mu$m, the toner tends to leak through toner seal portions at the ends of the toner-carrying member to cause the toner's in-machine scatter and melt-adhesion to the drum. Also, the developing sleeve may rotate at a high friction to cause self-generation of heat, which may be the cause of temperature rise. As the result, this may cause adhesion of toner to residual toner detection electrodes to tend to produce an error in residual toner detection means. If, on the other hand, the toner has a weight-average particle diameter larger than 15 $\mu$m, the toner tends to spout from the lower part of the toner-carrying member to cause developing chamber in-machine scatter.

The weight-average particle diameter of the toner is determined by measuring particle size distribution by the Coulter counter method. The particle size distribution of the toner may be measured by various methods. In the present invention, it is measured by the Coulter counter method. For example, Coulter Multisizer (manufactured by Coulter Electronics, Inc.) may be used as a measuring device. As an electrolytic solution for measurement, an aqueous 1% by weight NaCl solution is prepared using first-grade sodium chloride. For example, ISOTON R-II (trade name, available from Coulter Scientific Japan Co.) may be used. Measurement is made by adding as a dispersant 0.1 to 5 ml of a surface active agent (preferably an alkylbenzene sulfonate) to 100 to 150 ml of the above electrolytic solution, and further adding 2 to 20 mg of a sample to be measured. Then, the electrolytic solution to which the sample has been added is subjected to dispersion for about 1 minute to about 3 minutes in an ultrasonic dispersion machine. Using an aperture of 100 $\mu$m in the above particle size distribution measuring device, the volume and number of toner particles are measured for each channel, and the volume distribution and number distribution of the toner are calculated, and the weight-based, weight average particle diameter (D4) of the toner according to the present invention is determined from the volume distribution.

As channels, 13 channels are used, which are of 2.00 to less than 2.52 $\mu$m, 2.52 to less than 3.17 $\mu$m, 3.17 to less than 4.00 $\mu$m, 4.00 to less than 5.04 $\mu$m, 5.04 to less than 6.35 $\mu$m, 6.35 to less than 8.00 $\mu$m, 8.00 to less than 10.08 $\mu$m, 10.08 to less than 12.70 $\mu$m, 12.70 to less than 16.00 $\mu$m, 16.00 to less than 20.20 $\mu$m, 20.20 to less than 25.40 $\mu$m, 25.40 to less than 32.00 $\mu$m, and 32.00 to less than 40.30 $\mu$m.

The binder resin used in the present invention may be of any types, which may include styrene resins, styrene copolymer resins, polyester resins, polyol resins, polyvinyl chloride resins, phenolic resins, natural-resin-modified phenolic resins, natural-resin-modified maleic acid resins, acrylic resins, methacrylic resins, polyvinyl acetate resins, silicone resins, polyurethane resins, polyamide resins, furan resins, epoxy resins, xylene resins, polyvinyl butyral, terpene resins, coumarone indene resins, and petroleum resins. In particular, resins used preferably may include styrene copolymer resins and polyester resin.

Comonomers copolymerizable with styrene monomers in the styrene copolymers may include styrene derivatives such as vinyltoluene, acrylates such as acrylic acid, methyl acrylate, ethyl acrylate, butyl acrylate, dodecyl acrylate, octyl acrylate, 2-ethylhexyl acrylate and phenyl acrylate; methacrylates such as methacrylic acid, methyl methacrylate, ethyl methacrylate, butyl methacrylate and octyl methacrylate; dicarboxylic acids having a double bond and esters thereof such as maleic acid, butyl maleate, methyl maleate and dimethyl maleate; acrylamide, acrylonitrile, methacrylonitrile and butadiene; vinyl chloride; vinyl esters such as vinyl acetate and vinyl benzoate; ethylenic olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination of two or more kinds.

The binder resin of the present invention may have an acid value. Monomers for adjusting the acid values of the binder resin may include, e.g., acrylic acid, and $\alpha$- or $\beta$-alkyl derivatives thereof such as methacrylic acid, $\alpha$-ethylacrylic acid, crotonic acid, cinnamic acid, vinylacetic acid, isocrotonic acid and angelic acid, and unsaturated dicarboxylic acids and monoester derivatives or anhydrides thereof such as fumaric acid, maleic acid, citraconic acid, alkenylsuccinic acids, itaconic acid, methaconic acid, dimethylmaleic acid and dimethylfumaric acid. Any of such monomers used alone or in combination may be copolymerized with other monomers to obtain desired polymers. Among these, the use of monoester derivatives of unsaturated dicarboxylic acids is especially preferred in order to control the acid value.

Stated more specifically, such monomers may include monoesters of α,β-unsaturated dicarboxylic acids as exemplified by monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; and monoesters of alkenyl dicarboxylic acids as exemplified by monobutyl n-butenyl succinate, monomethyl n-octenyl succinate, monoethyl n-butenyl malonate, monomethyl n-dodecenyl glutarate and monobutyl n-butenyl adipate.

Any of the carboxyl group-containing monomers as shown above may be added in an amount of from 0.1 to 20% by weight, and preferably from 0.2 to 15% by weight, based on the weight of the whole monomers constituting the binder resin.

In the case when the binder resin of the toner according to the present invention has the acid value, it may preferably have an acid value of from 1 to 50 mg·KOH/g.

If the binder resin used in the present invention has an acid value of less than 1 mg·KOH/g, it has so low an acid value as to provide insufficient charge characteristics, resulting in a low developing performance. If on the other hand it has an acid value of more than 50 mg·KOH/g, the toner may be affected by humidity in, e.g., an environment of high temperature and high humidity to have a possibility of having low fluidity and floodability. As long as the binder resin used in the present invention has an acid value of from 1 to 50 mg·KOH/g, stable charging performance and the desired fluidity and floodability can be achieved without regard to differences in environment.

In the present invention, the acid value of the binder resin is determined in the following way.

(Measurement of Acid Value)

Basic operation is made according to JIS K-0070.

1) A sample is used after the THF-insoluble matter of the toner and binder resin has been removed, or the soluble component obtained in the above measurement of THF-insoluble matter, which has been extracted with THF solvent by means of the Soxhlet extractor, is used as a sample. A crushed product of the sample is precisely weighed in an amount of from 0.5 to 2.0 g, and the weight of the polymer component is represented by W (g).

2) The sample is put in a 300 ml beaker, and 150 ml of a toluene/ethanol (4/1) mixed solvent is added thereto to dissolve the sample.

3) Using a methanol solution of 0.1 N KOH, titration is made by means of a potentiometric titrator. (For example, automatic titration may be utilized which is made using a potentiometric titrator AT-400, Win-Workstation, manufactured by Kyoto Denshi K.K. and an ABP-410 motor buret.)

4) The amount of the KOH solution used here is represented by S (ml). A blank is measured at the same time, and the amount of the KOH solution used in the blank is represented by B (ml).

5) The acid value is calculated according to the following expression. Letter symbol f is the factor of KOH.

$$\text{Acid value (mg·KOH/g)}=\{(S-B)\times f\times 5.61\}/W.$$

The binder resin according to the present invention may have a glass transition temperature (Tg) of from 45° C. to 80° C., and preferably from 50° C. to 70° C.

As methods for synthesizing the binder resin according to the present invention, a polymerization process usable in the present invention may include solution polymerization, emulsion polymerization and suspension polymerization.

Of these, the emulsion polymerization is a method in which a monomer almost insoluble in water is dispersed in an aqueous phase in the form of small particles by the use of an emulsifying agent and then polymerized using a water-soluble polymerization initiator. In this method, the heat of reaction can readily be controlled and the phase where polymerization takes place (an oily phase comprised of polymers and monomers) and the aqueous phase are separated, so that the rate of termination reaction can be low and hence the rate of polymerization can be high, making it possible to obtain a product with a high degree of polymerization. In addition, because of a relatively simple polymerization process and also because of a polymerization product formed of fine particles, the product can readily be mixed with colorants, charge control agents and other additives in the manufacture of toners, and hence this method is advantageous as a method of producing binder resins for toners. The emulsion polymerization, however, tends to give an impurity to the resulting polymer because of an emulsifying agent added, and also requires operations such as salting-out to take out the polymer. Hence, in order to avoid such a difficulty, the suspension polymerization is favorable.

The suspension polymerization may be carried out using the monomer in an amount of not more than 100 parts by weight, and preferably from 10 to 90 parts by weight, based on 100 parts by weight of the aqueous medium. Usable dispersants may include polyvinyl alcohol, a polyvinyl alcohol partially saponified product, and calcium phosphate. Usually, any of these dispersants may be used in an amount of from 0.05 to 1 part by weight based on 100 parts by weight of the aqueous medium. The polymerization may suitably be carried out at a temperature of from 50° C. to 95° C., which should appropriately be selected according to polymerization initiators to be used and the intended polymer.

The binder resin used in the present invention may preferably be produced using a polyfunctional polymerization initiator alone or in combination with a monofunctional polymerization initiator which are as exemplified below.

As specific examples of a polyfunctional polymerization initiator having a polyfunctional structure, it may include polyfunctional polymerization initiators having in one molecule two or more functional groups such as peroxide groups, having a polymerization-initiating function, as exemplified by 1,1-di-t-butylperoxy-3,3,5-trimethylcyclohexane, 1,3-bis(t-butylperoxyisopropyl) benzene, 2,5-dimethyl-2,5-(t-butylperoxy)hexane, 2,5-dimethyl-2,5-di-(t-butylperoxy)hexane, tris-(t-butylperoxy) triazine, 1,1-di-t-butylperoxycyclohexane, 2,2-di-t-butylperoxybutane, 4,4-di-t-butylperoxyvaleric acid-n-butyl ester, di-t-butyl peroxyhexahydroterephthalate, di-t-butyl peroxyazelate, di-t-butyl peroxytrimethyladipate, 2,2-bis(4,4-di-t-butylperoxycyclohexyl)propane, 2,2-t-butylperoxyoctane, n-butyl-4,4-di(t-butylperoxy)valerate, α,α'-bis(t-butylperoxydiisopropyl)benzene and various polymer oxides; and polyfunctional polymerization initiators having in one molecule both a functional group such as a peroxide group, having a polymerization-initiating function, and a polymerizable unsaturated group, as exemplified by diallyl peroxydicarbonate, t-butyl peroxymaleate, t-butyl peroxyallylcarbonate, and t-butyl peroxyisopropylfumarate.

Of these, more preferred ones are 1,1-di-t-butylperoxy-3,3,5-trimethylcyclohexane, 1,1-di-t-butylperoxycyclohexane, di-t-butyl peroxyhexahydroterephthalate, di-t-butyl peroxyazelate, 2,2-bis(4,4-di-t-butylperoxycyclohexyl)propane, and t-butylperoxyallyl carbonate.

In order to satisfy various performances required as binders for the toner, any of these polyfunctional polymerization initiators may preferably be used in combination with a monofunctional polymerization initiator. In particular, they may preferably be used in combination with a polymerization initiator having a half-life of 10 hours which is lower than the decomposition temperature necessary for the polyfunctional polymerization initiator to obtain a half-life of 10 hours.

Such a monofunctional polymerization initiator may specifically include organic peroxides such as benzoyl peroxide, dicumyl peroxide and di-t-butyl peroxide; and azo or diazo compounds such as azobisisobutylonitrile and diazoaminoazobenzene.

Any of these monofunctional polymerization initiators may be added in the monomers at the same time the polyfunctional polymerization initiator is added. In order to keep a proper efficiency of the polyfunctional polymerization initiator, the monofunctional polymerization initiator may preferably be added after the half-life the polyfunctional polymerization initiator shows has lapsed in the polymerization step.

Any of these polymerization initiators may preferably be added in an amount of 0.05 to 2 parts by weight based on 100 parts by weight of the monomers, in view of efficiency.

It is also preferable for the binder resin to have been cross-linked with a cross-linkable monomer.

As the cross-linkable monomer, a monomer having at least two polymerizable double bonds may chiefly be used. As specific examples, it may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxyethylene(2)-2,2-bis(4-hydroxyphenyl)propane diacrylate, polyoxyethylene(4)-2,2-bis(4-hydroxyphenyl) propane diacrylate, and the above compounds whose acrylate moiety has been replaced with methacrylate; and polyester type diacrylate compounds as exemplified by MANDA (trade name; available from Nippon Kayaku Co., Ltd.).

As a polyfunctional cross-linkable monomer, it may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallyl cyanurate, and triallyl trimellitate.

Any of these cross-linkable monomers may preferably be used in an amount of from 0.00001 to 1 part by weight, and preferably from 0.001 to 0.05 part by weight, based on 100 parts by weight of other monomer components.

Of these cross-linkable monomers, monomers preferably usable are aromatic divinyl compounds (in particular, divinylbenzene) and diacrylate compounds linked with a chain containing an aromatic group and an ether linkage.

As other methods for synthesizing the binder resin, bulk polymerization and solution polymerization may be used. In bulk polymerization, polymers with a low-molecular weight can be obtained by polymerizing monomers at a high temperature to accelerate the rate of termination reaction, but there is the problem of a difficulty in controlling the reaction. In this regard, the solution polymerization is preferred because low-molecular weight polymers can be obtained with ease under mild conditions, utilizing a difference in chain transfer of radicals that is caused by a solvent, and controlling the quantity of initiators and the reaction temperature. In particular, solution polymerization carried out under conditions of pressure application is also preferred in order to keep the amount of the initiator to a minimum and keep as far as possible any remaining initiator from affecting the product.

The polyester resin used in the present invention has the following composition.

As a dihydric alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol represented by the following Formula (A) and a derivative thereof:

(A)

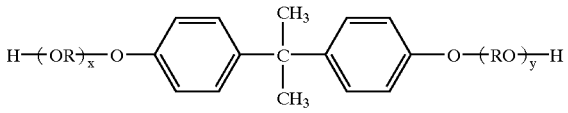

wherein R represents an ethylene group or a propylene group, x and y are each an integer of 0 or more, and an average value of x+y is 0 to 10; and a diol represented by the following Formula (B).

(B)

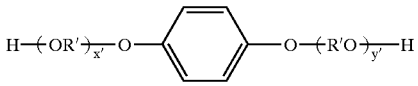

wherein R' represents —$CH_2CH_3$—,

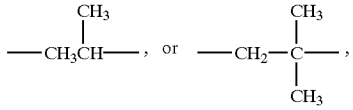

x' and y' are each an integer of 0 or more, and an average value of x+y is 0 to 10.

As a dibasic acid component, it may include dicarboxylic acids and derivatives thereof as exemplified by benzene dicarboxylic acids or anhydrides thereof such as phthalic acid, terephthalic acid, isophthalic acid and phthalic anhydride, and lower alkyl esters thereof; alkyldicarboxylic acids such as succinic acid, adipic acid, sebacic acid and azelaic acid, and anhydrides or lower alkyl esters thereof; alkenylsuccinic acids or alkylsuccinic acids such as n-dodecenylsuccinic acid and n-dodecylsuccinic acid, and anhydrides or lower alkyl esters thereof; and unsaturated dicarboxylic acids such as fumaric acid, maleic acid, citraconic acid and itaconic acid, and anhydrides or lower alkyl esters thereof.

A trihydric or higher alcohol component and a tribasic or higher acid component serving also as cross-linking components may also be used in combination.

The trihydric or higher, polyhydric alcohol component may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

The tribasic or higher, polycarboxylic acid component in the present invention may include polycarboxylic acids and derivatives thereof, e.g., trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl) methane, 1,2,7,8-octanetetracarboxylic acid, Empol trimer acid, anhydrides of these, and lower alkyl esters of these; and tetracarboxylic acids represented by the following formula:

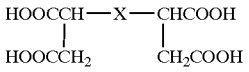

wherein X represents an alkylene group or alkenylene group having 5 to 30 carbon atoms having at least one side chain having 3 or more carbon atoms; anhydrides thereof, and lower alkyl esters thereof.

The alcohol components used in the present invention may be in a content of from 40 mol % to 60 mol %, and preferably from 45 mol % to 55 mol %, and the acid components from 60 mol % to 40 mol %, and preferably from 55 mol % to 45 mol %. Also, the tribasic or higher polyhydric or polybasic components may preferably be in a content of from 5 mol % to 60 mol % of the whole components.

The polyester resin may be obtained by conventionally known condensation polymerization.

The toner of the present invention may preferably contain a charge control agent.

A charge control agent capable of controlling the toner to be negatively chargeable may include the following compounds.

Organic metal complex salts and chelate compounds are effective, including monoazo metal complexes, acetylyacetone metal complexes, aromatic hydroxycarboxylic acid and aromatic dicarboxylic acid type metal complexes. Besides, they may also include aromatic hydroxycarboxylic acids, aromatic mono- and polycarboxylic acids, and metal salts, anhydrides or esters thereof, and phenol derivatives such as bisphenol.

In particular, azo type metal complexes represented by the following Formula (1) shown below are preferred.

(1)

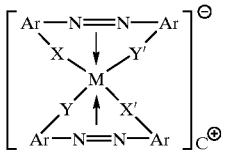

In the formula, M represents a central coordination metal, including Sc, Ti, V, Cr, Co, Ni, Mn or Fe. Ar represents an aryl group as exemplified by a phenyl group or a naphthyl group, which may have a substituent. In such a case, the substituent includes a nitro group, a halogen atom, a carboxyl group, an anilido group, and an alkyl group having 1 to 18 carbon atoms or an alkoxyl group having 1 to 18 carbon atoms. X, X', Y and Y' each represent —O—, —CO—, —NH— or —NR—® is an alkyl group having 1 to 4 carbon atoms). $C^+$ represents a counter ion, and represents a hydrogen, sodium, potassium, ammonium or aliphatic ammonium ion, or a mixed ion thereof.

As the central metal, Fe or Cr is particularly preferred. As the substituent, a halogen atom, an alkyl group or an anilido group is preferred. As the counter ion, a hydrogen, alkali metal, ammonium or aliphatic ammonium ion is preferred. A mixture of complex salts having different counter ions may also preferably be used.

Basic organic acid metal complex salts represented by the following Formula (2) are also preferable as charge control agents capable of imparting negative chargeability.

(2)

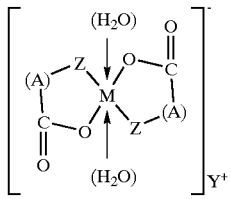

In the formula, M represents a central coordination metal, including Cr, Co, Ni, Fe, Zn, Al, Si or B. A represents;

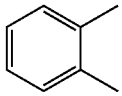

(which may have a substituent such as an alkyl group)

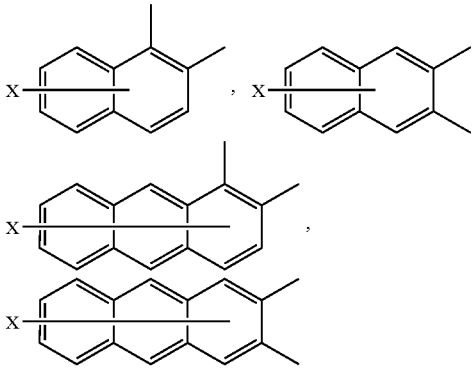

(X represents a hydrogen atom, a halogen atom, a nitro group or an alkyl group), and

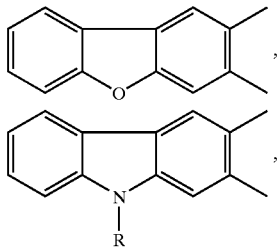

-continued

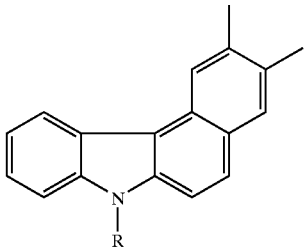

(R represents a hydrogen atom, an alkyl having 1 to 18 carbon atoms group or an alkenyl group having 1 to 18 carbon atoms);

$Y^+$ represents a counter ion, and represents a hydrogen, sodium, potassium, ammonium or aliphatic ammonium ion, or a mixed ions thereof. Z represents —O— or

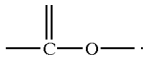

A charge control agent capable of controlling the toner to be positively chargeable may include the following compounds:

Nigrosine and nigrosine products modified with a fatty acid metal salt; quaternary ammonium salts such as tributylbenzylammonium 1-hydroxy-4-naphthoslulfonate and tetrabutylammonium teterafluoroborate, and analogues of these, i.e., onium salts such as phosphonium salts, and lake pigments of these; triphenylmethane dyes and lake pigments of these (laking agents include tungstophosphoric acid, molybdophosphoric acid, tungstomolybdophosphoric acid, tannic acid, lauric acid, gallic acid, ferricyanic acid and ferrocyanic acid); metal salts of higher fatty acids; diorganotin oxides such as dibutyltin oxide, dioctyltin oxide and dicyclohexyltin oxide; diorganotin borates such as dibutyltin borate, dioctyltin borate and dicyclohexyltin borate; guanidine compounds; and imidazole compounds. Any of these may be used alone or in combination of two or more kinds. Of these, triphenylmethane dye compounds and quaternary ammonium salts whose counter ions are not halogens may preferably be used. Homopolymers of monomers represented by the following Formula (3) may be used.

(3)

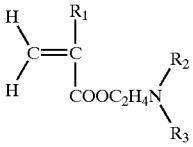

In the formula, $R_1$ represents H or $CH_3$; $R_2$ and $R_3$ each represent a substituted or unsubstituted alkyl group (preferably having 1 to 4 carbon atoms); or copolymers of polymerizable monomers such as styrene, acrylates or methacrylates as described above may also be used as positive charge control agents. In this case, these homopolymers and copolymers have the function as charge control agents and the function as binder resins (as a whole or in part).

In particular, compounds represented by the following Formula (4) are preferred as positive charge control agents for the toner according to the present invention.

(4)

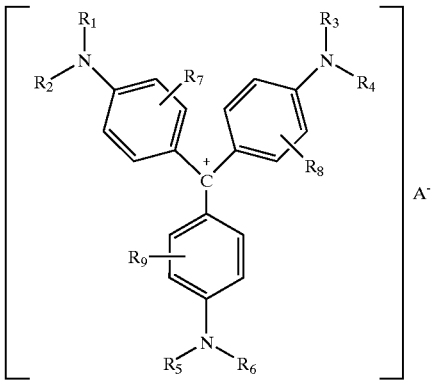

In the formula, $R_1$, $R_2$, $R_3$, $R_4$, $R_5$ and $R_6$ may be the same or different from one another and each represent a hydrogen atom, a substituted or unsubstituted alkyl group or a substituted or unsubstituted aryl group. $R_7$, $R_8$ and $R_9$ may be the same or different from one another and each represent a hydrogen atom, a halogen atom, an alkyl group or an alkoxyl group. $A^-$ represents an anion such as a sulfate ion, a nitrate ion, a borate ion, a phosphate ion, a hydride ion, an organosulfate ion, an organosulfonate ion, an organophosphate ion, a carboxylate ion, an organoborate ion or a tetrafluoroborate ion.

As methods for incorporating the charge control agent in the toner, there are a method of adding it internally into the toner particles and a method of adding it externally to the toner particles. The amount of the charge control agent used depends on the type of the binder resin, the presence of any other additives, and the manner by which the toner is produced, including the manner of dispersion, and can not absolutely be specified. Preferably, the charge control agent may be used in an amount ranging from 0.1 to 10 parts by weight, and more preferably from 0.1 to 5 parts by weight, based on 100 parts by weight of the binder resin.

The toner according to the present invention may contain a wax. The wax usable in the present invention may include aliphatic hydrocarbon waxes such as low-molecular weight polyethylene, low-molecular weight polypropylene, olefin copolymers, microcrystalline wax, paraffin wax and Fischer-Tropsch wax; oxides of aliphatic hydrocarbon waxes, such as polyethylene oxide wax, or block copolymers of these; waxes composed chiefly of a fatty ester, such as carnauba wax and montanate wax, or those obtained by subjecting part or the whole of fatty esters to deoxidizing treatment, such as deoxidized carnauba wax. It may further include saturated straight-chain fatty acids such as palmitic acid, stearic acid, montanic acid and long-chain alkylcarboxylic acids having a still longer-chain alkyl group; unsaturated fatty acids such as brassidic acid, eleostearic acid and parinaric acid; saturated alcohols such as stearyl alcohol, aralkyl alcohols, behenyl alcohol, carnaubyl alcohol, ceryl alcohol, melissyl alcohol and long-chain alkyl alcohols having a still longer-chain alkyl group; polyhydric alcohols such as sorbitol; fatty acid amides such as linolic acid amide, oleic acid amide and lauric acid amide; saturated fatty acid bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as m-xylenebisstearic acid amide and N,N'- distearylisophthalic acid amide; grafted waxes obtained by grafting vinyl monomers such as styrene and acrylic acid to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

Wax which may preferably be used may include paraffin wax; low-molecular weight alkylene polymers obtained by polymerizing alkylenes by radical polymerization under high pressure or by polymerization under low pressure in the presence of a Ziegler catalyst a metallocene catalyst or any other catalyst; alkylene polymers obtained by thermal decomposition of high-molecular weight alkylene polymers; those obtained by separation and purification of low-molecular-weight alkylene polymers formed as by-products when alkylene polymers are synthesized; and waxes obtained by extraction fractionation of specific components from i) distillation residues of hydrocarbons obtained by the Arge process from synthetic gases comprised of carbon monoxide and hydrogen, or from ii) synthetic hydrocarbons obtained by hydrogenation of these. To these waxes, antioxidants may previously be added. The wax may further include waxes formed of straight-chain alcohols, fatty acids, acid amides, esters or montanic derivatives. Those from which impurities such as fatty acids have been removed are also preferred.

Particularly preferred are paraffin wax, those obtained by polymerization of olefins such as ethylene, and by-products from the polymerization, and those composed basically of hydrocarbons having up to thousands of carbon atoms, such as Fischer-Tropsch wax. Long-chain alkyl alcohols having hydroxyl groups at terminals, having up to hundreds of carbon atoms, are also preferred. Those obtained by adding alkylene oxides to alcohols are still also preferred.

Then, from these waxes, waxes may be fractionated according to the size of molecular weight by press sweating, solvent fractionation, vacuum distillation, ultracritical gas extraction or fractionation recrystallization (e.g., molten liquid crystallization and crystal filtration) to make them have a sharp molecular-weight distribution. Such waxes are further preferred because components ranged with the necessary melt behavior can be held in a larger proportion.

The wax used in the present invention may have at least one endothermic peak in a DSC curve at the time of heating, measured with a differential scanning calorimeter (DSC), where the endothermic peak may preferably be present within the range of from 60° C. to 160° C., more preferably from 60° C. to 150° C., and still more preferably from 65° C. to 150° C. Two or more endothermic peaks may also be present. In such a case, at least one endothermic peak may preferably be present in the range of from 60° C. to 120° C. Where the wax has the endothermic peak(s) within the above temperature range, the wax component can appropriately exude to the toner particle surfaces at the time of the production of toner to further improve the smoothness of the toner particle surfaces.

The DSC curve of the toner is obtained by measurement made according to ASTM D3418-82, using a differential scanning calorimeter (DSC measuring apparatus), e.g., DSC-7 (manufactured by Perkin-Elmer Corporation) or DSC2920 (manufactured by TA Instruments Japan, Ltd.). As the DSC curve, used is a DSC curve obtained by measurement when the wax is once heated and then cooled to take a previous history and thereafter heated at a heating rate of 10° C./min.

The wax may preferably have a molecular weight distribution of Mw/Mn (weight-average molecular weight/number-average molecular weight) of 3.0 or less, more preferably 2.5 or less, and still more preferably 2.0 or less.

For the wax which may be used in the present invention, it is effective to be added in an amount of from 0.1 part by weight to 15 parts by weight, and preferably from 0.5 part by weight to 12 parts by weight, based on 100 parts by weight of the binder resin. It is also preferable to use a plurality of waxes.

The toner according to the present invention may also be incorporated with a magnetic material in its toner particles so that it can be used as a magnetic toner. In this case, the magnetic material may also serve as a colorant. The magnetic material usable in the present invention may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

These magnetic materials may also preferably be those having a number-average particle diameter of from 0.05 $\mu$m to 1.0 $\mu$m, and more preferably from 0.1 $\mu$m to 0.5 $\mu$m. Those having a BET specific surface area of from 2 to 40 $m^2/g$, and more preferably from 4 to 20 $m^2/g$ may preferably be used as the magnetic material. There are no particular limitations on their shape, and those having any shape may be used. Also preferably usable are those having a saturation magnetization of from 10 to 200 $Am^2/kg$, and preferably from 70 to 100 $Am^2/kg$, a residual magnetization of from 1 to 100 $Am^2/kg$, and preferably from 2 to 20 $Am^2/kg$ and a coercive force of from 1 to 30 kA/m, and preferably from 2 to 15 kA/m, as magnetic properties under application of a magnetic field of 795.8 kA/m. Any of these magnetic materials may preferably be used in an amount of from 20 to 200 parts by weight, and more preferably from 40 to 150 parts by weight, based on 100 parts by weight of the binder resin.

The number-average particle diameter may be determined by, e.g., measurement with a digitizer on a photograph taken on a transmission electron microscope by magnification photographing.

The magnetic properties of the magnetic material may be measured with a vibrating-sample type magnetometer VSM-3S-15 (manufactured by Toei Kogyo K.K.) under an external magnetic field of 795.8 kA/m.

The specific surface area may be measured according to the BET method, where nitrogen gas is adsorbed on sample surfaces using a specific surface area measuring device AUTOSOBE 1 (manufactured by Yuasa Ionics Co.), and the specific surface area is calculated by the BET multiple point method.

The toner according to the present invention may contain a colorant. The colorant may include any suitable pigments or dyes. The pigments may include carbon black, aniline black, acetylene black, Naphthol Yellow, Hanza Yellow, Rhodamine Lake, Alizarine Lake, red iron oxide, Phthalocyanine Blue and Indanethrene Blue. Any of these may be used in a quantity which is necessary and sufficient for maintaining the optical density of fixed images, and may be added in an amount of from 0.2 to 20 parts by weight, and preferably from 0.2 to 10 parts by weight, based on 100 parts by weight of the binder resin. The dyes may include azo dyes, anthraquinone dyes, xanthene dyes and methine dyes. The dye may be added in an amount of from 0.1 to 20 parts by weight, and preferably from 0.3 to 10 parts by weight, based on 100 parts by weight of the binder resin.

The toner according to the present invention contains an inorganic fine powder in order to attain the specific floodability. The inorganic fine powder is externally added to toner particles. The inorganic fine powder may preferably be a hydrophobic inorganic fine powder. As examples of the inorganic fine powder, it may include fine silica powder, fine titanium oxide powder, fine alumina powder, and any of these having been made hydrophobic. These may preferably be used alone or in combination.

The fine silica powder may include both dry-process silica called fumed silica, produced by vapor phase oxidation of silicon halides, and wet-process silica produced from water glass or the like. The dry-process silica is preferred, as having less silanol groups on the surface and inside and leaving no production residue.

The fine silica powder may preferably be those having been made hydrophobic. It may be made hydrophobic by chemical treatment with an organosilicon compound capable of reacting with or physically adsorbing the fine silica powder. As a preferred method, the dry-process fine silica powder produced by vapor phase oxidation of a silicon halide may be treated with an organosilicon compound such as silicone oil after the powder has been treated with a silane compound, or at the same time it is treated with a silane compound.

The silane compound used in such hydrophobic treatment may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, tirornanosilane mercaptan, tirmethylsilyl mercaptan, tirornanosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane and 1,3-diphenyltetramethyldisiloxane.

The organosilicon compound may include silicone oils. Silicone oils preferably used are those having a viscosity of approximately from 30 to 1,000 $mm^2/s$ at 25° C., preferably as exemplified by dimethyl silicone oil, methylphenyl silicone oil, α-methylstyrene modified silicone oil, chlorophenyl silicone oil, and fluorine modified silicone oil.

As a particularly preferred method, the fine silica powder may be treated with dimethylsilicone oil. The fine silica powder having been made hydrophobic with dimethylsilicone oil has an appropriate hydrophobicity, and hence can effectively prevent the toner from having a low charge quantity because of moisture absorption and having a low developing performance.

The treatment with silicone oil may be made by a method in which the fine silica powder having been treated with a silane compound and the silicone oil are directly mixed by means of a mixing machine such as a Henschel mixer, or the silicone oil is sprayed on the fine silica powder serving as a base. Alternatively, the silicone oil may be dissolved or dispersed in a suitable solvent and thereafter the solution or dispersion may be mixed with the base fine silica powder, followed by removal of the solvent.

As preferable treatment for making hydrophobic the fine silica powder, it may also be made by a method in which the fine silica powder is treated with hexamethyldisilazane and subsequently treated with silicone oil.

Treating the fine silica powder with the silane compound and thereafter with the silicone oil as described above is preferred because the hydrophobicity can effectively be increased.

Fine titanium oxide powder or fine alumina powder having been subjected to the hydrophobic treatment and also the silicone oil treatment which are made on the fine silica powder is also preferred like the treated fine silica powder.

To the toner according to the present invention, other additives may optionally externally be added. They are, e.g., fine resin particles or inorganic fine particles that act as a charging auxiliary agent, a conductivity-providing agent, a fluidity-providing agent, an anti-caking agent, a release agent at the time of heat roll fixing, a lubricant, or an abrasive.

The fine resin particles may preferably be those having an average particle diameter of from 0.03 to 1.0 μm. Polymerizable monomers for constituting such fine resin particles may include styrene monomers such as styrene, o-methylstyrene, m-methylstyrene, p-methylstyrene, p-methoxystyrene and p-ethylstyrene; acrylic acid; methacrylic acid; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and monomers such as acrylonitrile, methacrylonitrile and acylamide.

These monomers may be polymerized by suspension polymerization, emulsion polymerization or soap-free polymerization. Fine resin particles obtained by soap-free polymerization are more preferred.

Other fine particles may include lubricants such as Teflon, zinc stearate and polyvinylidene fluoride (in particular, polyvinylidene fluoride is preferred); abrasives such as cerium oxide, silicon carbide and strontium titanate (in particular, strontium titanate is preferred); anti-caking agents; and conductivity-providing agents such as carbon black, zinc oxide, antimony oxide and tin oxide. White fine particles and black fine particles both having the polarity opposite to the charge polarity of the toner particles may also be used in a small quantity as a developing performance improver.

The fine resin particles, inorganic fine particles or hydrophobic inorganic fine particles to be mixed in the toner may preferably be used in an amount of from 0.1 to 5 parts by weight, and more preferably from 0.1 to 3 parts by weight, based on 100 parts by weight of the toner.

As a method of producing the toner according to the present invention, it is preferable to use a method in which the toner component materials as described above are thoroughly mixed by means of a ball mill or any other mixer, thereafter the mixture obtained is well kneaded by means of a heat kneading machine such as a heat roll kneader or an extruder, and the kneaded product is cooled to solidify, followed by mechanical pulverization and classification of the pulverized product to obtain a toner. As other methods, usable are a method for producing a toner by polymerization in which the stated materials are mixed with monomers that are to constitute the binder resin, to form an emulsion suspension, followed by polymerization to obtain the toner; a method in which, in a microcapsule toner comprised of a core material and a shell material, the core material or the shell material, or the both of these, is/are incorporated with the stated materials; and a method in which the component materials are dispersed in a binder resin solution and thereafter the dispersion obtained is spray-dried to obtain a toner. Any desired additive(s) may further optionally thoroughly be mixed with toner particles by means of a mixing machine such as a Henschel mixer to obtain the toner according to the present invention.

As the mixing machine, it may include Henschel Mixer (manufactured by Mitsui Mining & Smelting Co., Ltd.); Super Mixer (manufactured by Kawata K.K.); Ribocone (manufactured by Ohkawara Seisakusho K.K.); Nauta Mixer, Turbulizer and Cyclomix (manufactured by Hosokawa Micron Corporation); Spiral Pin Mixer (manufactured by Taiheiyo Kiko K.K.); and Rhedige Mixer (manufactured by Matsubo K.K.). As the kneading machine, it may include KRC Kneader (manufactured by Kurimoto Tekkosho K.K.); Buss Co-kneader (manufactured by Buss Co.); TEM-type Extruder (manufactured by Toshiba Machine Co., Ltd.); TEX Twin-screw Extruder (manufactured by Nippon Seiko K.K.); PCM Kneader (manufactured by Ikegai Tekkosho K.K.); Three-Roll Mill, Mixing Roll Mill, and Kneader (manufactured by Inoue Seisakusho K.K.); Kneadex (manufactured by Mitsui Mining & Smelting Co., Ltd.); MS-Type Pressure Kneader, Kneader Ruder (manufactured by Moriyama Seisakusho K.K.); and Banbury Mixer (manufactured by Kobe Seikosho K.K.). As a grinding machine, it may include Counter Jet Mill, Micron Jet and Inomizer (manufactured by Hosokawa Micron Corporation); IDS-Type Mill and PJM Jet Grinding Mill (manufactured by Nippon Pneumatic Kogyo K.K.); Cross Jet Mill (manufactured by Kurimoto Tekkosho K.K.); Ulmax (manufactured by Nisso Engineering K.K.); SK Jet O-Mill (manufactured by Seishin Kigyo K.K.); Criptron (manufactured by Kawasaki Heavy Industries, Ltd); Turbo Mill (manufactured by Turbo Kogyo K.K.); and Super Rotor (Nisshin Engineering K.K.). As a classifier, it may include Classyl, Micron Classifier and Spedic Classifier (manufactured by Seishin Kigyo K.K.); Turbo Classifier (manufactured by Nisshin Engineering K.K.); Micron Separator, Turboprex(ATP) and TSP Separator (manufactured by Hosokawa Micron Corporation); Elbow Jet (manufactured by Nittestsu Kogyo K.K.); Dispersion Sparator (manufactured by Nippon Pneumatic Kogyo K.K.); and YM Microcut (manufactured by Yasukawa Shoji K.K.). As a granulator, it may include Roller Compactor (manufactured by Turbo Kogyo K.K.). As a sifter used to sieve coarse powder and so forth, it may include Ultrasonic (manufactured by Koei Sangyo K.K.); Rezona Sieve and Gyrosifter (manufactured by Tokuju Kosakusho K.K.); Vibrasonic System (manufactured by Dulton Co.); Soniclean (manufactured by Shinto Kogyo K.K.); Turbo Screener (manufactured by Turbo Kogyo K.K.); Microsifter (manufactured by Makino Sangyo K.K.); and circular vibrating screens.

The image-forming method and process cartridge according to the present invention are described below.

The process cartridge of the present invention is a process cartridge which is detachably mountable to the main body of an image-forming apparatus, and has a residual toner detection means capable of detecting a residual toner successively by a change in electrostatic capacity.

The process cartridge of the present invention is also a process cartridge which is detachably mountable to the main body of an image-forming apparatus; has a toner-holding section which holds therein a toner for developing electrostatic latent images formed on a photosensitive member and is provided with a toner-carrying member which transports the toner to a developing zone of the photosensitive member; and can detect residual toner held in the toner-holding section, by successively detecting any change in electrostatic capacity which is caused between two upper and lower electrodes provided inside the toner-holding section, facing the toner-carrying member (any one of the two electrodes may be the toner-carrying member or a developing blade sheet metal) and leaving a space between the electrodes.

The process cartridge of the present invention is still also a process cartridge which is detachably mountable to the main body of an image-forming apparatus; has a toner-holding section which holds therein a toner for developing electrostatic latent images formed on a photosensitive member and is provided with a toner-carrying member which transports the toner to a developing zone of the photosensitive member; and can detect residual toner held in the toner-holding section, by successively detecting any change in electrostatic capacity at an electrostatic-capacity generation zone provided at a position where the contact area varies in accordance with a change in quantity of the toner held in the toner-holding section.

The image-forming method and process cartridge according to the present invention are described below in greater detail with reference to the accompanying drawings. Incidentally, in the following description, an electrophotographic image-forming apparatus is used, to which the process cartridge is mounted. The process cartridge of the present invention is also applicable to other image-forming methods of an electrostatic recording system or a toner jet system, without any particular limitations as long as it is an image-forming method making use of a mechanism in which the quantity of the toner held in the toner-holding section is detected by a change in electrostatic capacity.

Process Cartridge, Embodiment 1

First, an embodiment of an electrophotographic image-forming apparatus to which the process cartridge constructed according to the present invention is mountable is described with reference to FIG. 1. In this embodiment, the electrophotographic image-forming apparatus is denoted as a laser beam printer A of an electrophotographic system, and forms images on a recording medium, e.g., recording paper, OHP (overhead projection) sheets and cloth, by an electrophotographic image-forming process.

The laser beam printer A has a drum-shaped electrophotographic photosensitive member, i.e., a photosensitive drum 7. The photosensitive drum 7 is electrostatically charged by a charging means charging roller 8, and then exposed to laser light in accordance with image information from an optical means having a laser diode 1*a*, a polygon mirror 1*b*, a lens 1*c* and a reflecting mirror 1*d*. Thus, a latent image corresponding to the image information is formed on the photosensitive drum 7. This latent image is developed by a developing means 9 (FIG. 2) and is made into a visible image, i.e., a toner image.

Figure 2:
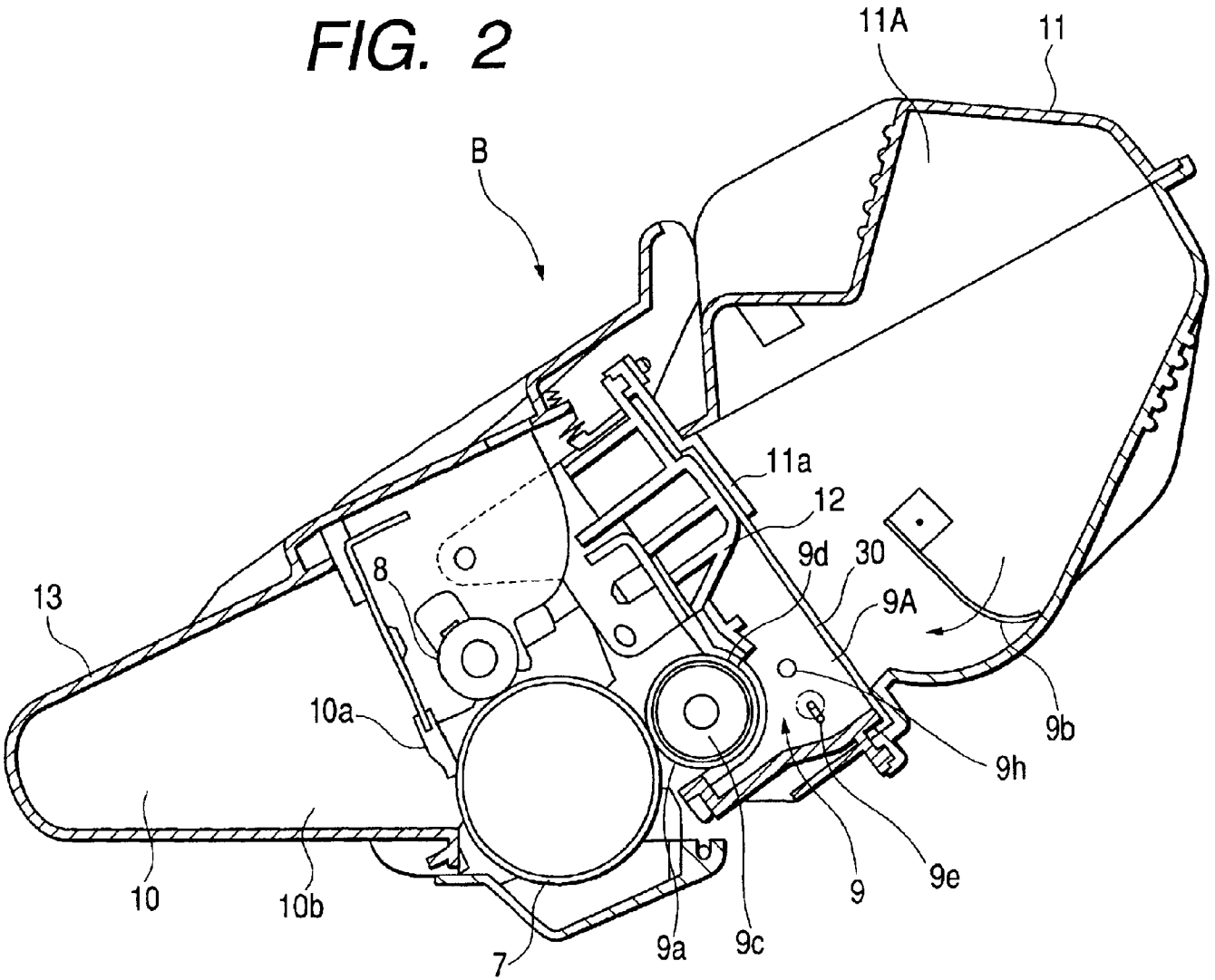
FIG. 2 is a longitudinal sectional view showing a longitudinal section in an embodiment of the process cartridge according to the present invention.

As shown in FIG. 2, the developing means 9 has a developing chamber 9A having a developing sleeve 9*a* as the toner-carrying member, where the toner held in a toner container 11A serving as the toner-holding section, formed adjoiningly to the developing chamber 9A, is sent out to the developing sleeve 9*a* of the developing chamber 9A as a toner feed member 9*b* is rotated. In the developing chamber 9A, a toner agitation member 9*e* is provided in the vicinity of the developing sleeve 9*a* to circulate the toner held in the developing chamber 9A. Also, the developing sleeve 9*a* is internally provided with a stationary magnet 9*c*, where the toner is transported as the developing sleeve 9*a* is rotated, and is triboelectrically charged and simultaneously made into a toner layer having a stated thickness, which is then fed to the developing zone of the photosensitive drum 7. The toner having been fed to this developing zone is moved to the latent image formed on the photosensitive drum 7 to form the toner image. The developing sleeve 9*a* is connected to a development bias circuit, from which usually a development bias voltage formed by superimposing a DC voltage on an AC voltage is applied to the sleeve.

In the present invention, the toner-carrying member has an average surface roughness (Ra) ranging from 0.5 $\mu$m to 2.5 $\mu$m, and, the movement speed of the toner-carrying member surface in the developing zone, is 0.95 to 1.20 times the movement speed of the photosensitive drum (electrostatic-latent-image-bearing member) surface facing the former, in the course of which the electrostatic latent image is developed with the toner (one-component developer). The toner on the toner-carrying member may be in a coat weight of 3.0 mg/cm$^2$ or less, and preferably in a coat weight of 2.5 mg/cm$^2$ or less. Thus, the toner can uniformly be coated on the toner-carrying member. This is preferable in view of the stability of development. The toner according to the present invention has good floodability, and hence the toner moves onto the toner-carrying member with ease, where the toner layer with a uniform thickness may be formed with difficulty unless the toner on the toner-carrying member is controlled to a certain quantity. However, since the toner-carrying member has the surface roughness within the above range, the toner layer can stably be formed with ease on the toner-carrying member always in a uniform thickness even when the toner having good floodability as in the present invention is used.

An embodiment of the electrophotographic image-forming apparatus to which the process cartridge constructed according to the present invention is mountable is further described. As shown in FIG. 1, in synchronization with the formation of the toner image, a recording medium 2 set in a paper feed cassette is transported to a transfer position through a pick-up roller 3*b*, paired transport rollers 3*c* and 3*d* and a paired registration roller 3*e*. At the transfer position, a transfer roller 4 as a transfer means is disposed, to which a voltage is applied so that the toner image held on the photosensitive drum 7 is transferred to the recording medium 2.

The recording medium 2 to which the toner image has been transferred is transported to a fixing means 5 through a transport guide 3*f*. The fixing means 5 has a drive roller 5*c* and a fixing roller 5*b* internally provided with a heater 5*a*, where heat and pressure is applied to the recording medium 2 to fix to the surface of the recording medium 2 the toner image having been thus transferred.

The recording medium is transported through paired delivery rollers 3*g*, 3*h* and 3*i* via a reversing course 3*j* and is taken off to a take-off tray. This take-off tray is provided at the top of the electrophotographic image-forming apparatus main body 14 of the laser beam printer A. Also, a swingable flapper 3*k* may be actuated so that the recording medium 2 can be taken off through a paired delivery roller 3*m* not via the reversing course 3*j*. In this embodiment, the transport means 3 is constituted of the above pick-p roller 3*b*, paired transport rollers 3*c* and 3*d*, paired registration roller 3*e*, transport guide 3*f*, paired delivery rollers 3*g*, 3*h* and 3*i* and delivery roller 3*m*.

The photosensitive drum 7 from which the toner image has been transferred to the recording medium 2 by means of the transfer roller 4 is cleaned by a cleaning means 10 to remove the toner remaining on the photosensitive drum 7, and thereafter used for the next image-forming process. As shown in FIG. 2, the cleaning means 10 scrapes off the toner remaining on the photosensitive drum 7 by means of an elastic cleaning blade 10*a* provided in contact with the photosensitive drum 7 surface, and collects it in a waste-toner receptacle 10*b*.

In the present invention, the process cartridge has the cleaning means, which removes any unnecessary toner having adhered to the photosensitive member surface, and the cleaning means may preferably be a rubber elastic blade. In general, unless all the toner remaining on the photosensitive member surface without being transferred is scraped off, the toner may remain thereon to stain the next image. However, in the case when the toner having good floodability as in the present invention is used, the load may be less applied when the toner on the photosensitive member is scraped off with the rubber elastic blade. Hence, the unnecessary toner may hardly remain on the photosensitive member, so that good images can be formed.

The rubber elastic blade may also preferably be set at a preset angle within the range of from 10° to 30° to a tangent of the photosensitive member surface. This enables more highly effective removal of the unnecessary toner having adhered to the photosensitive member surface.

The rubber elastic blade may also preferably have an edge thickness of from 0.5 mm to 2.5 mm. This enables more highly effective removal of the unnecessary toner having adhered to the photosensitive member surface and also, as having an appropriate thickness, enables a good toner removal effect to be maintained over a long-term service without causing any break of the rubber elastic blade.

An example of a process cartridge B according to the present embodiment is described below. As shown in FIG. 2, a toner container (toner-holding section) 11A which holds therein the toner, a frame member 11 having a toner agitation-transport member 9*b* which is a toner agitation means, and a developing frame member 12 which holds a developing means 9 having a developing sleeve 9*a* and a developing blade 9*d* are integrally bonded by fusing to set up a developing unit. The process cartridge B has been made into a cartridge by integrally joining to the developing unit a cleaning frame member 13 fitted with a photosensitive drum 7, a cleaning means 10 (having a cleaning blade 10*a*) and a charging roller 8.

According to the present invention, the process cartridge B has a residual toner detection means (hereinafter "residual toner detector") capable of detecting the residual toner with consumption of the toner held in the toner container 11A.

Figure 3:
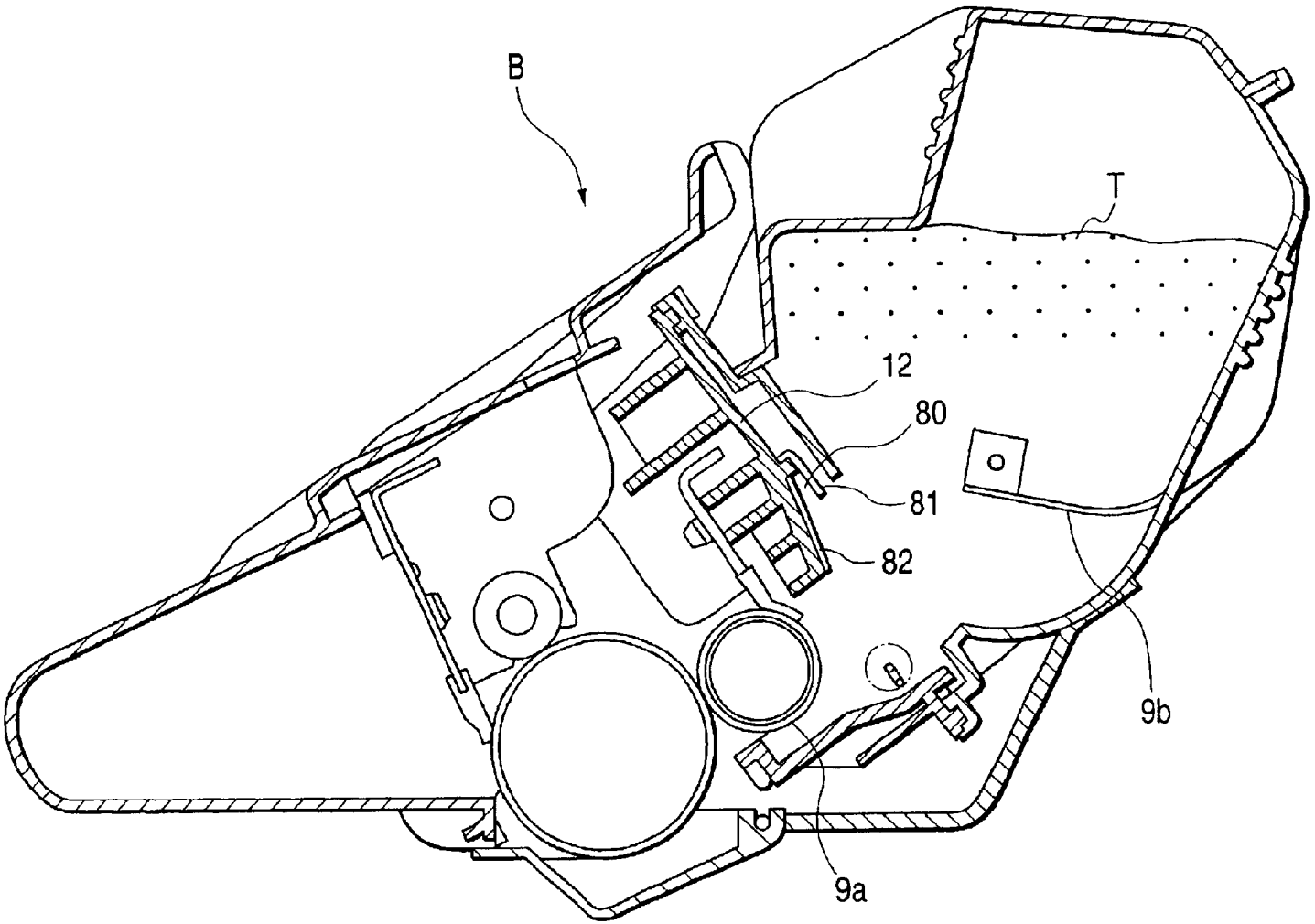
FIG. 3 is a schematic view showing the location of first and second electrodes and a recess formed by these in a toner-residual detection means according to the present invention.

According to the embodiment of this process cartridge, the residual toner detector makes use of, as shown in FIG. 3, a detection means having first and second electrodes 81 and 82 which form a recess 80 the lower part of which is kept open in such a way that the toner conveyed by the toner agitation-transport member 9*b* can enter (hereinafter the electrodes used in the residual toner detection means is also called "detection means" in some cases).

These electrodes 81 and 82 are also so disposed as to substantially face each other and be substantially in parallel to the developing sleeve 9*a*. Namely, the first and second electrodes 81 and 82 are disposed at different positions in the direction where they intersect the direction of movement of a toner T moved by the toner agitation-transport member 9*b*. Also, the first and second electrodes 81 and 82 are attached to a frame 12 which constitutes the developing chamber 9A. Specific construction of these first and second electrodes 81 and 82 is detailed later.

Then, the residual toner detector is a device in which an AC voltage is applied to any one of the first and second electrodes 81 and 82 to generate electric signals corresponding to the electrostatic capacity between these electrodes 81 and 82 and the signals are measured to detect the residual toner.

How the toner is before the shipping of the process cartridge and how it moves and decreases when the process cartridge is mounted to the electrophotographic image-forming apparatus main body 14 and used are described below.

When the process cartridge is shipped, a sealing member 30 for tightly sealing the toner held in the toner container 11A is stuck between the developing chamber 9A and the toner container 11A so that the toner may not leak outside because of vibration during transportation.

When the process cartridge is used by a user, it is mounted to the electrophotographic image-forming apparatus main body 14 after the sealing member 30 has been removed. The toner agitation-transport member 9*b* is provided in the toner container 11A as described above, and this toner agitation-transport member 9*b* has an agitation shaft and an elastic sheet (made of Mylar, trade name; available from Du Pont). As it is rotated, the toner held in the toner container 11A is transported toward the developing chamber 9A side.

The action of this toner agitation-transport member 9*b* brings the process cartridge B into use for the first time. Even immediately after the sealing member 30 has been removed, the toner is conveyed to the developing chamber 9A side without delay, and hence the process cartridge is smoothly brought into a printable state. At the same time, the toner is conveyed also to the space between the first and second electrodes 81 and 82, and hence the electrostatic capacity changes.

As the force that changes the state of toner standing distributed in the vicinity of the first and second electrodes 81 and 82, the following four items may be given.

(1) The force acting upward when the toner is conveyed in by the toner agitation-transport member 9*b*.

(2) The force by which the toner drops downward by its own weight.

(3) The force so acting as to cover up, and detain, the toner present in the recess 80. (The toner present in a large quantity at the lower part of the recess 80 may cover up the "toner behaving to drop downward by its own weight".)

(4) Where the toner itself has a low floodability, the force so acting as to detain, and pack, the toner at its existing position.

When the toner remains sufficiently in the toner container 11A and in the developing chamber 9A, the force of item (1) acts very strongly and also is firmly tightened by the force of item (1), i.e., the force acting to cover up the recess 80. Hence, the state where the space between the first and second electrodes 81 and 82 is kept packed with toner is maintained. In such a case, as the electrostatic capacity, a high value is continued being shown.

Where the process cartridge B is used on, the toner in the vicinity of the developing sleeve 9*a* is consumed because of development and decreases, where the toner held in the toner container 11A is always replenished to the vicinity of the developing sleeve 9*a* by the action of the toner agitation-transport member 9*b*. As a result, as the process cartridge B is used, the toner held in the toner container 11A decreases and its level decreases.

As shown in FIGS. 4A to 4D, as the level of the toner held in the toner container 11A decreases in the order of FIGS. 4A, 4B, 4C and 4D, the force of items (1) and (3) becomes smaller, and hence the residual toner present between the first and second electrodes 81 and 82 decreases, so that the electrostatic capacity also changes.

Figure 4A:
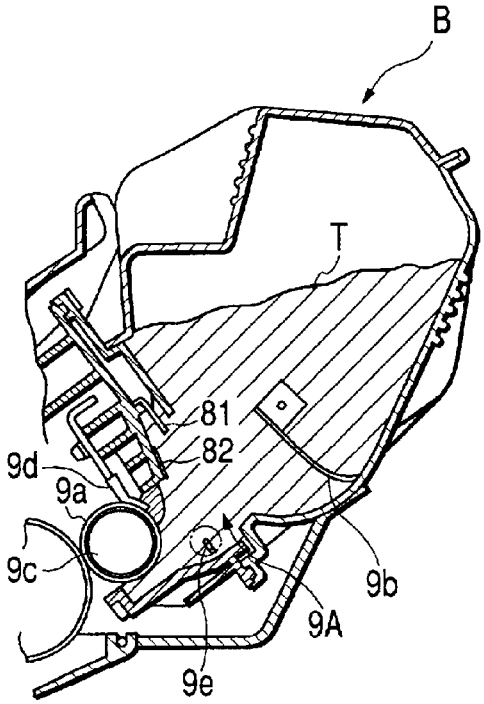
FIGS. 4A, 4B, 4C and 4D are schematic views showing how a toner decreases when the toner is consumed on and its positional relationship with the first and second electrodes.
Figure 4B:
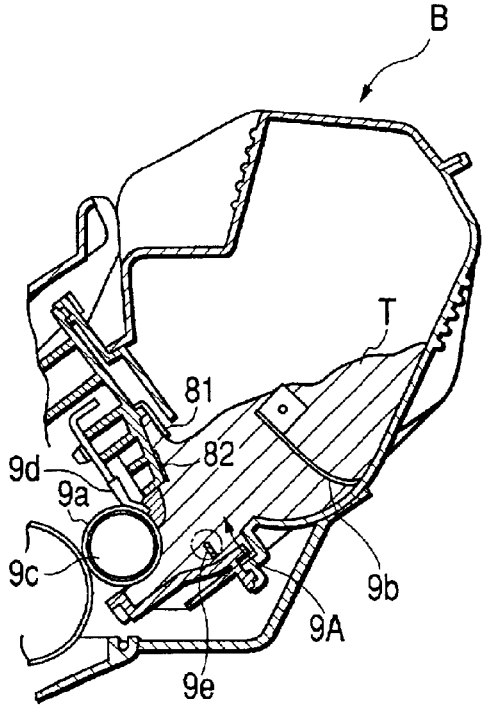
Figure 4C:
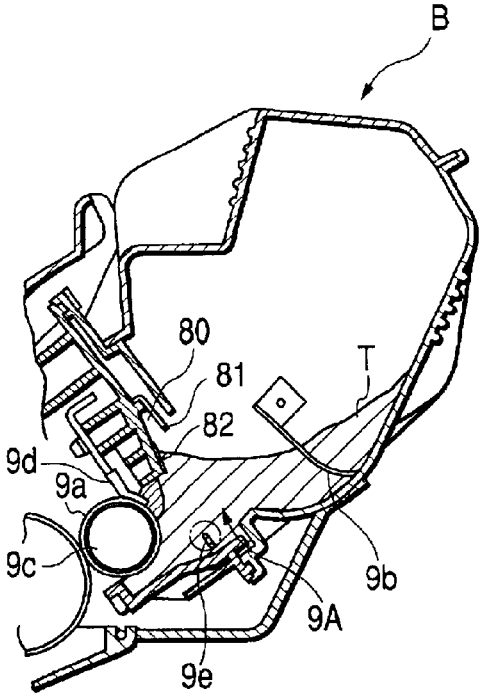
Figure 4D:
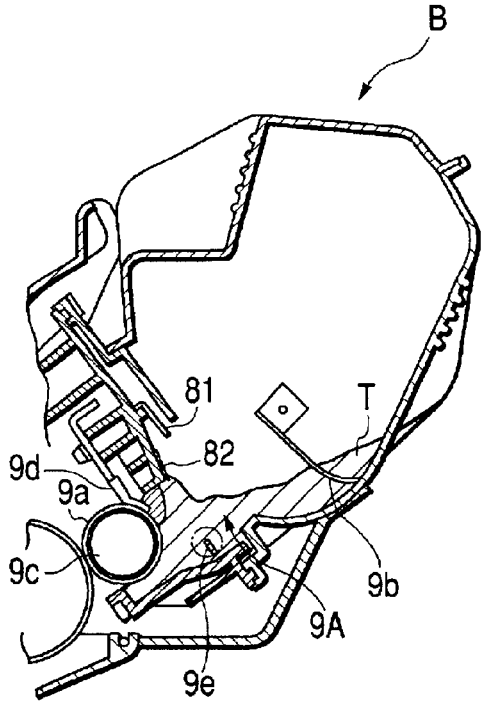

To describe this matter with reference to FIGS. 4A to 4D, FIG. 4A shows a condition where the toner is sufficiently held in the toner container 11A and the first and second electrodes 81 and 82 stand buried in the toner. FIG. 4B shows a condition where the toner held in the toner container 11A has decreased and has come to such a level that its surface is adjacent to the lower end of the first electrode 81 and the upper end of the second electrodes 82. FIG. 4C shows a condition where the toner has decreased further to come no longer present in the recess 80, and has come to a level which is lower than the lower end of the first electrode 81 and positioned at the middle of the second electrodes 82. FIG. 4D shows a condition where the toner has come to a level which is barely adjacent to the lower end of the second electrodes 82.

The tendency of change in the toner level (toner residual) in the toner container 11A and that in the value of electrostatic capacity depends on the powder characteristics of the toner used and the ability of transport of the toner agitation-transport member 9*b*.

For example, if the toner is as fluid as water, the toner level in the toner container 11A and the toner level at the space between the first and second electrodes 81 and 82 may be in perfect agreement. However, actual fluidity of toner is lower than the fluidity of water, and a condition where the toner has been transported to the developing chamber 9A side by the toner agitation-transport member 9*b* is maintained to a certain extent. Hence, as shown in FIGS. 4A to 4D, the toner level at the space between the first and second electrodes 81 and 82 tends to change a little later than the toner level in the toner container 11A changes. However, the toner according to the present invention has so high a floodability that the toner level in the toner container and the toner level at the space between the electrodes may differ less and the freedom of designing can be made high.

Any too weak or too strong transport force of the toner agitation-transport member 9*b* may also may cause a change in the manner in which the toner enters the space between the first and second electrodes 81 and 82, so the relationship between the change in residual toner and the change in value of electrostatic capacity may differ. However, the toner according to the present invention has so high a floodability that the position and shape of the first and second electrodes 81 and 82 can be made proper with ease to lessen the influence of transport force.

Besides the foregoing construction, where the process cartridge has, e.g., a memory means, the number of printed sheets or the drive time of the process cartridge may be stored in a memory so that the detection can be started for the first time when at least the time considered to reach an equilibrium lapses. Such a method is also available.

Figure 5:
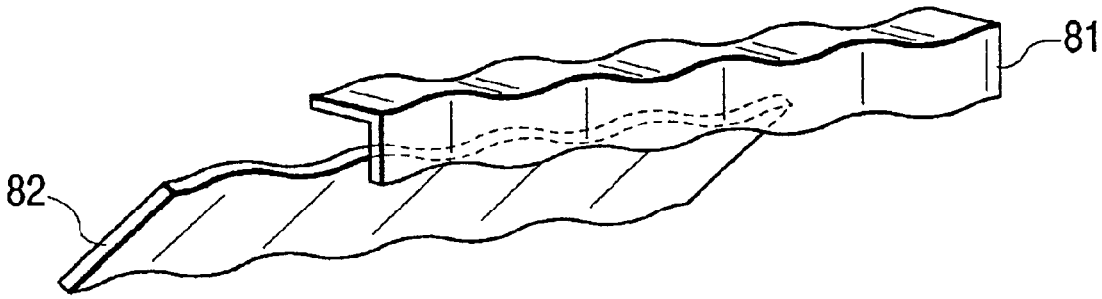
FIG. 5 is a perspective view showing the first and second electrodes.
Figure 6:
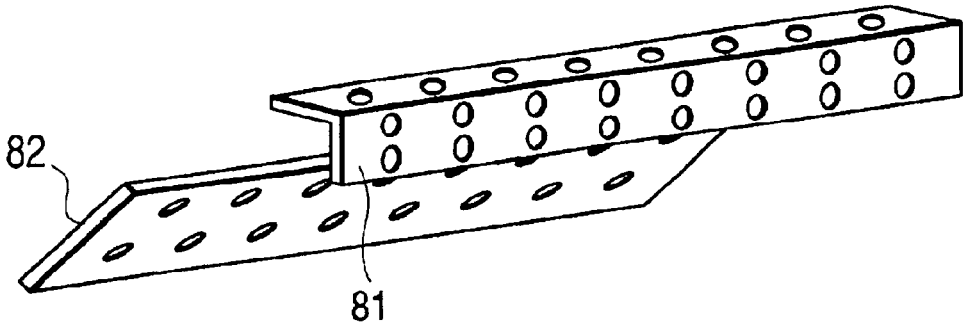
FIG. 6 is a perspective view showing the first and second electrodes.

In order to improve the precision of detection when the residual toner is successively detected, the amount of change in the electrostatic capacity may be made larger. Stated specifically, this can be achieved by making the first and second electrodes 81 and 82 each have a larger surface area or by setting the distance between the first and second electrodes 81 and 82 smaller. In the case when the electrodes are made to have larger surface area, they may be made to have a corrugated shape as shown in FIG. 5, or have a drawn shape as shown in FIG. 6.

Figure 7:
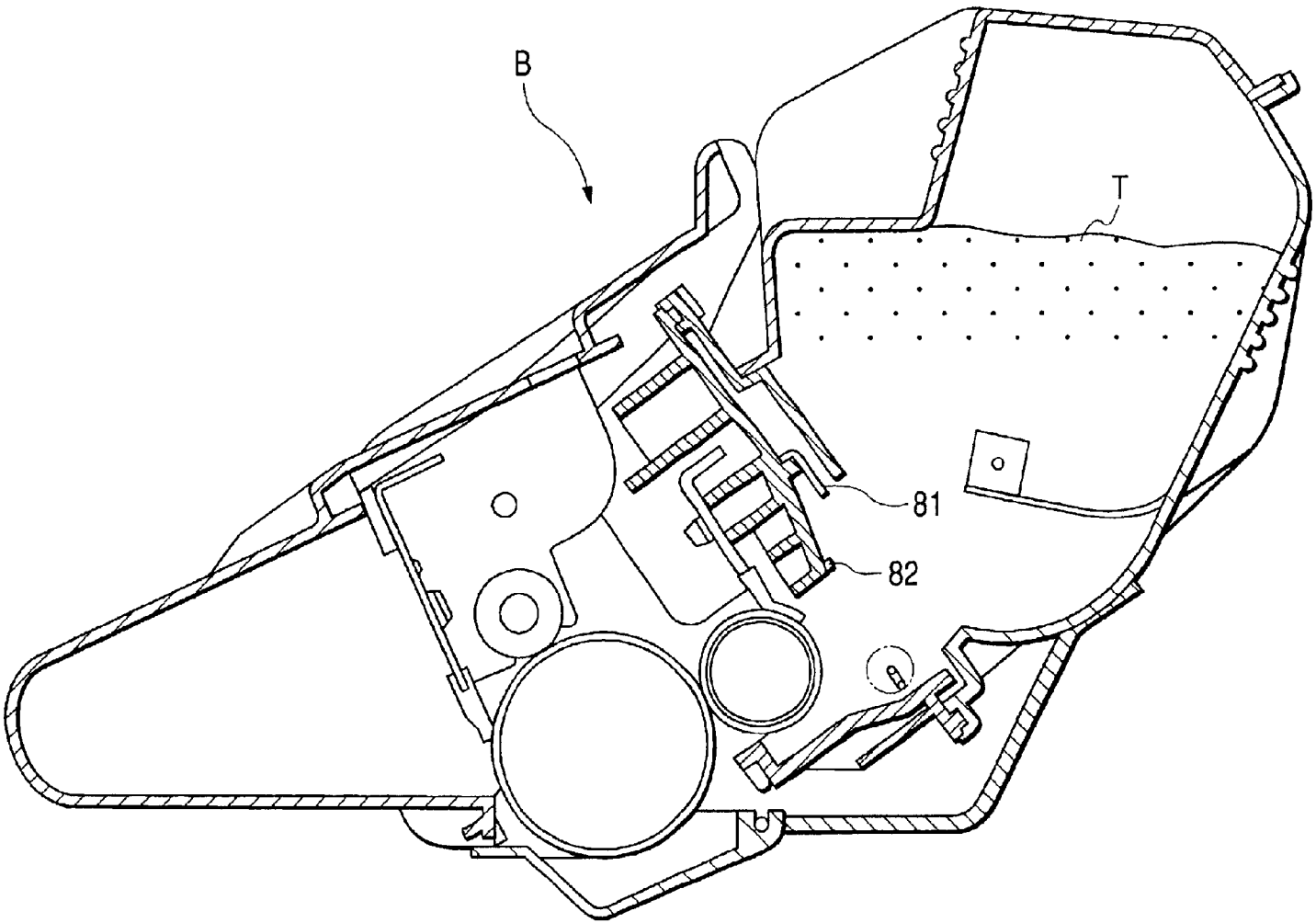
FIG. 7 is a longitudinal sectional view of a process cartridge according to the present invention.
Figure 8:
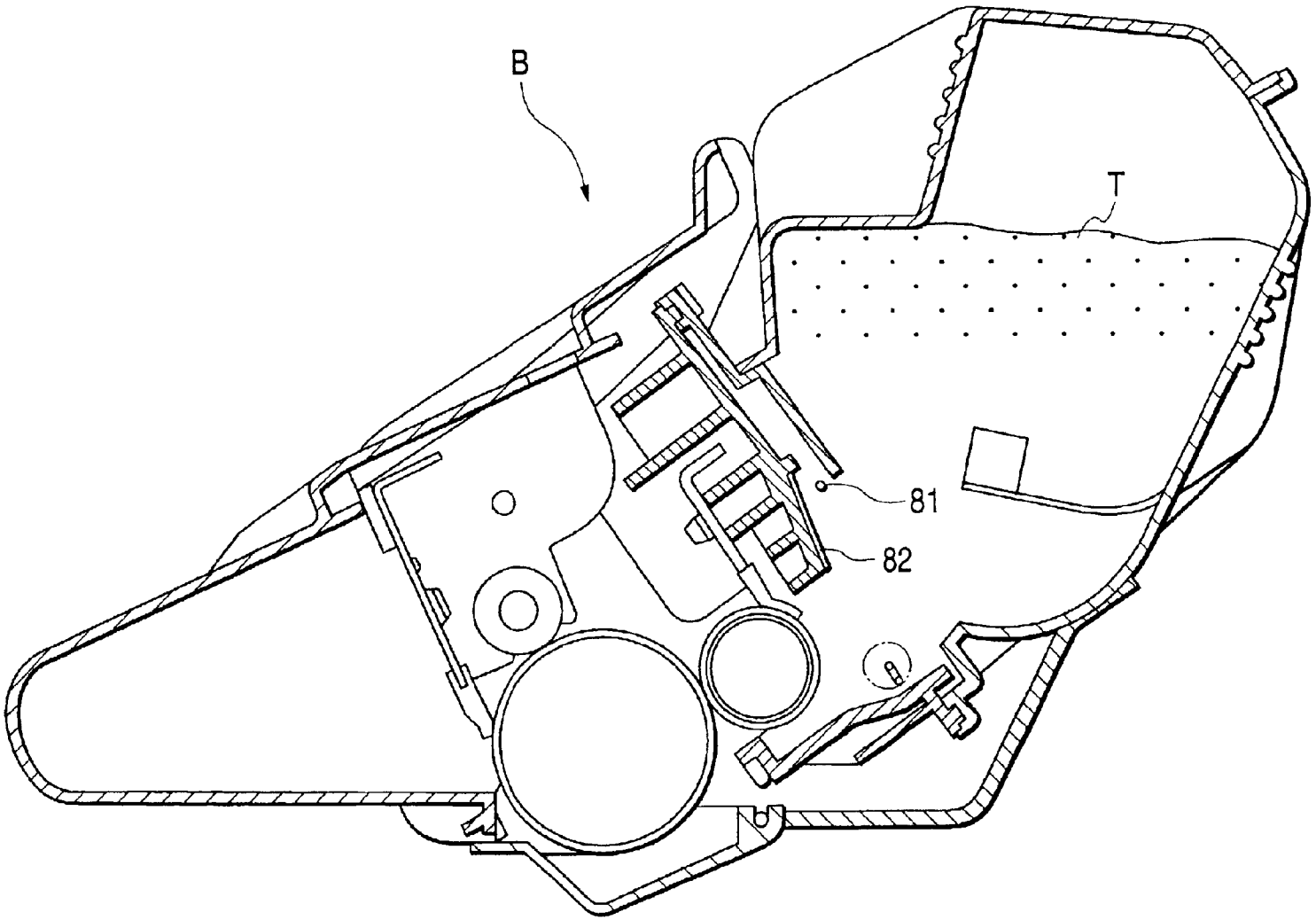
FIG. 8 is a longitudinal sectional view of a process cartridge according to the present invention.

Incidentally, where the space for the electrodes can not be ensured for some reason of designing or any cost reduction must be made, any one of the first and second electrodes 81 and 82 may be constituted of a round rod as shown in FIGS. 7 and 8.

As the image formation is continued, the toner is consumed, and finally the toner present between an end of the developing blade 9*d* which regulates the quantity of toner on the developing sleeve 9*a* surface and the second electrode 82, i.e., between the developing blade 9*a* and the second electrode 82 is used up, where blank areas occur on images and the process cartridge reaches the end of its stored toner, i.e., no toner.

Figure 9:
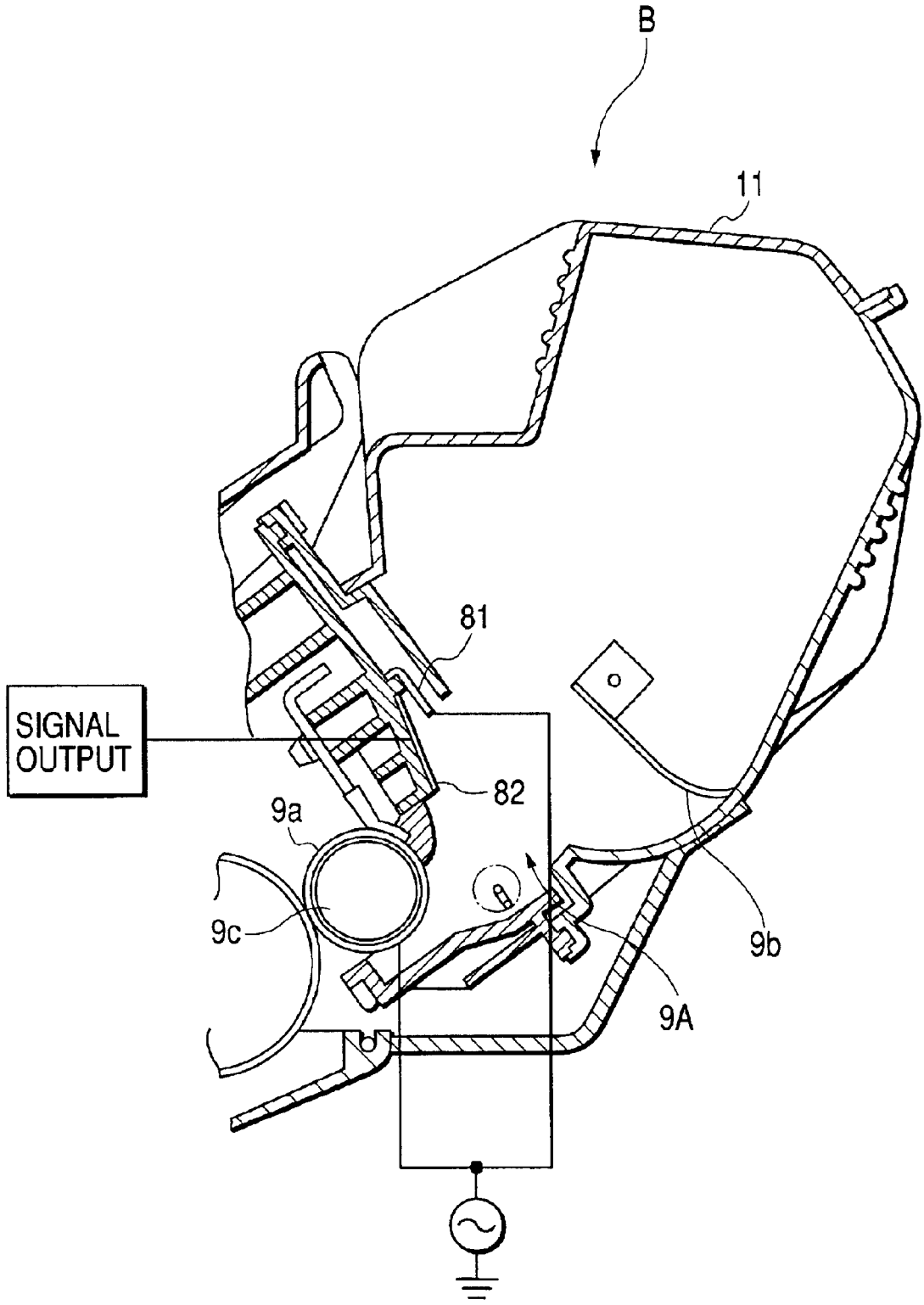
FIG. 9 is a view showing an electric circuit of the second electrode and developing sleeve.

Here, the developing sleeve 9*a* or a metal sheet of the developing blade 9*d* may further be used as either an electrode of a capacitor (what serves as the opposing electrode is the second electrode 82), and, as shown in FIG. 9, may be connected in parallel to the capacitor the first and second electrodes 81 and 82 constitute. This enables a great improvement in the precision in detecting the bank areas.

Figure 10A:
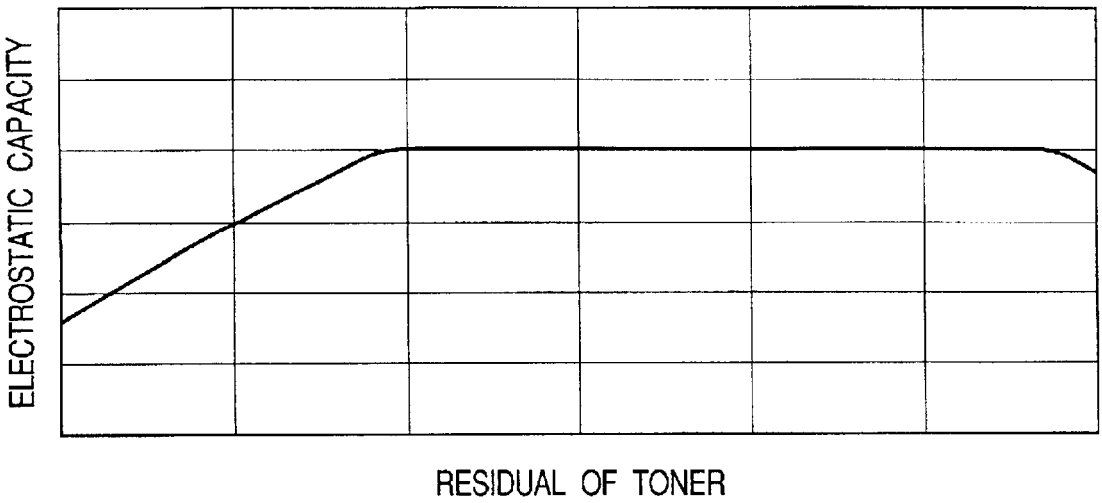
FIGS. 10A and 10B are graphs showing changes in residual toner and electrostatic capacity in (a) a case in which a developing member is not used as a capacitor and (b) a case in which a developing member is used as a capacitor, respectively.
Figure 10B:
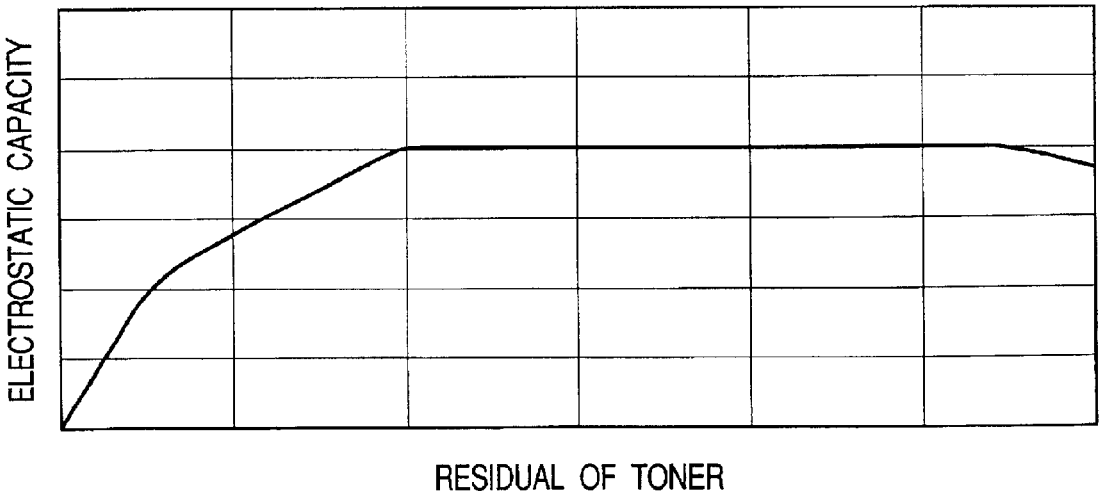

FIGS. 10A and 10B are graphs diagrammatically showing the precision of detection in a case in which the developing sleeve 9*a* is used as one of capacitors (FIG. 10A) and a case in which it is not used as the same (FIG. 10B). As can be seen therefrom, the amount of change in electrostatic capacity with respect to the unit amount of change in toner (consumption) is dramatically larger in the case of FIG. 10A than in the case of FIG. 10B at the last moment the blank areas occur.

The reason why the amount of change in electrostatic capacity with respect to the unit amount of change in toner (consumption) is dramatically larger at the last moment the blank areas occur is that, as stated above, the blank areas occur when the quantity of toner on the developing sleeve 9*a* surface begins decreasing. Hence, it is an indispensable condition for improving detection precision to measure the quantity of toner on the developing sleeve 9*a* surface more accurately.

As described above, the use of the developing sleeve 9*a* as either an electrode of the capacitor and the presence of the opposing electrode second electrode 82 in the vicinity of the developing sleeve 9*a* surface make it possible to achieve a higher "detection sensitivity" in the vicinity of the developing sleeve 9*a*, so that the difference in detection precision as shown in FIGS. 10A and 10B is brought about.

In order to further improve the "detection sensitivity" at the last moment the blank areas occur, it is necessary to improve the "detection sensitivity" in the vicinity of the developing sleeve 9*a* surface.

Figure 11:
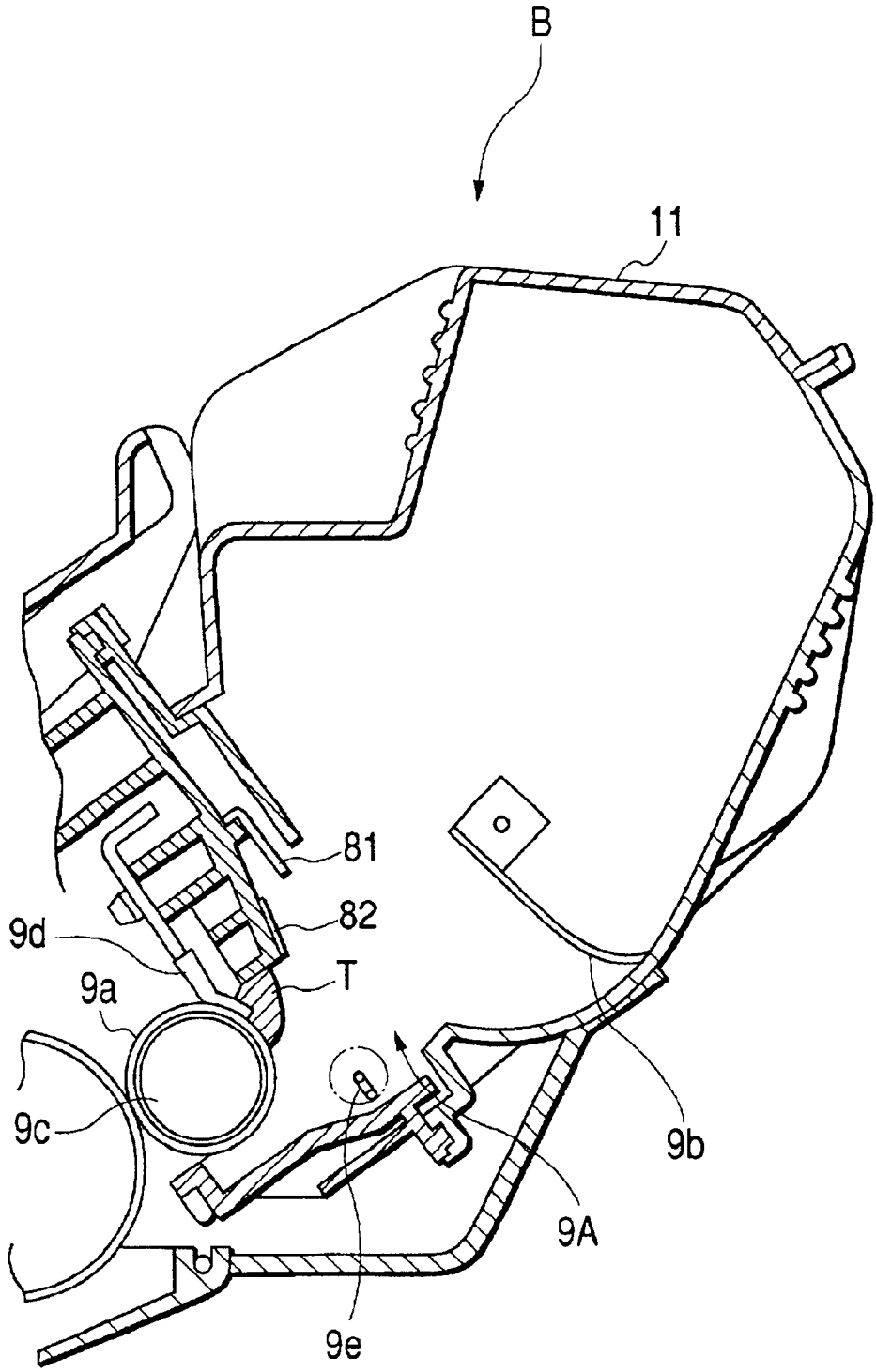
FIG. 11 is a schematic illustration showing a condition in which the toner is present only in the vicinity of a developing blade.

Even when there is little toner on the developing sleeve 9*a* surface, development is possible when the toner T remains in the region and vicinity of the developing blade 9*d* as shown in FIG. 11. Accordingly, the blank-area detection precision can be improved by making the toner T in that region detectable with a good sensitivity.

Incidentally, the electrodes 81 and 82 all act alike as long as they are conductive members. In the embodiment of the process cartridge of the present invention, non-magnetic metallic materials such as non-magnetic stainless steel are used so that they have no influence on the circulation of toner.

The electrodes 81 and 82 may also directly be attached to the frame 12 constituting the developing chamber 9A, by processing such as metallizing and printing or by two-color molding of conductive resins. In such a case, compared with electrodes formed of different members, the electrodes can be attached in less fitting tolerance and less component part tolerance, and hence the improvement in positional precision can be achieved.

In the foregoing description, the construction of toner-residual detection in which a magnetic toner is used as the toner has been described. The present invention is applicable also to the construction of a developing unit in which a non-magnetic toner is used.

Process Cartridge, Embodiment 2

Next, a second embodiment of the process cartridge according to the present invention is described with reference to FIGS. 12 to 14.

In the second embodiment of the process cartridge, too, an electrophotographic image-forming apparatus having the same construction and function as those described in the first embodiment of the process cartridge is used. Thus, the like members are denoted by the like reference numerals.

Figure 12:
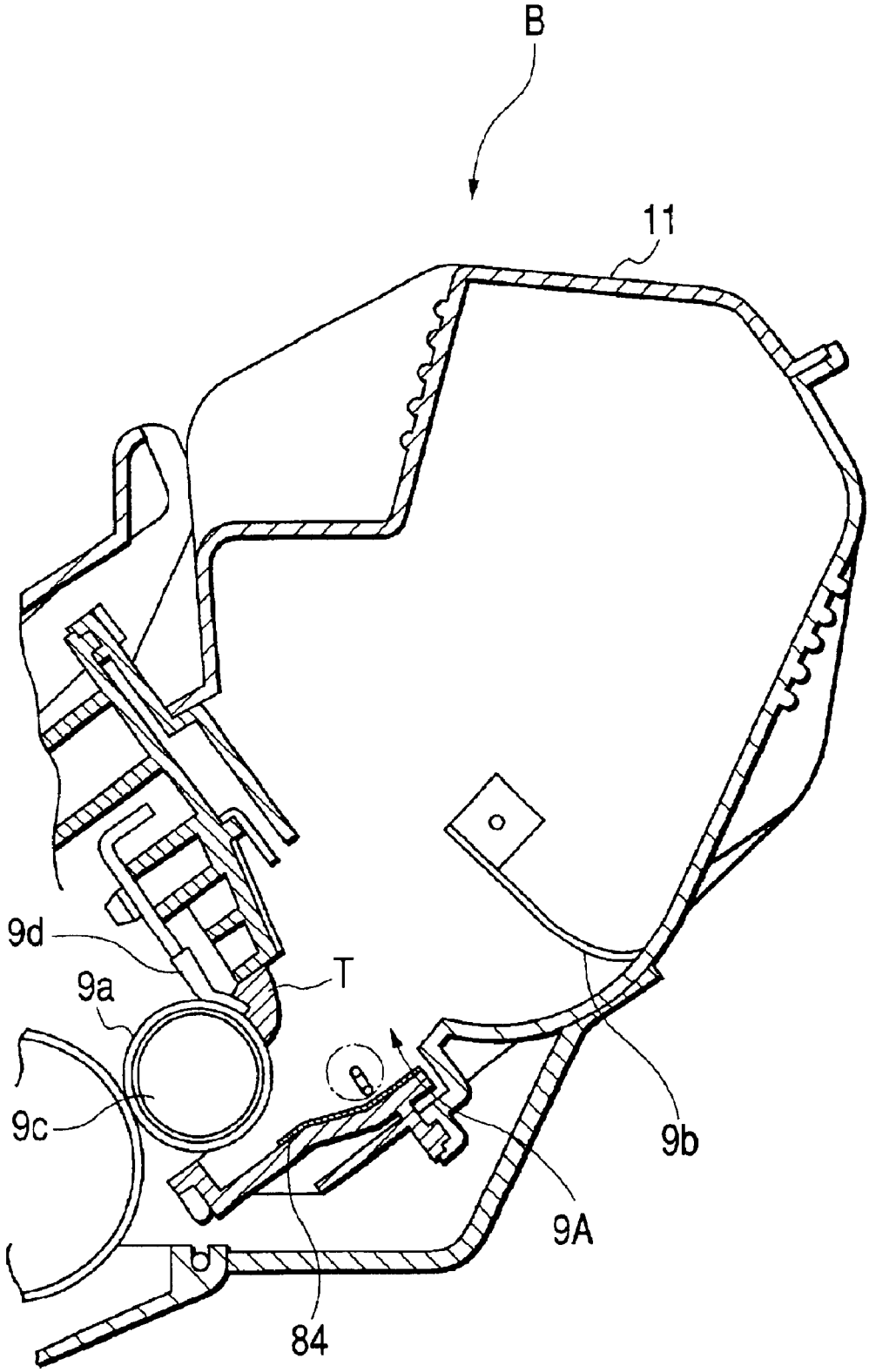
FIG. 12 is a main-part longitudinal sectional view showing a toner-residual detector.

In the second embodiment of the process cartridge, as shown in FIG. 12, an electrode 84 is disposed on the bottom surface of a developing chamber 9A. More specifically, the electrode 84 is provided in the course where a toner T held in a toner container 11 comes to a developing sleeve 9*a*. Accordingly, this electrode 84 is hereinafter called a "course electrode 84". This course electrode 84 has the sectional shape shown in FIG. 12 and has the same shape over the whole region in the lengthwise direction.

On a magnetic toner present on the bottom surface of the developing chamber 9A and the vicinity thereof, the force always acts by which it is attracted to the developing sleeve 9*a* by the aid of magnetic force of a magnet 9*c* provided in the developing sleeve 9*a*. Hence, there is a tendency that, as the toner is running short and the feed of toner from the toner container 11 decreases, the toner remaining in the vicinity of the floor surface of the developing chamber 9A is first consumed.

Figure 13A:
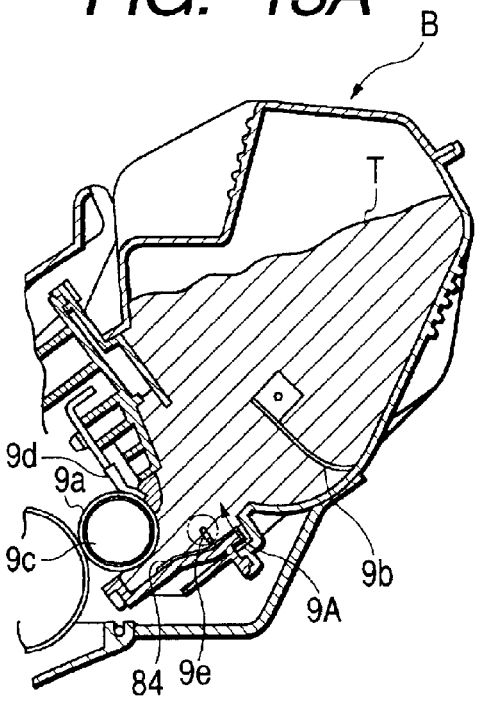
FIGS. 13A, 13B, 13C and 13D are schematic illustrations showing how a bottom-surface electrode and a toner stand when the quantity of toner becomes smaller.
Figure 13B:
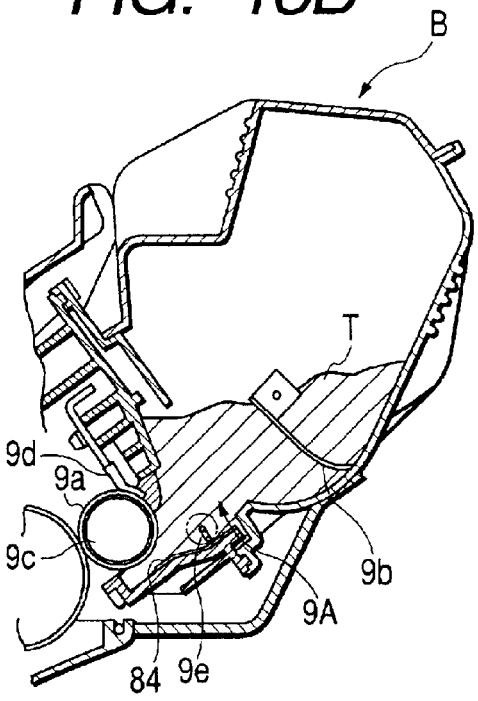
Figure 13C:
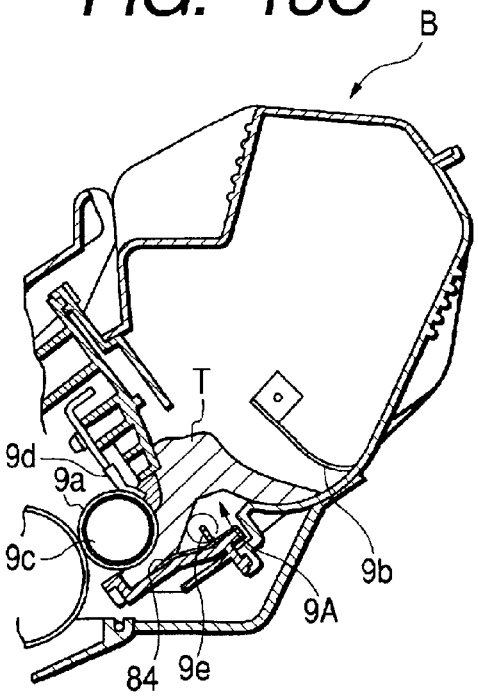
Figure 13D:
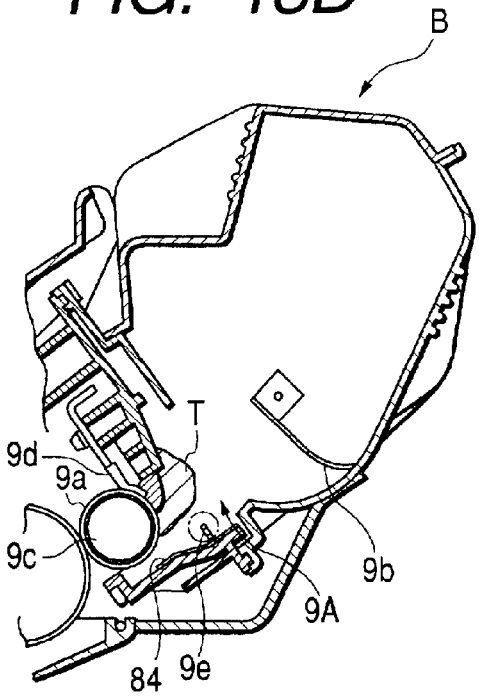

Stated specifically, as shown in FIGS. 13A to 13D, when the toner remains in the toner container 11 in a large quantity, the toner is packed into the developing chamber 9A by its own weight, and hence the toner is immediately packed thereinto even when the toner is consumed as stated above (FIG. 13A). However, as the toner residual in the toner container 11 becomes smaller, the force of packing the toner in its portion having been consumed does not act strongly, so that the developing chamber 9A becomes hollow (come to have a cavity) first in the vicinity of the bottom surface of the developing chamber 9A (FIGS. 13B and 13C), and finally the toner comes to remain around the edge of the developing blade 9*d* (FIG. 13D). However, the toner according to the present invention has so high a floodability that such a phenomenon may occur with difficulty, and is preferable for attaining the performance of the process cartridge.

Since the toner is consumed in this manner, the present construction enables residual toner detection which can detect the residual toner in the vicinity of the bottom surface of the developing chamber 9A.

Figure 14:
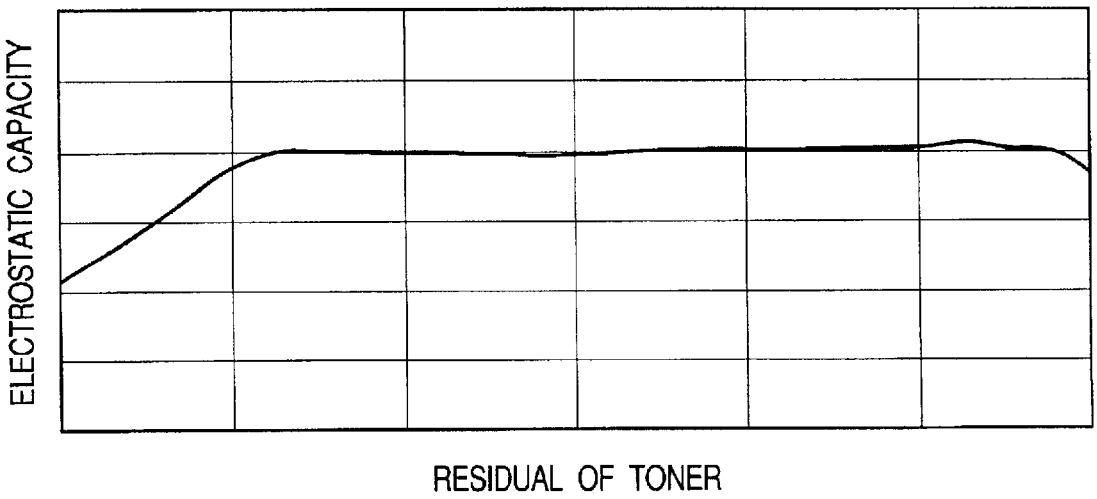
FIG. 14 is a graph showing the relationship between the toner residual and the electrostatic capacity in a toner-residual detector.

FIG. 14 is a graph diagrammatically showing a change in electrostatic capacity which is caused when the residual toner becomes smaller. As can be seen from FIG. 14, the use of this construction also enables detection of the residual toner.

Process Cartridge, Embodiment 3

Next, a third embodiment of the process cartridge according to the present invention is described.

Figure 15:
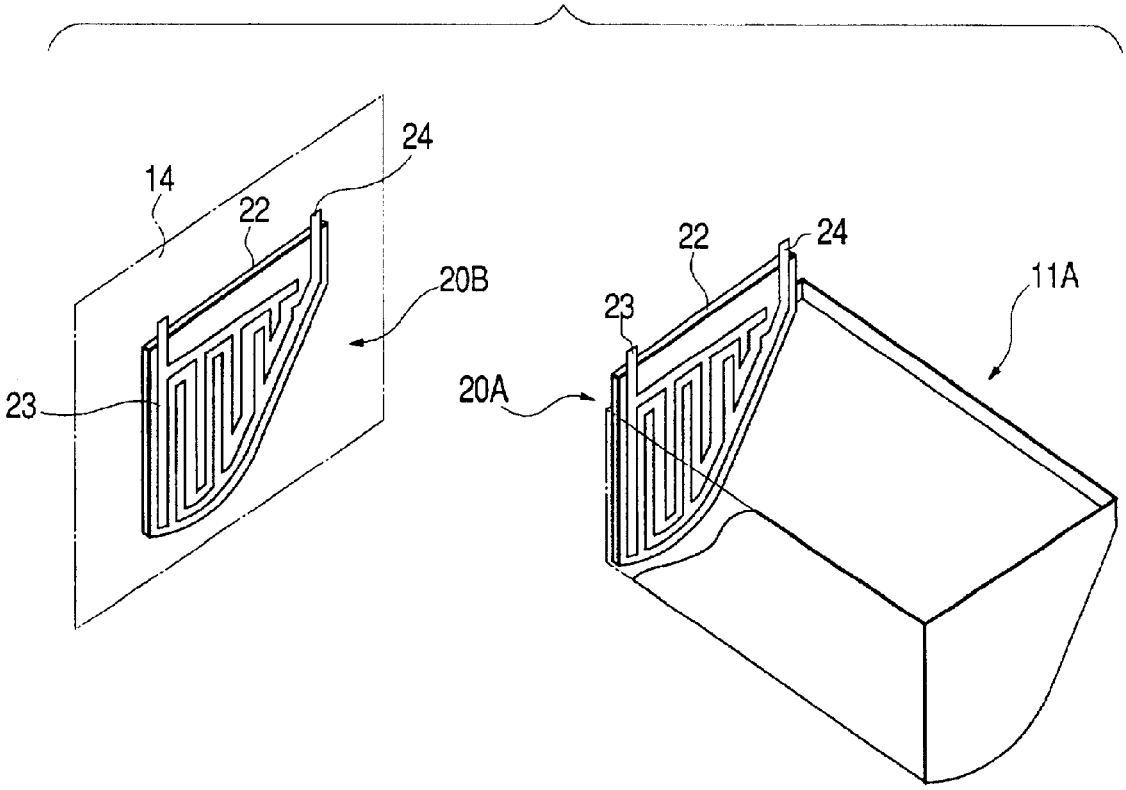
FIG. 15 is a perspective view of a toner container, for describing an example of the toner-residual detector used in the present invention.

In the third embodiment of the process cartridge, a residual toner detector has, as shown in FIG. 15, a measuring electrode member 20A as a first electrostatic capacity generator at which the residual toner is detected. Here, the detector may preferably have a reference electrode member 20B as a second electrostatic capacity generator which is a comparison member which detects the environment, i.e., atmospheric temperature and humidity and outputs reference signals.

Figure 16:
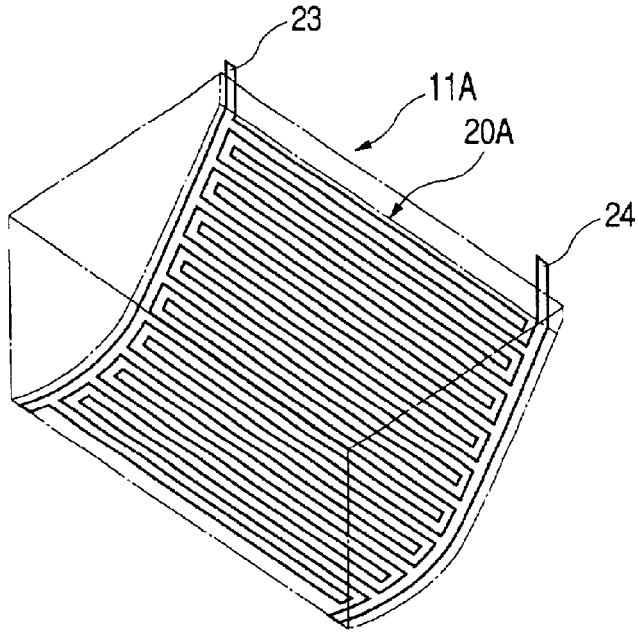
FIG. 16 is a perspective view of a toner container, for describing another example of the toner-residual detector used in the present invention.
Figure 17:
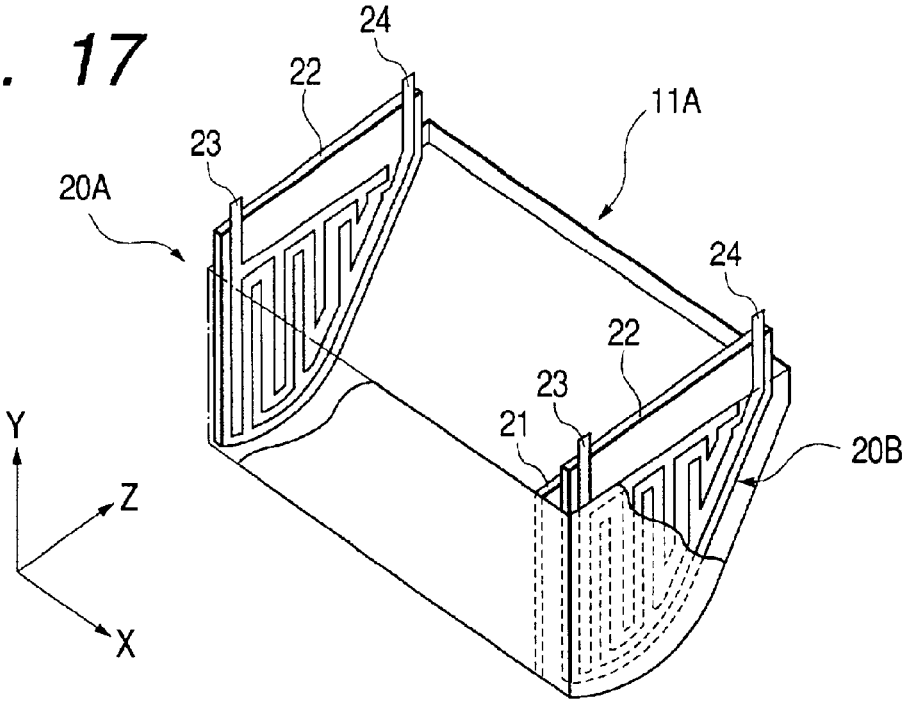
FIG. 17 is a perspective view of a toner container, for describing still another example of the toner-residual detector used in the present invention.
Figure 18:
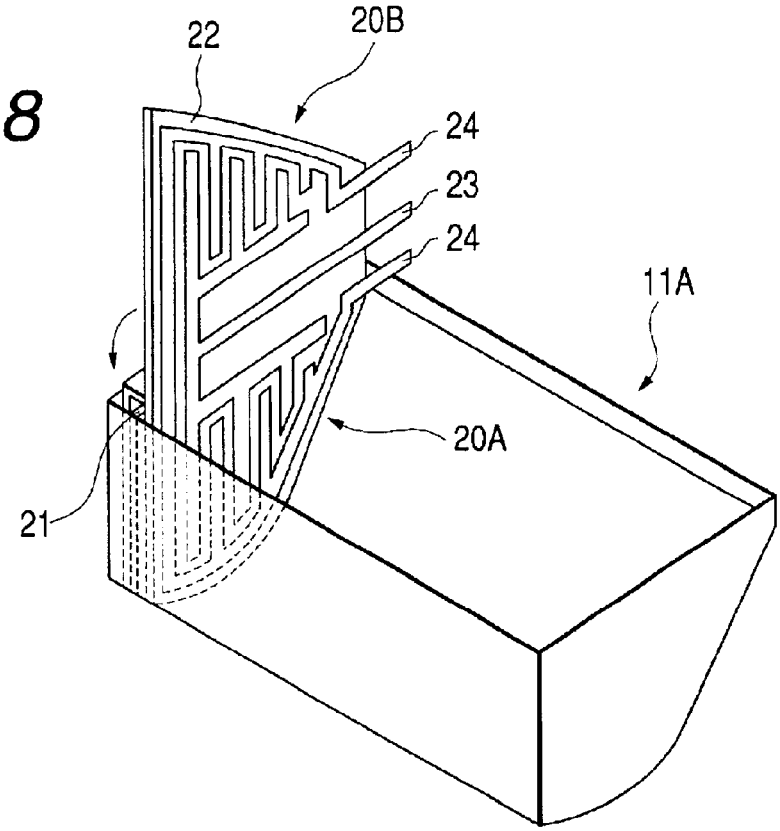
FIG. 18 is a perspective view of a toner container, for describing a further example of the toner-residual detector used in the present invention.

The measuring electrode member 20A is disposed at a position coming into contact with the toner and moreover in such a direction that the area of contact with the toner may vary as the toner decreases, e.g., on an inner sidewall of the toner container 11A of the developing means 9 as shown in FIG. 15, or on the inner bottom surface of the toner container 11A as shown in FIG. 16. Also, in the case when the reference electrode member 20B is provided, as shown in FIG. 14 it may be provided at any position of the main body 14, not coming into contact with the toner. It may also be provided, e.g., as shown in FIG. 17, at a place which is inside the toner container 11A and does not come into contact with the toner, divided with a partition wall 21 on the side opposite to the measuring electrode member 20A. Still also, where the measuring electrode member 20A and the reference electrode member 20B are integrally made up in symmetrical disposition as shown in FIG. 18, the latter may be provided at a place which is inside the toner container 11A on the same side as the side on which the measuring electrode member 20A has been disposed and does not come into contact with the toner, divided with a partition wall 21; the reference electrode member 20B being folded outward.

Figure 19:
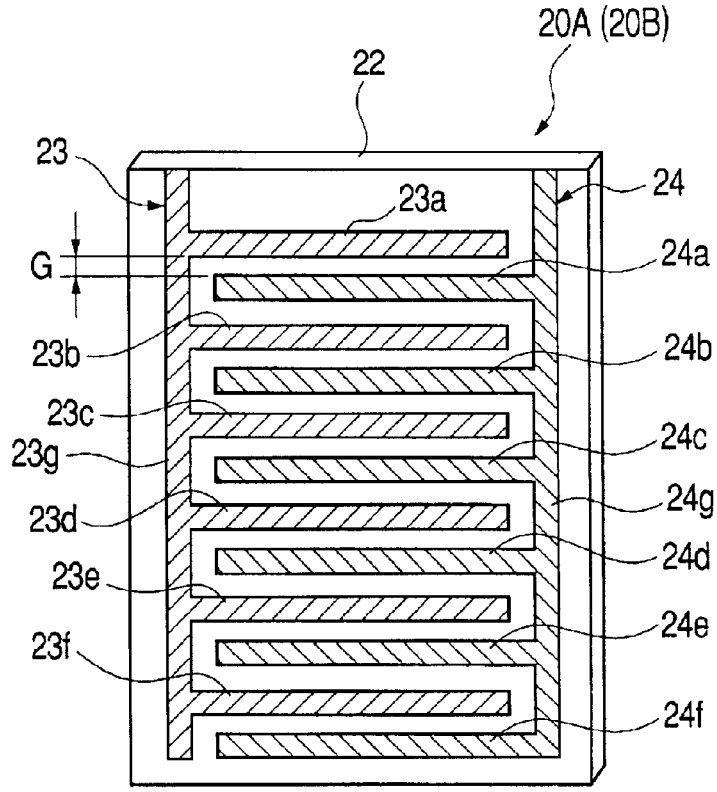
FIG. 19 is a front view showing an example of measuring electrode and reference electrode members.
Figure 20:
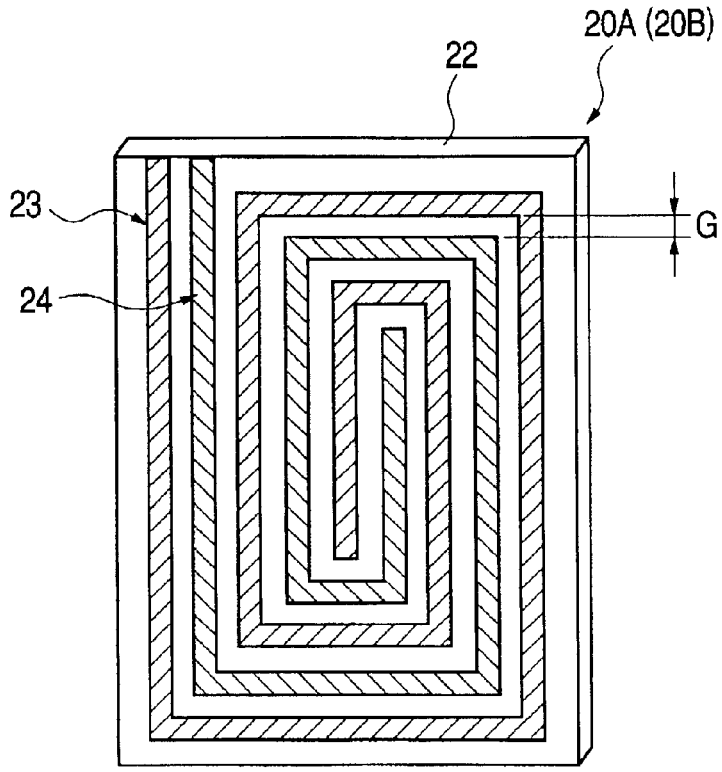
FIG. 20 is a front view showing another example of measuring electrode and reference electrode members.

The measuring electrode member 20A has, as shown in FIG. 19, a pair of conducting members, i.e., electrodes 23 and 24, formed in parallel on a substrate 22 at given intervals. The electrodes 23 and 24 may each have one base portion and a plurality of branched portions branched from the base portion, and the branched portions of the respective electrodes 23 and 24 may be so formed as to be alternately arranged in parallel at given intervals G. In this embodiment, the electrodes 23 and 24 have at least one set of paired electrode portions 23*a* to 23*f* and 24*a* to 24*f*. The electrode portions 23*a* to 23*f* and 24*a* to 24*f* are connected with one another through connecting electrode portions 23*g* and 24*g*, respectively. The two electrodes 23 and 24 have the form of many T-shaped branches paired with one another. Of course, the electrode pattern of the measuring electrode member 20A is by no means limited to this. As shown in FIG. 20, it may also be formed in a spiral shape in which a pair of electrodes 23 and 24 are disposed in parallel to each other at a given interval.

The measuring electrode member 20A can successively detect the residual of toner in the toner container 11A by measuring the electrostatic capacity between the pair of electrodes 23 and 24. Namely, since the toner has a larger dielectric constant than air, the electrostatic capacity between the pair of electrodes 23 and 24 increases as the toner comes into contact with the surface of the measuring electrode member 20A.

Thus, according to the present invention, using the measuring electrode member 20A constructed as described above, the residual toner in the toner container 11A can be measured from the contact area of toner coming into contact with the surface of the measuring electrode member 20A by applying a prescribed calibration curve, without regard to the sectional shape of the toner container 11A and the shape of the measuring electrode member 20A.

Electrode patterns 23 and 24 of such a measuring electrode member 20A may be obtained, e.g., by forming conductor metal patterns 23 and 24 of copper or the like by etching or printing on, e.g., a rigid printed substrate 22 of 0.4 mm to 1.6 mm thick made of paper-reinforced phenol resin or glass-reinforced epoxy resin or a flexible printed substrate 22 of about 0.1 mm thick made of polyester or polyimide. Such electrodes may be produced by the same method as any conventional method of forming wiring patterns on printed substrates. Thus, even those having a complicated electrode pattern form as shown in FIGS. 10 and 20 can be produced with ease, and their production cost may little differ from that for those having simple patterns.

The use of the complicated pattern form as shown in FIGS. 19 and 20 enables the electrodes 23 and 24 to face each other at a large length. A pattern formation method such as etching may further be used so that the given intervals G between the electrodes 23 and 24 can be narrowed up to approximately tens of microns ($\mu$m), making it possible to attain a large electrostatic capacity. Also, this can make larger the amount of change in electrostatic capacity and can improve detection precision. Stated specifically, the electrodes 23 and 24 are each formed in a width of from 0.1 mm to 0.5 mm, a thickness of from 17.5 $\mu$m to 70 $\mu$m and an interval G of from 0.1 mm to 0.5 mm. To the metal pattern-formed surface, a thin resin film of, e.g., approximately from 12.5 $\mu$m to 125 $\mu$m thick may further be laminated.

As described above, according to the residual toner detector used in the present invention, changes in the area of contact of toner with the measuring electrode member 20A provided on the sidewall or bottom surface of the interior of the toner container 11A in the direction where the toner decreases, i.e., changes in electrostatic capacity of the measuring electrode member 20A are measured, and the residual toner in the whole toner container 11A is successively detected on the basis of the measured values.

Namely, since the toner has a larger dielectric constant than air, the electrostatic capacity to be outputted is larger at the part where the toner is in contact with the measuring electrode member 20A (the part where the toner is present) than at the part where the toner is not in contact with it (the part where the toner is not present). Accordingly, the changes in such electrostatic capacity may be measured to estimate the residual toner in the toner container 11A.

As shown in FIG. 15, the measuring electrode member 20A may be disposed on an inner sidewall on one side of the toner container 11A, where the proportion the toner occupies in the sectional area along the Y-Z plane shown in FIG. 17, of the side portion in the lengthwise direction of the toner container 11A can be estimated on the basis of the value of electrostatic capacity.

Figure 21:
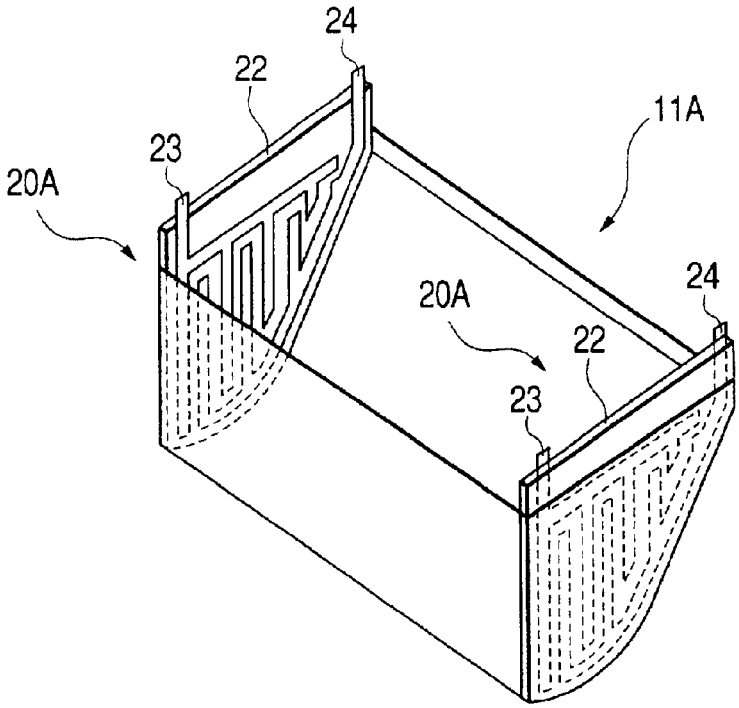
FIG. 21 is a perspective view of a toner container, for describing another example of the toner-residual detector used in the present invention.
Figure 22:
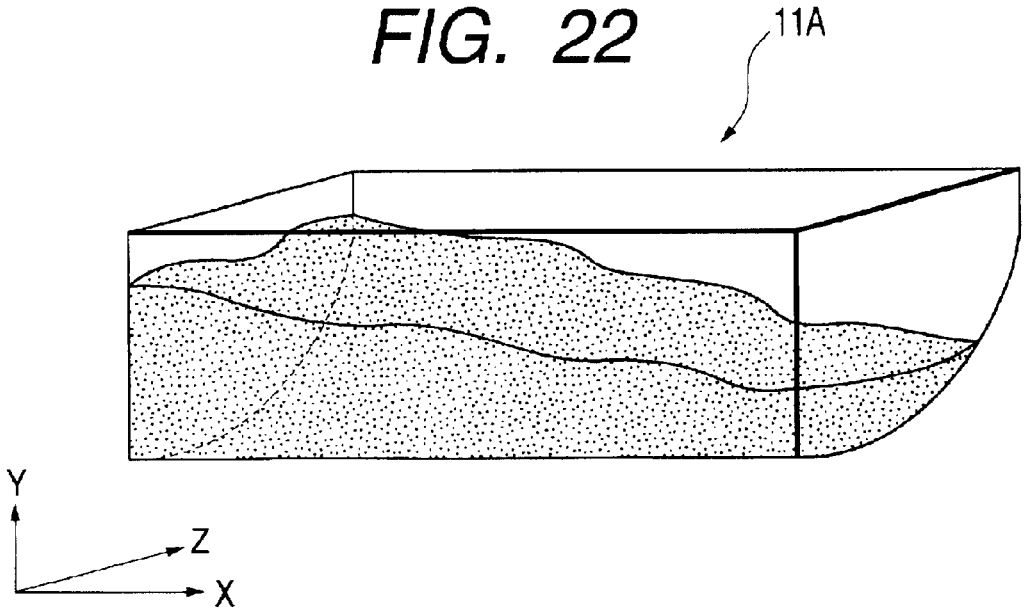
FIG. 22 is a view showing another example of a form in which the toner is held in a toner container.

As also shown in FIG. 21, the measuring electrode member 20A may be disposed at two places, on both sidewalls on the inside of the toner container 11A, where any gathering of toner on one side can be estimated by comparing outputs of both the measuring electrode members 20A and 20A, even in instances in which the toner has extremely gathered on one side in the lengthwise direction as shown in FIG. 22 when the process cartridge B is detached in order to deal with paper jamming or because the process cartridge B has been leaned or printing patterns have deviated from normal courses. Thus, the residual toner can more accurately be estimated against any gathering of toner on one side in the lengthwise direction than the case where the measuring electrode member 20A is disposed on one side. However, where the toner having high floodability as in the present invention is used and further the toner container has an agitation mechanism therein, it is not always necessary to dispose the measuring electrode member 20A at two places.

Where the measuring electrode member 20A is disposed on the bottom surface on the inside of the toner container 11A as shown in FIG. 16, the proportion the toner occupies in the bottom area can be estimated. Hence, any influence of the gathering of toner on one side in the lengthwise direction can be made small. Moreover, since in the toner container 11A the bottom surface has a larger area than either sidewall, the measuring electrode member 20A can be set at a larger area than the above case where it is disposed on the sidewall. Thus, the amount of change in electrostatic capacity can be made larger and larger outputs can be ensured, promising a small error of measurement.

Where the measuring electrode member 20A is disposed on the bottom surface and sidewall on the inside of the toner container 11A, the residual toner in the toner container 11A can three-dimensionally be estimated, and hence the residual toner in the toner container can more accurately be detected.

According to the present invention, the residual toner detector may further have, as shown in FIG. 15, the reference electrode member 20B as a second electrostatic capacity generator.

The reference electrode member 20B may have the same construction as the measuring electrode member 20A. The reference electrode member 20B may have, as shown in FIG. 19, a pair of conducting members, i.e., electrodes 23 (23*a* to 23*f*) and 24 (24*a* to 24*f*) formed in parallel on the substrate 22 at given intervals, and the two electrodes 23 and 24 may have the form of many T-shaped branches paired with one another. Also, as shown in FIG. 20, it may be formed in a spiral shape. The reference electrode member 20B may also be produced by the same method as any conventional method of forming wiring patterns on printed substrates.

According to the present invention, as described above, the reference electrode member 20B varies in electrostatic capacity in accordance with environmental conditions such as temperature and humidity and functions as a comparison member for reference with respect to the measuring electrode member 20A. Hence, the residual toner can be detected in a higher precision.

In the above embodiments of the process cartridge, the residual toner can successively be detected over the whole region of from about 30% to 0%, assuming as 100% the quantity of the toner held in the container at first. In the present invention, however, without limitation to this range, the process cartridge may be so designed that the residual toner in the container is successively detected over the region of from 50% to 0%, or from 40% to 0%. Here, the situation that the residual toner is 0% does not mean only that the toner has completely run short. For example, the situation that the residual toner is 0% also embraces a situation that, even though the toner still remains in the container, its residual toner has decreased to an extent that the stated image quality (development quality) can no longer be attained.

EXAMPLES

The present invention is described below by giving examples specifically. The present invention is by no means limited to these.

In the following Examples and Comparative Example, a developing unit described below is used.

Figure 23:
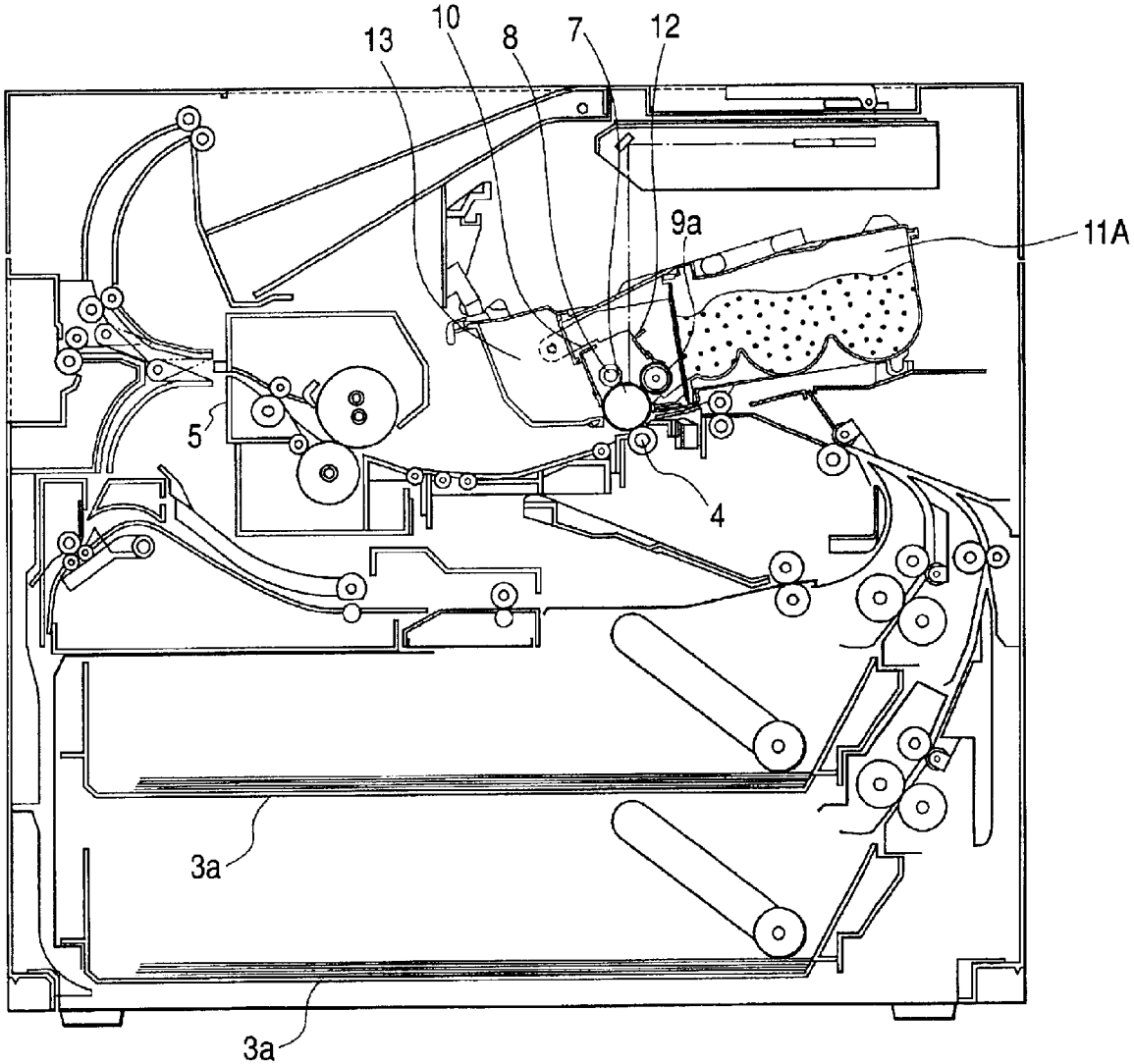
FIG. 23 is a longitudinal sectional view showing an image-forming apparatus main body to which a process cartridge has been mounted, used in examples of the present invention.
Figure 24:
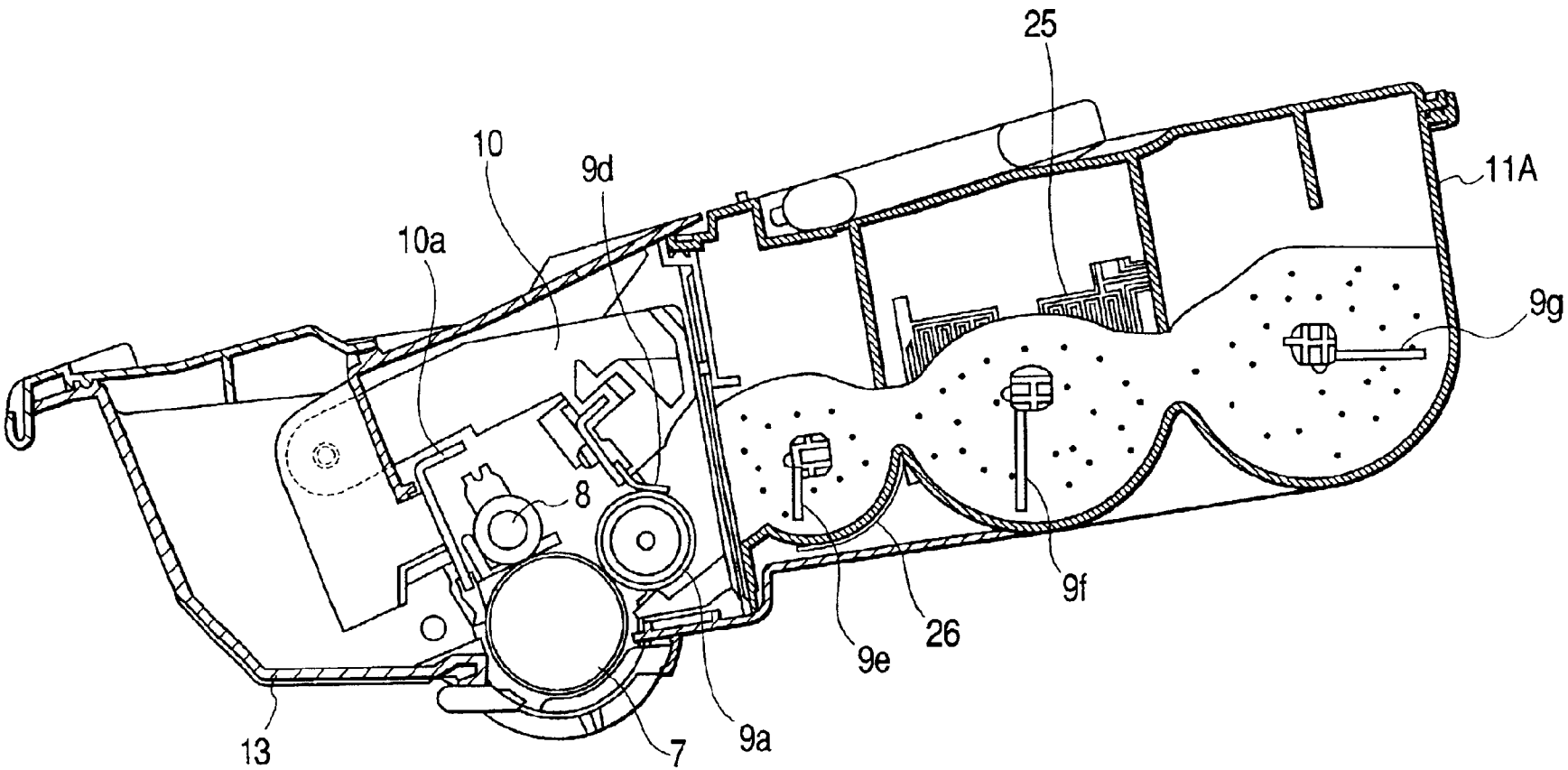
FIG. 24 is a longitudinal sectional view showing a process cartridge used in examples of the present invention.
Figure 25:
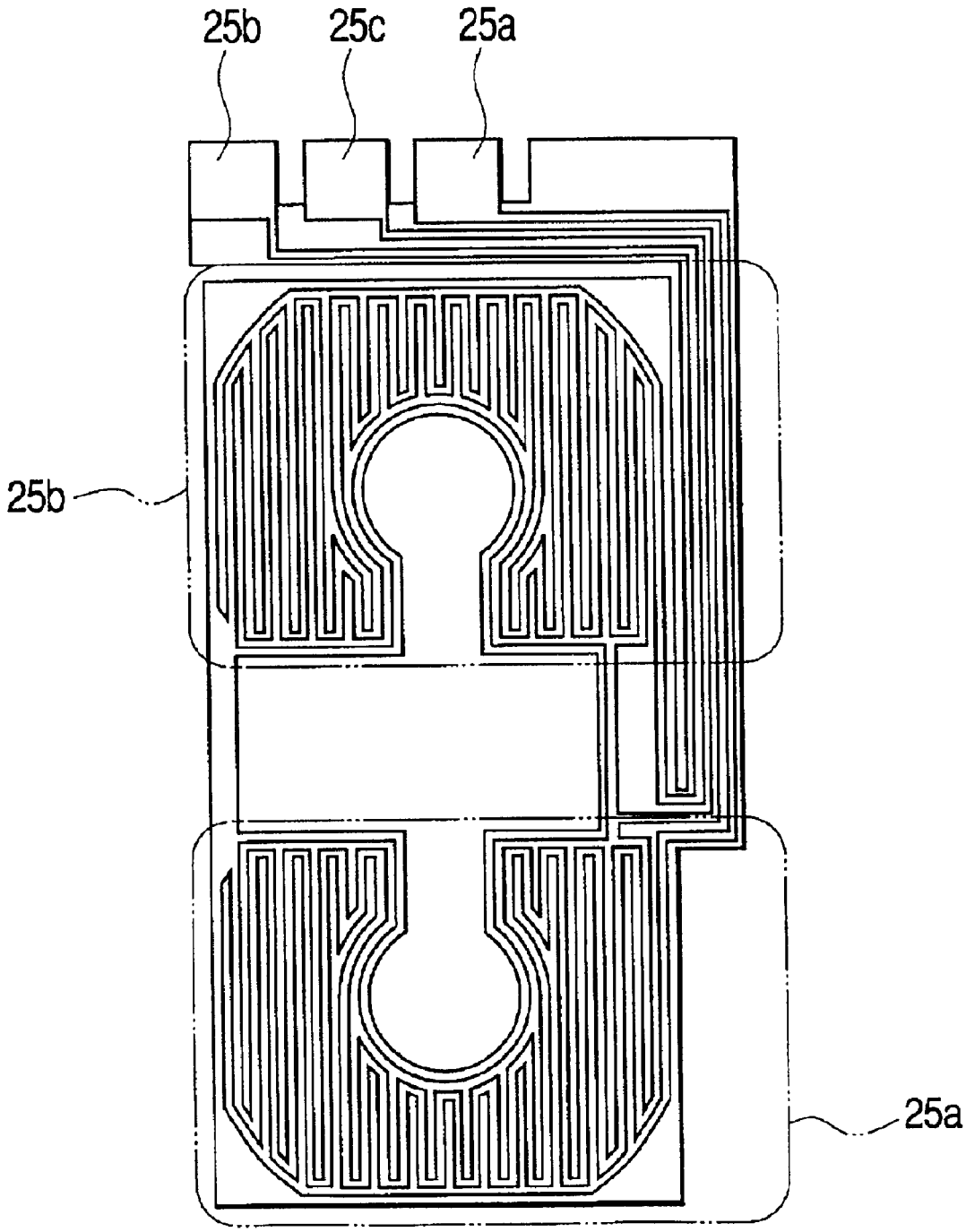
FIG. 25 is an exploded view of a first detection member used in examples of the present invention.

FIG. 23 shows the main body of an image-forming apparatus used in the Examples. FIG. 24 is a sectional view showing a process cartridge used in the Examples. FIG. 25 is an exploded view of a residual toner successive detection electrode member. Reference numeral 7 denotes a photosensitive drum; 9*a* denotes a developer(toner)-carrying member; 10*a* denotes a cleaning blade; and 8 denotes a charging member.

The developing unit is constituted of a toner, a toner container 11A, a developing sleeve 9*a* and a developing blade (doctor blade or D-blade) 9*d*. The developing sleeve 9*a* comprises an aluminum mandrel coated with a phenolic resin having carbon black dispersed therein. A magnet (not shown) is provided inside the developing sleeve so that a magnetic toner which contains magnetite is attracted to the surface of the developing sleeve 9*a*, and the toner is uniformly coated on the developing sleeve 9*a* by the aid of the doctor blade 9*d*.

Meanwhile, the toner container 11A has triple U-shaped, round bottoms. In the U-shaped zones, it has three agitation members 9*e*, 9*f* and 9*g* as shown in FIG. 24. Then, the respective agitation members form their agitation regions divided with partition plates.

As also shown in FIG. 24, a first detection member 25 and a second detection member 26 are provided which are to detect the residual toner successively. The first detection member 25 is used to detect the residual toner in a region where the toner is in a large quantity, and the second detection member 26 is used to detect the residual toner in a region where the toner is of a small quantity. Stated specifically, the first detection member 25 detects the residual toner in the region of from about 50% to about 10%, and the second detection member 26 detects the residual toner in the region between about 50% and about 10% and until the toner runs short. Both the first detection member 25 and the second detection member 26 measure the residual toner by electrostatic capacity. The toner used here is described below.

Using a toner before external addition, obtained according to the toner formulation and production process shown below, the following toners 1 to 4 were prepared to make studies on the following Examples and Comparative Example.

| Toner materials: | (by weight) |
|---|---|
| Binder resin | 100 parts |
| Magnetic iron oxide | 95 parts |
| Polypropylene wax | 4 parts |
| Charge control agent | 2 parts |

The above binder resin was a styrene-acrylic resin having:

a glass transition temperature Tg of 58° C. as measured by DSC, an acid value of 23.0 mg·KOH/g, and an Mn (number-average molecular weight) of 7,000 and Mw (weight-average molecular weight) of 400,000 as measured by GPC; and a monomer ratio of 72.5 parts of styrene, 20 parts of n-butyl acrylate, 7 parts of n-butyl maleate and 0.5 part of divinylbenzene;

the magnetic iron oxide had an average particle diameter of 0.20 $\mu$m, a BET specific surface area of 8.0 $m^2/g$, a coercive force of 3.7 kA/m, a saturation magnetization of 82.3 $Am^2/kg$ and a residual magnetization of 4.0 $Am^2/kg$;

the polypropylene wax had a melting point of 143° C. and a penetration at 25° C. of 0.5 mm; and the charge control agent used was an iron complex of an azo compound having a t-butyl group as a substituent.

These materials were each used in Example 1 and also used in the subsequent Examples and Comparative Example.

The above materials were melt-kneaded by means of a twin-screw extruder heated to 130° C. The kneaded product obtained and then cooled was crushed by means of a hammer mill, followed by pulverization using Turbo Mill (manufactured by Turbo Kogyo K.K.) to effect mechanical pulverization. The finely pulverized product thus obtained was strictly classified by means of a multi-division classifier utilizing the Coanda effect (Elbow Jet Classifier, manufactured by Nittetsu Kogyo K.K.) to remove ultrafine powder and coarse powder to obtain toner particles (toner before external addition). The toner particles had a BET specific surface area of 1.10 $m^2/g$ and a weight-average particle diameter of 6.9 $\mu$m.

| (Preparation of Toner 1) | |
|---|---|
| | (by weight) |
| Toner particles | 100 parts |
| Hydrophobic silica | 1.2 parts |
| Titanium oxide | 0.2 part |

The hydrophobic silica used was hydrophobic silica having been subjected to hydrophobic treatment with dimethylsilicone oil and hexamethyldisilazane and having a BET specific surface area of 100 $m^2/g$ and a methanol wettability of 68%. The titanium oxide used was titanium oxide having been subjected to hydrophobic treatment with isobutyltrimethoxysilane and having a BET specific surface area of 80 $m^2/g$ and a methanol wettability of 60%. In the following Examples and Comparative Example, the same ones as the above were used as hydrophobic silica and titanium oxide.

Figure 26:
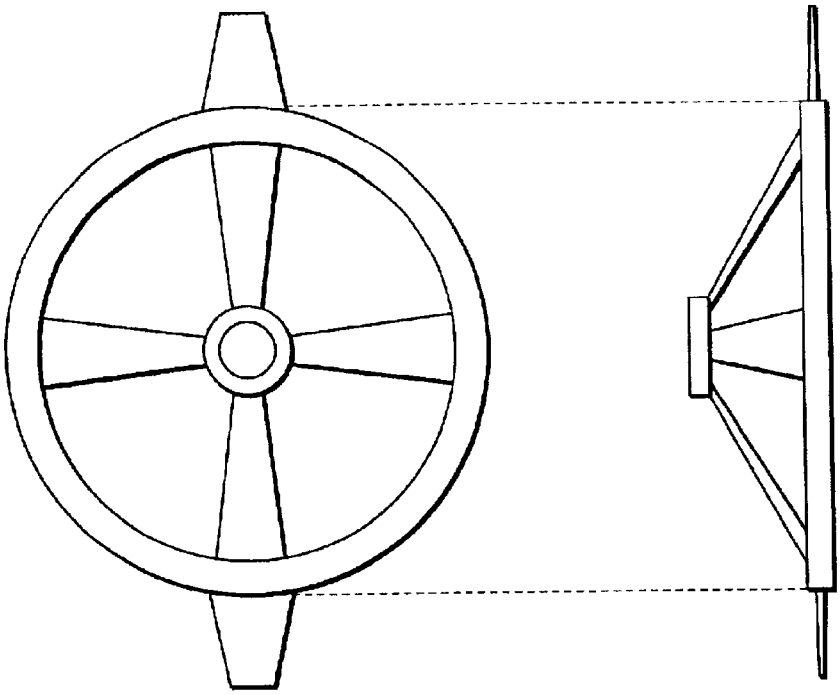
FIG. 26 is a diagrammatic view of an agitation blade Y1 used in the present invention.
Figure 27:
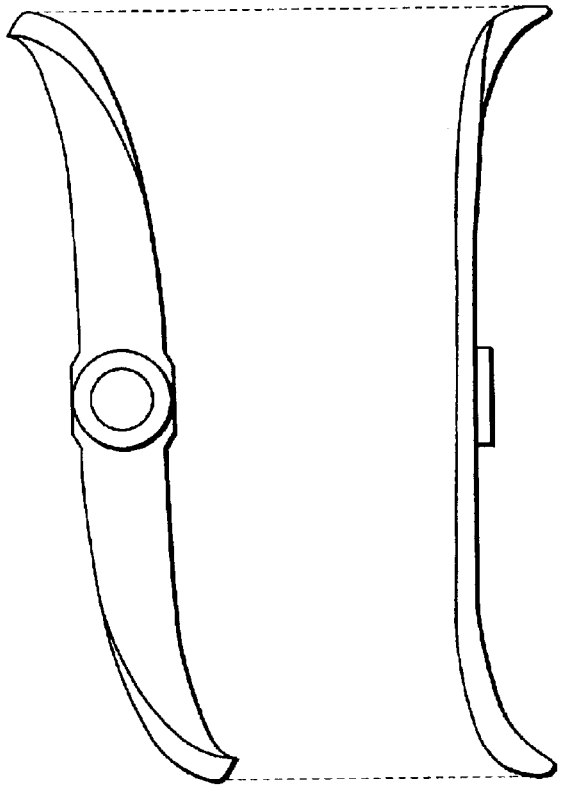
FIG. 27 is a diagrammatic view of an agitation blade S0 used in the present invention.

The above materials were put into Henschel Mixer FM10C/1 (manufactured by Mitsui Mining and Smelting Co., Ltd.) to effect treatment for external addition at a number of revolutions of 45.00 $s^{-1}$ for 1 minute and thereafter continuously at 50.00 $s^{-1}$ for 2 minutes, filling the toner particles into the mixer in an apparent volume filling fraction of 12% and selecting Y1 (FIG. 26) and S0 (FIG. 27) as agitation blades. Thus, toner 1 was obtained.

The ratio of BET specific surface area of the toner 1 thus obtained to that of the toner before external addition was 2.1. The Carr's floodability index and Carr's fluidity index of the toner 1 as measured by the method described in the present specification were 92.0 and 84.0, respectively.

As to the parameters for determining these, the angle of repose was 25.0° (index: 25), the spatula angle was 26° (index: 24), the degree of compression was 15.0% (index: 20), the degree of agglomeration was 3.0% (index: 15), the angle of rupture was 7° (index: 25), the difference angle was 18.0° (index: 17) and the dispersibility was 70.2% (index: 25).

The conditions for external addition and the results of measurement of powder characteristics of the toner 1 are shown in Table 1.

(Preparation of Toner 2)

The same external additives as those for the toner 1 were used, and were put into Henschel Mixer FM10C/1 to effect treatment for external addition at a number of revolutions of 53.33 $s^{-1}$ for 1 minute and thereafter at 70.00 $s^{-1}$ for 1 minute, selecting Y1 and S0 as agitation blades and filling the toner particles into the mixer in an apparent volume filling fraction of 12%. Thus, toner 2 was obtained.

The ratio of BET specific surface area of the toner 2 thus obtained to that of the toner before external addition was 2.0. The Carr's floodability index and Carr's fluidity index of the toner 2 as measured by the method described in the present specification were 86.0 and 77.0, respectively. As to the parameters for determining these, the angle of repose was 31.0° (index: 22), the spatula angle was 31.0° (index: 22.5), the degree of compression was 20.0% (index: 17.5), the degree of agglomeration was 3.7% (index: 15), the angle of rupture was 19.0° (index: 24), the difference angle was 12.0° (index: 12) and the dispersibility was 55.0% (index: 25).

The conditions for external addition and the results of measurement of powder characteristics of the toner 2 are shown in Table 1.

(Preparation of Toner 3)

The same external additives as those for the toner 1 were used, and were put into Henschel Mixer FM10C/1 to effect treatment for external addition at a number of revolutions of 50.00 $s^{-1}$ for 2 minutes and thereafter, after a pose, at 66.67 $s^{-1}$ for 1 minute, selecting Y1 and S0 as agitation blades and filling the toner particles into the mixer in an apparent volume filling fraction of 11%. Thus, toner 3 was obtained.

The ratio of BET specific surface area of the toner 3 thus obtained to that of the toner before external addition was 2.0. The Carr's floodability index and Carr's fluidity index of the toner 3 as measured by the method described in the present specification were 86 and 66, respectively. As to the parameters for determining these, the angle of repose was 36.0° (index: 19.5), the spatula angle was 27.0° (index: 12), the degree of compression was 27.0% (index: 12), the degree of agglomeration was 6.2% (index: 14.5), the angle of rupture was 22.0° (index: 21), the difference angle was 14.0° (index: 14.5) and the dispersibility was 42.0% (index: 22).

The conditions for external addition and the results of measurement of powder characteristics of the toner 3 are shown in Table 1.

| (Preparation of Toner 4) | |
|---|---|
| | (by weight) |
| Toner particles | 100 parts |
| Hydrophobic silica | 1.0 parts |
| Titanium oxide | 0.1 part |

Figure 28:
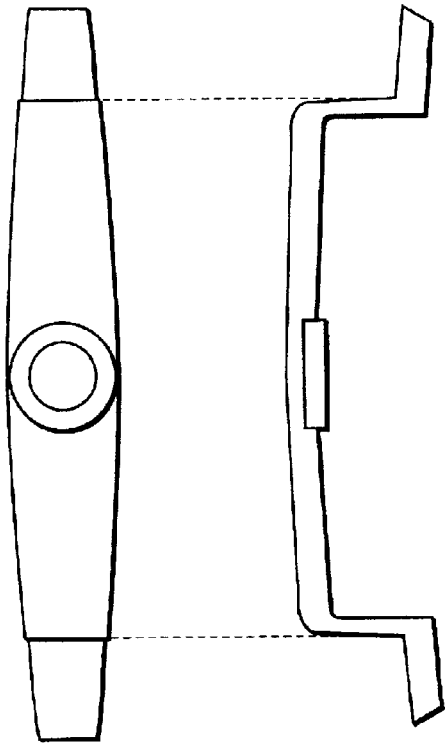
FIG. 28 is a diagrammatic view of an agitation blade Z0 used in the present invention.
Figure 29:
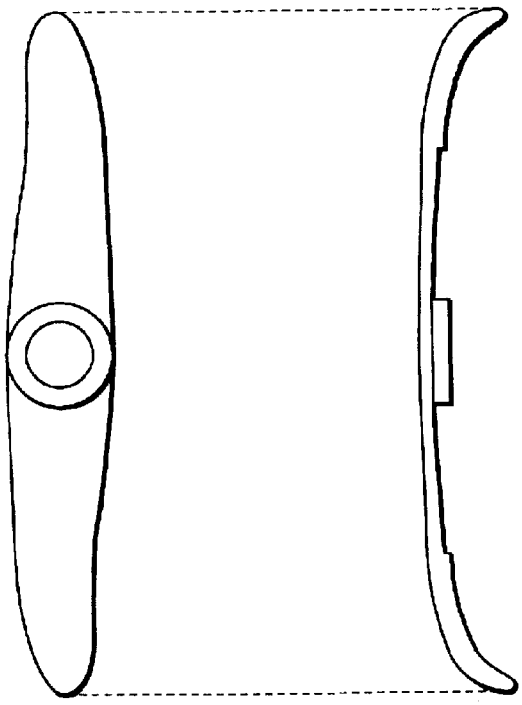
FIG. 29 is a diagrammatic view of an agitation blade A0 used in the present invention.

The above materials were put into Henschel Mixer FM10C/1 to effect treatment for external addition at a number of revolutions of 70.00 $s^{-1}$ for 5, selecting Z0 (FIG. 28) and A0 (FIG. 29) as agitation blades and filling the toner particles into the mixer in an apparent volume filling fraction of 10%. Thus, toner 4 was obtained.

The ratio of BET specific surface area of the toner 4 thus obtained to that of the toner before external addition was 1.6. The Carr's floodability index and Carr's fluidity index of the toner 44 as measured by the method described in the present specification were 73.0 and 64.5, respectively. As to the parameters for determining these, the angle of repose was 39.0° (index: 19.5), the spatula angle was 30.00 (index: 12), the degree of compression was 35.0% (index: 21), the degree of agglomeration was 12.0% (index: 12), the angle of rupture was 29.0° (index: 18.0), the difference angle was 10.0° (index: 10) and the dispersibility was 35.0% (index: 20).

The conditions for external addition and the results of measurement of powder characteristics of the toner 4 are shown in Table 1.

Example 1

In Example 1, the toner 1 was used in the process cartridge of the present invention. Evaluation was made setting the toner-carrying member (developing sleeve) to have an Ra of 1.3 $\mu$m, its peripheral speed ratio to the photosensitive member to be 1.00, the toner laid-on quantity of the developing sleeve to be 2.06 $mg/cm^2$ and the volume of the toner-holding section of the process cartridge to be constant at 2,000 $cm^3$, and changing as shown below the relationship between volume X of the toner-holding section, toner fill Ct and toner density Dt.

Cartridge Setting Conditions:

(a) The toner 1 was so filled that Ct/(X*Dt) which indicates the filling fraction of toner came to 0.7 to make evaluation. (Ct: 1,205 g; Dt: 0.86 $g/cm^3$)

(b) The toner 1 was so filled that Ct/(X*Dt) which indicates the filling fraction of toner came to 0.65 to make evaluation. (Ct: 1,118 g; Dt: 0.86 g/cm$^3$)

(c) The toner 1 was so filled that Ct/(X*Dt) which indicates the filling fraction of toner came to 0.5 to make evaluation. (Ct: 860 g; Dt: 0.86 g/cm$^3$)

A table of combination of cartridge setting conditions with toner is shown in Table 2.

Next, this magnetic toner prepared and the process cartridge were evaluated by the following five methods.

Image Evaluation Test

The magnetic toner was filled into the process cartridge. Images were reproduced using a remodeled machine of a laser beam printer LBP-950 (manufactured by CANON INC.; 32 sheets/minute in A4 lateral feed), so remodeled that the process cartridge was mountable. Here, the process speed was 144.5 mm/second.

Images obtained were evaluated on the following items.

(1) Image Density:

Image reproduction was tested (image formation test) under the above setting conditions and in an environment of low temperature and low humidity (15° C., 10% RH) and an environment of high temperature and high humidity (32.5° C., 85% RH). Images were printed on 20,000 sheets of plain paper (75 g/m$^2$) for usual copying machines. The image density on the first sheet when the printing was started and the image density after running of 20,000 sheets were measured. Here, the image density was measured with Macbeth Reflection Densitometer (manufactured by Macbeth Co.).

(2) Fog:

Images were printed on 20,000 sheets of plain paper (75 g/m$^2$) for usual copying machines in an environment of low temperature and low humidity (15° C., 10% RH) and an environment of high temperature and high humidity (32.5° C., 85% RH), and the evaluation on fog was made upon finish of this printing. The fog was calculated from comparison between the whiteness of transfer paper as measured with Reflectometer (manufactured by Tokyo Denshoku K.K.) and the whiteness of transfer paper as measured therewith after a solid white image was printed. It means that, the greater this value is, the more greatly the fog occurs.

Figure 30:
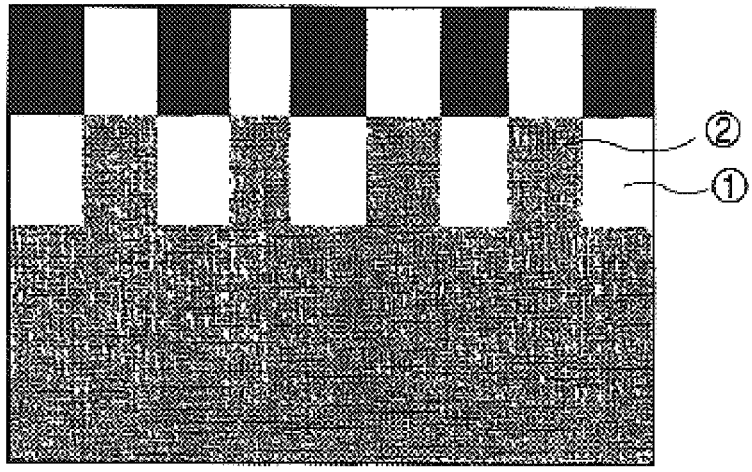
FIG. 30 shows a negative-ghost evaluation pattern.
Figure 31:
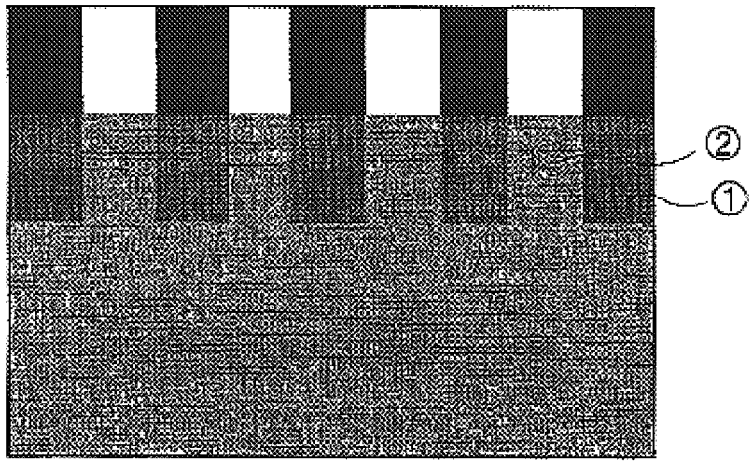
FIG. 31 shows a positive-ghost evaluation pattern.

(3) Sleeve Ghost:

Images were printed on 20,000 sheets of plain paper (75 g/m$^2$) for usual copying machines in an environment of low temperature and low humidity (15° C., 10% RH) and an environment of high temperature and high humidity (32.5° C., 85% RH), and the evaluation on ghost was made at intervals of 5,000 sheets. To make image evaluation concerning the ghost, solid-black belt images were printed by one round of the sleeve and thereafter halftone images were printed. Their image patterns are shown in FIGS. 30 and 31. The evaluation was made in the following way: In the case of, e.g., sleeve negative ghost which is often seen in the low-temperature low-humidity environment, in one sheet of image-printed paper, a difference in reflection density measured with the Macbeth Reflection Densitometer between the part where the black images were formed (black print areas) and the part no images were formed (non-image areas) both on the first round was calculated on the sleeve second round in the manner shown below. The negative ghost is a ghost phenomenon in which the density coming on the sleeve second round is commonly lower than the density at the part where the first-round image areas are non-image areas, and the shape of the pattern reproduced on the first round comes out as it is. This difference in density was utilized to make evaluation by the difference in reflection density. As for positive ghost which is seen in the high-temperature high-humidity environment, it is a ghost phenomenon in which the density coming on the sleeve second round is commonly higher than the density at the part where the first-round image areas are non-image areas, and the shape of the pattern reproduced on the first round comes out as it is.

Difference in reflection density=reflection density (image-formed areas)−reflection density (none-image-formed areas)

On the basis of its average value, evaluation was made to obtain the results shown in Table 3. The smaller the difference in reflection density is, the less the ghost has occurred and the higher the image level is. As overall evaluation on the ghost, the evaluation was made according to the following three ranks A, B and C.

(Difference in Reflection Density)

A: 0.00 to less than 0.05.

B: 0.05 to less than 0.08.

C: 0.08 or more.

Stated specifically with reference to FIG. 30, densities of the image areas corresponding to the sleeve second round at the area denoted by 1 in circle, which had been a solid black area on the sleeve first round at the upper part of the drawing and at the area denoted by 2 in circle, which had been a solid white area on the first round, were measured with Macbeth Densitometer, and the positive ghost was calculated as (density at 2 in circle)−(density at 1 in circle)=negative-ghost level.

Stated specifically with reference to FIG. 31, densities of the image areas corresponding to the sleeve second round at the area denoted by 1 in circle, which had been a solid black area on the sleeve first round at the upper part of the drawing and at the area denoted by 2 in circle, which had been a solid white area on the first round, were measured with Macbeth Densitometer, and the positive ghost was calculated as (density at 1 in circle)−(density at 2 in circle)=positive-ghost level.

(4) Evaluation on Fading:

In the case when a toner to be used is filled into the process cartridge provided therein with the electrodes for toner-residual detection, the movement of the toner may be obstructed because of the presence of the electrodes to tend to cause the gathering of powder on one side. Especially where the toner has a low floodability, the toner not only may be transported onto the toner-carrying member in poor performance when agitated with the agitation member, but also the gathering of toner powder on one side may be corrected with difficulty and hence the toner may be transported onto the toner-carrying member while keeping its gathering on one side. As the result, the toner may become present on the toner-carrying member in a non-uniform quantity to cause "fading" (uneven density which is especially low only at some part) when, e.g., solid black images are printed.

As evaluation for the invention made this time, evaluation was made on whether or not the fading occurred when solid black images were printed on each 1,000th sheet in the the high-temperature high-humidity environment, in which especially the floodability tends to lower (see FIG. 31).

Figure 32:
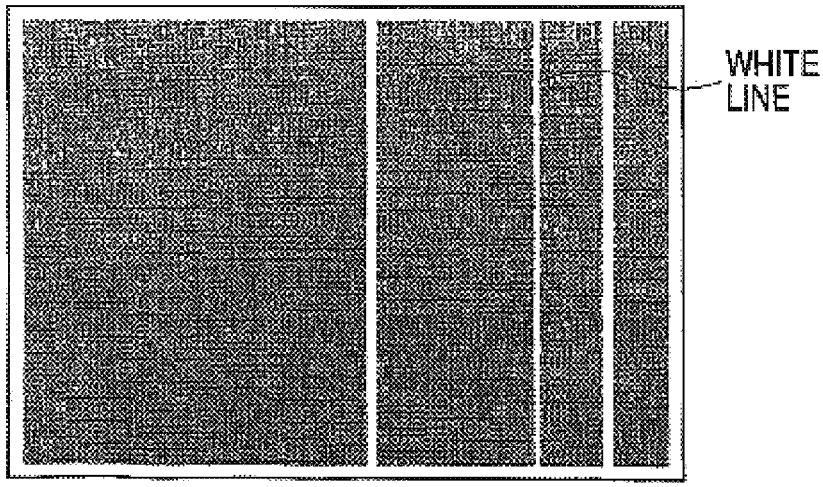
FIG. 32 shows a liberated-external-additive adhesion evaluation pattern.

(5) Evaluation on White-line Blank Areas Caused by Melt Adhesion to Sleeve:

Where a toner having a low floodability is used, a high powder pressure is applied to the toner-carrying member when the toner is transported to the toner-carrying member by the agitation member. This tends to cause the toner to melt-adhere to the toner-carrying member when the in-machine temperature is raised, so that image defects in white lines may occur in the direction of the paper feed (see FIG. 32).

As evaluation for the invention made at this time, evaluation was made on whether or not the white lines due to melt adhesion to the sleeve occurred when solid black images were printed at intervals of 5,000 sheets from the start of printing up to running on 20,000 sheets in total.

Evaluation was made on the above five items.

Evaluation was made with respect of the above conditions (a), (b) and (c), in which the volume of the toner-holding section and the filling fraction were changed. As the result, superior developing performance was achievable in both the low-temperature low-humidity environment and the high-temperature high-humidity environment. Also, the fog was as good as 1.8% in (a), 1.9% in (b) and 2.0% in (c) in the low-temperature low-humidity environment and 1.3% in (a), 1.6% in (b) and 1.7% in (c) in the high-temperature high-humidity environment. Any phenomena such as sleeve ghost, fading and white lines due to melt adhesion were also not seen.

The results of evaluation are shown in Table 3.

In the residual toner detection system, the residual toner detection in the high-temperature high-humidity environment was also evaluated. Any error in the residual toner detection was calculated from a difference between the value of measurement of residual toner and the quantity of the toner actually held in the cartridge; the measurement being made on the toner fill when the residual toner was indicated as 25%, 15% or 5%.

(a) Measurement error was 6.3% at the time of 25% detection, 3.2% at the time of 15% detection and 1.1% at the time of 5% detection.

(b) Measurement error was 5.8% at the time of 25% detection, 2.9% at the time of 15% detection and 1.3% at the time of 5% detection.

(c) Measurement error was 5.5% at the time of 25% detection, 2.8% at the time of 15% detection and 1.2% at the time of 5% detection.

The results of evaluation of residual toner detection are shown in Table 4.

Example 2

In Example 2, the toner 2 was used in the process cartridge of the present invention. Evaluation was made changing as shown below the setting of the cartridge when the volume of the toner-holding section of the process cartridge was 2,000 $cm^3$ and the Ct/(X*Dt) which indicates the filling fraction of toner was 0.65 (Ct: 1,092 g; Dt: 0.84 $g/cm^3$).

(a) Evaluation was made using a developing sleeve set to have an Ra of 1.1 $\mu$m, its peripheral speed ratio to the photosensitive member to be 1.10 and the toner laid-on quantity of the sleeve to be 1.56 $mg/cm^2$. As the result, superior developing performance was achievable in both the low-temperature low-humidity environment and the high-temperature high-humidity environment. Also, the fog was as low as 2.0% in the low-temperature low-humidity environment and 1.8% in the high-temperature high-humidity environment. Any phenomena such as sleeve ghost, fading and image white lines were also not seen.

(b) Evaluation was made using a developing sleeve set to have an Ra of 1.46 $\mu$m, its peripheral speed ratio to the photosensitive member to be 1.12 and the toner laid-on quantity of the sleeve to be 2.27 $mg/cm^2$. As the result, superior developing performance was achievable in both the low-temperature low-humidity environment and the high-temperature high-humidity environment. Also, the fog was as low as 1.8%. Any phenomena such as sleeve ghost, fading and white lines due to melt adhesion were also not seen.

In the toner-residual detection made in the same manner as in Example 1, the results were as follows:

(a) Measurement error was 7.1% at the time of 25% detection, 3.6% at the time of 15% detection and 1.5% at the time of 5% detection.

(b) Measurement error was 6.9% at the time of 25% detection, 3.8% at the time of 15% detection and 1.6% at the time of 5% detection.

Example 3

In Example 3, the toner 3 was used in the process cartridge of the present invention. Evaluation was made changing as shown below the setting of the cartridge when the volume of the toner-holding section of the process cartridge was 2,000 $cm^3$ and the Ct/(X*Dt) which indicates the filling fraction of toner was 0.70 (Ct: 1,148 g; Dt: 0.83 $g/cm^3$).

Evaluation was made using a developing sleeve set to have an Ra of 1.3 $\mu$m, its peripheral speed ratio to the photosensitive member to be 1.00 and the toner laid-on quantity of the sleeve to be 2.01 $mg/cm^2$. As the result, superior developing performance was achievable in both the low-temperature low-humidity environment and the high-temperature high-humidity environment. Also, the fog was as low as 2.1% in the low-temperature low-humidity environment and 1.7% in the high-temperature high-humidity environment. Any phenomena such as sleeve ghost, fading and white lines due to melt adhesion were also not seen.

In the toner-residual detection made in the same manner as in Example 1, the measurement error was 8.5% at the time of 25% detection, 4.6% at the time of 15% detection and 2.3% at the time of 5% detection.

Comparative Example 1

In Comparative Example 1, the toner 4 was used. Like Examples, the process cartridge was set in the printer main body as shown in FIGS. 23 and 24.

Evaluation was made setting the volume of the toner-holding section to be 2,000 $cm^3$ and so filling the toner thereinto that the Ct/(X*Dt) which indicates the filling fraction of toner came to be 0.65 (Ct: 1,040 g; Dt: 0.80 $g/cm^3$).

Evaluation was made using a developing sleeve set to have an Ra of 1.3 $\mu$m, its peripheral speed ratio to the photosensitive member to be 1.00 and the toner laid-on quantity of the sleeve to be 2.12 $mg/cm^2$. As the result, there was no problem on the developing performance in the low-temperature low-humidity environment. However, the fog was at levels as poor as 5.0% in the low-temperature low-humidity environment and 4.7% in the high-temperature high-humidity environment. The level of positive ghost was also poor. Although the image density itself was not seen to decrease in the high-temperature high-humidity environment, the fading was frequently seen. At the time the running was continued beyond 16,000 sheets, white-line blank areas due to the melt adhesion to sleeve began occurring, and, at the time of the finish of running, the white lines had occurred over approximately the half of images.

In the toner-residual detection made in the same manner as in Example 1, the measurement error was 12.5% at the time of 25% detection, 8.5% at the time of 15% detection and 5.5% at the time of 5% detection, showing a result that the measurement error was greater than the cases in which the toner having floodability of more than 80 was used.

As described above, in the case when the toner having the floodability index according to the present invention is used in the process cartridge which detects the toner residual successively, good images can be provided and also the toner residual can be detected within a small measurement error in any environment.

TABLE 1

Toner External-Addition Conditions & Toner Physical Properties

| | Toner 1 | Toner 2 | Toner 3 | Toner 4 |
|---|---|---|---|---|
| External additives: | (1) Hydrophobic silica and (2) titanium oxide | | | |
| Amount of external additives: (1)/(2) (pbw) | 1.2/0.2 | 1.2/0.2 | 1.0/0.3 | 0.9/0.6 |
| Toner filling fraction: (vol. %) | 12.00 | 12.00 | 11.00 | 10.00 |
| Agitation blades: (upper/lower) | Y1/SO | Y1/SO | Y1/SO | ZO/AO |
| External-addition Mode: | $45.00s^{-1} \times 1$ min<br>$50.00s^{-1} \times 2$ min | $53.33s^{-1} \times 1$ min<br>$70.00s^{-1} \times 1$ min | $50.00s^{-1} \times 2$ min<br>after a pause<br>$66.67s^{-1} \times 1$ min | $70.00s^{-1} \times 5$ min |
| BET specific surface area ratio of toner after external addition/toner before external addition | 2.1 | 2.0 | 2.0 | 1.6 |
| Angle of repose: (°) (index) | 25 (25) | 31 (22) | 36 (19.5) | 39 (19.5) |
| Degree of compression: (%) (index) | 15 (20) | 20 (17.5) | 27 (12) | 30 (12) |
| Spatula angle: (°) (index) | 26 (24) | 31 (22.5) | 32 (22) | 35 (21) |
| Degree of agglomeration: (%) (index) | 3 (15) | 3.7 (15) | 6.2 (14.5) | 12 (12) |
| Fluidity index: | 84.0 | 77.0 | 68.0 | 64.5 |
| Fluidity index calculated index: | 25.0 | 25 | 25.0 | 25.0 |
| Angle of rupture: (°) (index) | 7 (25) | 19 (24) | 22 (21) | 29 (18) |
| Difference angle: (°) (index) | 18 (17) | 12.0 (12) | 14 (14.5) | 10 (10) |
| Dispersibility: (°) (index) | 70.2 (25) | 55.0 (25) | 42 (22) | 35 (20) |
| Floodability index: | 92.0 | 86.0 | 82.5 | 73.0 |

TABLE 2

Table of Combination of Cartridge Setting Conditions With Toner

| | Example 1 | | | Example 2 | | | Comparative |
|---|---|---|---|---|---|---|---|
| | (a) | (b) | (c) | (a) | (b) | Example 3 | Example 1 |
| Toner used: | 1 | 1 | 1 | 2 | 2 | 3 | 4 |
| Volume setting: | | | | | | | |
| Ct/(X * Dt) filling fraction: | 0.7 | 0.65 | 0.5 | 0.65 | 0.65 | 0.7 | 0.65 |
| Ct: (g) | 1,205 | 1,118 | 860 | 1,092 | 1,092 | 1,148 | 1,040 |
| Dt: ($g/cm^3$) | 0.86 | 0.86 | 0.86 | 0.84 | 0.84 | 0.83 | 0.80 |
| Sleeve setting: | | | | | | | |
| Ra: ($\mu$m) | 1.3 | 1.3 | 1.3 | 1.1 | 1.46 | 1.3 | 1.3 |
| Peripheral ratio to photosensitive member: (mm) | 1 | 1 | 1 | 1.02 | 1.04 | 1 | 1 |
| Toner laid-on quantity: ($mg/cm^2$) | 2.06 | 2.06 | 2.06 | 1.56 | 2.27 | 2.00 | 2.12 |

Volume of toner-holding section of cartridge: X = 2,000 $cm^3$

TABLE 3

Evaluation Results

| | Low-temp. low-humidity environment | | | High-temp. high-humidity environment | | | | |
|---|---|---|---|---|---|---|---|---|
| | Image density (A)/(B) (%) | Fog (%) | Sleeve ghost | Image density (A)/(B) (%) | Fog (%) | Sleeve ghost | Fading | White lines* |
| Example 1 | | | | | | | | |
| (a) | 1.50/1.49 | 1.8 | A | 1.48/1.47 | 1.3 | A | A | A |
| (b) | 1.51/1.50 | 1.9 | A | 1.49/1.46 | 1.6 | A | A | A |
| (c) | 1.48/1.49 | 2.0 | A | 1.47/1.47 | 1.7 | A | A | A |
| Example 2 | | | | | | | | |
| (a) | 1.51/1.51 | 2.2 | A | 1.50/1.49 | 1.8 | A | A | A |
| (b) | 1.47/1.49 | 1.8 | A | 1.46/1.46 | 1.5 | A | A | A |
| Example 3 | 1.47/1.46 | 2.1 | A | 1.46/1.45 | 1.7 | A | A | A |
| Comparative Example 1 | 1.48/1.46 | 5.0 | C | 1.46/1.44 | 4.7 | C | C | C |

(A)/(B): At the time of start/after running on 30,000 sheets
*due to melt adhesion to sleeve

TABLE 4

Successive Toner-Residual Detection Measurement Results

| | | Detection at toner-residual 25% | | | Detection at toner-residual 15% | | | Detection at toner-residual 5% | | |
|---|---|---|---|---|---|---|---|---|---|---|
| | Toner fill (g) | Toner weight calculated | Toner = residual found (g) | Measurement error (%) | Toner weight calculated | Toner = residual found (g) | Measurement error (%) | Toner weight calculated | Toner = residual found (g) | Measurement error (%) |
| Example 1 | | | | | | | | | | |
| (a) | 1,205.0 | 301.3 | 282.3 | 6.3 | 180.8 | 175.0 | 3.2 | 60.3 | 59.6 | 1.1 |
| (b) | 1,118.0 | 279.5 | 263.3 | 5.8 | 167.7 | 162.8 | 2.9 | 55.9 | 55.2 | 1.3 |
| (c) | 860.0 | 215.0 | 203.2 | 5.5 | 129.0 | 125.4 | 2.8 | 43.0 | 42.5 | 1.2 |
| Example 2 | | | | | | | | | | |
| (a) | 1,092.0 | 273.0 | 253.6 | 7.1 | 163.8 | 157.9 | 3.6 | 54.6 | 53.8 | 1.5 |
| (b) | 1,092.0 | 273.0 | 254.2 | 6.9 | 163.8 | 157.6 | 3.8 | 54.6 | 53.7 | 1.6 |
| Example 3 | 1,148.0 | 287.0 | 262.6 | 8.5 | 172.2 | 164.3 | 4.5 | 57.4 | 56.1 | 2.3 |
| Comparative Example 1 | 1,040.0 | 260.0 | 227.5 | 12.5 | 156.0 | 142.7 | 8.5 | 52.0 | 49.1 | 5.5 |

Toner weight calculated − toner-residual found|/toner weight calculated × 100 = measurement error

TABLE 5

Fluidity Index of Powder

| Fluidity index | Cross-linking prevention counter-measure | Angle of repose | | Degree of compression | | Spatura angle | | Uniformity* | | Degree of agglomeration** | |
|---|---|---|---|---|---|---|---|---|---|---|---|
| | | Deg. | Index | Deg. | Index | Deg. | Index | Deg. | Index | Deg. | Index |
| Extent of fluidity | | | | | | | | | | | |
| Excellent: 90~100 | Unnecessary. | <25 | 25 | <5 | 25 | <25 | 25 | 1 | 25 | | |
| | | 26~29 | 24 | 6~9 | 23 | 26~30 | 24 | 2~4 | 23 | | |
| | | 30 | 22.5 | 10 | 22.5 | 31 | 22.5 | 5 | 22.5 | | |
| Good: 80~89 | Unnecessary. | 31 | 22 | 11 | 22 | 32 | 22 | 6 | 22 | | |
| | | 32~34 | 21 | 12~14 | 21 | 33~37 | 21 | 7 | 21 | | |
| | | 35 | 20 | 15 | 20 | 38 | 20 | 8 | 20 | | |
| Fairly good: 70~79 | Vibrator may be necessary. | 36 | 19.5 | 16 | 19.5 | 39 | 19.5 | 9 | 19 | | |
| | | 37~39 | 18 | 17~19 | 18 | 40~44 | 18 | 10~11 | 18 | | |
| | | 40 | 17.5 | 20 | 17.5 | 45 | 17.5 | 12 | 17.5 | | |
| Average: | With | 41 | 17 | 21 | 17 | 46 | 17 | 13 | 17 | | |

TABLE 5-continued

| Fluidity index | Cross-linking prevention counter-measure | Fluidity Index of Powder: Angle of repose Deg. | Angle of repose Index | Degree of compression Deg. | Degree of compression Index | Spatura angle Deg. | Spatura angle Index | Uniformity* Deg. | Uniformity* Index | Degree of agglomeration** Deg. | Degree of agglomeration** Index |
|---|---|---|---|---|---|---|---|---|---|---|---|
| 60~69 | critical point & cross-linking point. | 42~44<br>45 | 16<br>15 | 22~24<br>25 | 16<br>15 | 47~59<br>60 | 16<br>15 | 14~16<br>17 | 16<br>15 | <6 | 15 |
| Not so good: 40~59 | Necessary. | 46<br>47~54<br>55 | 14.5<br>12<br>10 | 26<br>27~30<br>31 | 14.5<br>12<br>10 | 61<br>62~74<br>75 | 14.5<br>12<br>10 | 18<br>19–21<br>22 | 14.5<br>12<br>10 | 6~9<br>10~29<br>30 | 14.5<br>12<br>10 |
| Poor: 20~39 | Strong counter-measure is necessary. | 56<br>57~64<br>65 | 9.5<br>7<br>5 | 32<br>33~36<br>37 | 9.5<br>7<br>5 | 76<br>77~89<br>90 | 9.5<br>7<br>5 | 23<br>24~26<br>27 | 9.5<br>7<br>5 | 31<br>32~54<br>55 | 9.5<br>7<br>5 |
| Very poor: 0~19 | Special measures & technique are necessary. | 66<br>67~89<br>90 | 4.5<br>2<br>0 | 38<br>39~45<br>>45 | 4.5<br>2<br>0 | 91<br>92~99<br>>99 | 4.5<br>2<br>0 | 28<br>29~35<br>>35 | 4.5<br>2<br>0 | 56<br>57~79<br>>79 | 4.5<br>2<br>0 |

*This value is used when the matter is powdery or particulate and its uniformity can be measured.
**This value is used when the matter is strongly agglomerative fine powder and its degree of agglomeration can be measured.

TABLE 6

| Floodability index | Flooding prevention countermeasure | Floodability Index of Powder: Fluidity Deg. | Fluidity Index | Angle of rapture Deg. | Angle of rapture Index | Difference angle Deg. | Difference angle Index | Dispersibility Deg. | Dispersibility Index |
|---|---|---|---|---|---|---|---|---|---|
| Extent of floodability | | | | | | | | | |
| Very strong: 80~100 | Rotary seal is necessary. | >60<br>59~56<br>55<br>54<br>53~50<br>49 | 25<br>24<br>22.5<br>22<br>21<br>20 | <10<br>11~19<br>20<br>21<br>22~24<br>25 | 25<br>24<br>22.5<br>22<br>21<br>20 | >30<br>29~28<br>27<br>26<br>25<br>24 | 25<br>24<br>22.5<br>22<br>21<br>20 | >50<br>49~44<br>43<br>42<br>41–36<br>35 | 25<br>24<br>22.5<br>22<br>21<br>20 |
| Fairly strong: 60~79 | Rotary seal is necessary. | 48<br>47~45<br>44<br>43<br>42~40<br>39 | 19.9<br>18<br>17.5<br>17<br>16<br>15 | 26<br>27~29<br>30<br>31<br>32~39<br>40 | 19.5<br>18<br>17.5<br>17<br>16<br>15 | 23<br>22~20<br>19<br>18<br>17~16<br>15 | 19.5<br>18<br>17.5<br>17<br>16<br>15 | 34<br>33~29<br>28<br>27<br>26~21<br>20 | 19.5<br>18<br>17.5<br>17<br>16<br>15 |
| Tending to flood: 40~59 | Rotary seal may be necessary. | 38<br>37~34<br>33 | 14.5<br>12<br>10 | 41<br>42~49<br>50 | 14.5<br>12<br>10 | 14<br>13~11<br>10 | 14.5<br>12<br>10 | 19<br>18~11<br>10 | 14.5<br>12<br>10 |
| Possible to flood: 25~39 | Rotary seal is necessary depending on flow speed or fill condition. | 32<br>31~29<br>28 | 9.5<br>8<br>6.25 | 51<br>52~56<br>57 | 9.5<br>8<br>6.25 | 9.5<br>8<br>7 | 9.5<br>8<br>6.25 | 9<br>8<br>7 | 9.5<br>8<br>6.25 |
| None: 0~24 | Unnecessary. | 27<br>26~23<br><23 | 6<br>3<br>0 | 58<br>59~64<br>>65 | 6<br>3<br>0 | 6<br>5~1<br>0 | 6<br>3<br>0 | 6<br>5~1<br>0 | 6<br>3<br>0 |

With regard to Tables 5 and 6, see Chemical Engineering, Jan. 18, 1965, pp.166–167.

What is claimed is:

1. A process cartridge used in an image-forming apparatus which forms an image on a recording medium, wherein said process cartridge is detachably mountable to a main body of said image-forming apparatus, said process cartridge comprising:

a photosensitive member;

magnetic toner comprising magnetic toner particles having magnetic material incorporated thereinto;

a magnetic toner-holding section configured to hold therein the magnetic toner for developing electrostatic latent images formed on said photosensitive member and provided with a magnetic toner-carrying member configured and positioned to transport the magnetic toner to a developing zone; and a residual magnetic toner detection means for detecting residual magnetic toner by a change in electrostatic capacity which is caused between electrodes provided inside said magnetic toner-holding section;

said magnetic toner containing at least a binder resin and the magnetic material, having a weight-average particle diameter of from 6.5 $\mu$m to 15.0 $\mu$m, and having a Carr's floodability index of more than 80.

2. The process cartridge according to claim 1, wherein said residual magnetic toner detection means detects a change in electrostatic capacity which is caused between two upper and lower electrodes provided inside said magnetic toner-holding section, facing said magnetic toner-carrying member and leaving a space between the electrodes.

3. The process cartridge according to claim 2, wherein any one of said two electrodes is a magnetic toner-carrying member or a developing blade sheet metal.

4. The process cartridge according to claim 1, wherein said residual magnetic toner detection means detects a change in electrostatic capacity at an electrostatic-capacity generation zone provided at a position where the contact area varies in accordance with a change in quantity of the magnetic toner held in said magnetic toner-holding section.

5. The process cartridge according to claim 1, wherein said photosensitive member comprises a photosensitive drum having a photosensitive drum surface, wherein said magnetic toner-carrying member has a magnetic toner-carrying member surface, wherein said magnetic toner-carrying member has an average surface roughness (Ra) ranging from 0.5 $\mu$m to 2.5 $\mu$m, and, as the movement speed of the magnetic toner-carrying member surface in the developing zone is at a speed 0.95 to 1.20 times the movement speed of the photosensitive drum surface facing the magnetic toner-carrying member surface, the electrostatic latent image is developed with the magnetic toner, wherein said magnetic toner on sail magnetic toner-carrying member has a coat weight of 3.0 mg/cm$^2$ or less.

6. The process cartridge according to claim 1, wherein said magnetic toner has a Carr's fluidity index of more than 60.

* * * * *

UNITED STATES PATENT AND TRADEMARK OFFICE

CERTIFICATE OF CORRECTION

PATENT NO. : 6,810,217 B2
DATED : October 26, 2004
INVENTOR(S) : Kaori Hiratsuka et al.

It is certified that error appears in the above-identified patent and that said Letters Patent is hereby corrected as shown below:

Column 2,
Line 45, “been” should read -- be --.

Column 3,
Line 53, “wherein;” should read -- wherein: --.

Column 4,
Line 13, “a” and “on” should be deleted.

Column 6,
Line 18, “of degree” should read -- of the degree --.

Column 8,
Lines 19 and 25, “residual-toner” should read -- residual toner --.

Column 16,
Line 4, “NR-®” should read -- NR-(R --.

Column 17
Line 30, “4-naphthoslulfonate” should read -- 4-naphthosulfonate --.
Line 31, “teterafluoroborate,” should read -- tetrafluoroborate, --.

Column 25,
Line 57, “pick-p” should read -- pick-up --.

Column 28,
Line 13, “(toner residual)” should read -- (residual toner) --.
Line 34, “also may” should read -- also --.

Column 29,
Line 10, “bank” should read -- blank --.

Column 31,
Line 36, “of” should be deleted.

Column 36,
Line 5, “pose,” should read -- pause, --.
Line 43, “30.00” should read -- 30.0° --.

UNITED STATES PATENT AND TRADEMARK OFFICE

CERTIFICATE OF CORRECTION

PATENT NO. : 6,810,217 B2
DATED : October 26, 2004
INVENTOR(S) : Kaori Hiratsuka et al.

It is certified that error appears in the above-identified patent and that said Letters Patent is hereby corrected as shown below:

Column 38,
Line 11, "(none-image" should read -- (non-image --.
Line 61, "in the" should read -- in --.

Column 40,
Lines 7 and 36, "toner-residual" should read -- residual toner --.

Column 42,
Line T1, "Y1/SO Y1/SO Y1/SO ZO/AO" should read -- Y1/S0 Y1/S0 Y1/S0 Z0/A0 --.

Column 43,
Line T4, "Toner-Residual" should read -- Residual Toner --.
Line T4, "toner-residual" should read -- residual toner --.
Line T4, "Toner=rsidual" should read -- Residual toner --.
Line T5, "Spatura" should read -- Spatula --.

Column 45,
Line T5, "Spatura" should read -- Spatula --.

Column 48,
Line 17, "sail" should read -- said --.

Signed and Sealed this

Thirty-first Day of May, 2005

JON W. DUDAS
*Director of the United States Patent and Trademark Office*